US011536133B2

(12) United States Patent
Sugiura et al.

(10) Patent No.: US 11,536,133 B2
(45) Date of Patent: Dec. 27, 2022

(54) DRILLING DYNAMICS DATA RECORDER

(71) Applicant: SANVEAN TECHNOLOGIES LLC, Katy, TX (US)

(72) Inventors: Junichi Sugiura, Bristol (GB); Stephen Jones, Cypress, TX (US)

(73) Assignee: SANVEAN TECHNOLOGIES LLC, Katy, TX (US)

( * ) Notice: Subject to any disclaimer, the term of this patent is extended or adjusted under 35 U.S.C. 154(b) by 180 days.

(21) Appl. No.: 15/677,244

(22) Filed: Aug. 15, 2017

(65) Prior Publication Data

US 2018/0066513 A1 Mar. 8, 2018

Related U.S. Application Data

(60) Provisional application No. 62/411,421, filed on Oct. 21, 2016, provisional application No. 62/375,302, filed on Aug. 15, 2016.

(51) Int. Cl.
*E21B 7/04* (2006.01)
*E21B 17/10* (2006.01)
(Continued)

(52) U.S. Cl.
CPC ..... *E21B 47/26* (2020.05); *E21B 7/04* (2013.01); *E21B 7/06* (2013.01); *E21B 44/00* (2013.01);
(Continued)

(58) Field of Classification Search
CPC ..... E21B 47/124; E21B 47/01
See application file for complete search history.

(56) References Cited

U.S. PATENT DOCUMENTS 5,136,525 A 8/1992 Cloud
5,139,094 A 8/1992 Prevedel et al.
(Continued)

FOREIGN PATENT DOCUMENTS

WO WO-0123704 A1 * 4/2001 ..... E21B 41/00
WO 2015/074101 A1 5/2015
WO 2016/108824 A1 7/2016

OTHER PUBLICATIONS https://www.merriam-webster.com/dictionary/proximate (Year: 2020).*
(Continued)

*Primary Examiner* — Robert E Fuller
*Assistant Examiner* — Theodore N Yao
(74) *Attorney, Agent, or Firm* — Ewing & Jones, PLLC

(57) ABSTRACT

A drilling dynamics data recorder is positioned within a slot in a downhole tool. The drilling dynamics data recorder may include a sensor package, the sensor package including one or more drilling dynamics sensors and a processor, the processor in data communication with the one or more drilling dynamics sensors. The drilling dynamics data recorder may also include a memory module, the memory module in data communication with the one or more drilling dynamics sensors and a communication port, the communication port in data communication with the memory module. The drilling dynamics data recorder may further include an electrical energy source, the electrical energy source in electrical communication with the memory module, the one or more drilling dynamics sensors, and the processor.

41 Claims, 46 Drawing Sheets

(51) Int. Cl.

| | |
|---|---|
| ***E21B 47/26*** | (2012.01) |
| ***E21B 47/01*** | (2012.01) |
| ***E21B 7/06*** | (2006.01) |
| ***E21B 47/017*** | (2012.01) |
| ***E21B 47/24*** | (2012.01) |
| ***E21B 44/00*** | (2006.01) |
| *E21B 10/26* | (2006.01) |

(52) U.S. Cl.
CPC ..... *E21B 47/01* (2013.01); *E21B 47/017* (2020.05); *E21B 47/24* (2020.05); *E21B 10/26* (2013.01); *E21B 17/1078* (2013.01)

(56) References Cited

U.S. PATENT DOCUMENTS

| | | | | |
|---|---|---|---|---|
| 6,142,228 | A | 11/2000 | Jogi et al. | |
| 6,585,043 | B1 | 7/2003 | Murray | |
| 7,025,136 | B2 | 4/2006 | Tulloch et al. | |
| 7,506,695 | B2 * | 3/2009 | Pastusek | E21B 21/08 175/40 |
| 2003/0056984 | A1 | 3/2003 | Smith et al. | |
| 2006/0065395 | A1 * | 3/2006 | Snell | E21B 41/0078 166/255.2 |
| 2006/0142945 | A1 | 6/2006 | McLaughlin | |
| 2007/0056771 | A1 | 3/2007 | Gopalan et al. | |
| 2007/0084277 | A1 | 4/2007 | Steinsiek | |
| 2009/0194332 | A1 * | 8/2009 | Pastusek | E21B 21/08 175/40 |
| 2009/0205869 | A1 | 8/2009 | Prill et al. | |
| 2010/0133006 | A1 | 6/2010 | Shakra et al. | |
| 2010/0161227 | A1 * | 6/2010 | Deere | E21B 47/124 702/9 |
| 2011/0308784 | A1 | 12/2011 | Ollerenshaw et al. | |
| 2012/0097823 | A1 | 4/2012 | Murray et al. | |
| 2012/0325561 | A1 | 12/2012 | Leblanc et al. | |
| 2013/0008640 | A1 | 1/2013 | Epperson et al. | |
| 2013/0147633 | A1 * | 6/2013 | Sumrall | E21B 47/124 340/854.4 |
| 2014/0069639 | A1 | 3/2014 | MacKenzie et al. | |
| 2014/0102797 | A1 | 4/2014 | Mahajan et al. | |
| 2015/0167392 | A1 | 6/2015 | Sugiura | |
| 2017/0254190 | A1 | 9/2017 | Jones et al. | |
| 2019/0106981 | A1 * | 4/2019 | Hailey | E21B 17/006 |

OTHER PUBLICATIONS https://www.merriam-webster.com/dictionary/bolt (Year: 2020).*
International Search Report and Written Opinion issued in PCT/US17/46880, dated Dec. 8, 2017, 22 pages.

* cited by examiner

DRILLING DYNAMICS DATA RECORDER

CROSS REFERENCE TO RELATED APPLICATIONS

This application is a nonprovisional application that claims priority from U.S. provisional application No. 62/375,302, filed Aug. 15, 2016, and from U.S. provisional application No. 62/411,421, filed Oct. 21, 2016, both of which are incorporated herein by reference.

TECHNICAL FIELD/FIELD OF THE DISCLOSURE

The present disclosure relates generally to downhole drilling tools, and specifically to drilling dynamics data recorders for downhole tools.

BACKGROUND OF THE DISCLOSURE

Wellbores are traditionally formed by rotating a drill bit positioned at the end of a bottom hole assembly (BHA). The drill bit may be actuated by rotating the drill pipe, by use of a mud motor, or a combination thereof. As used herein, the BHA includes the drill bit. Conventionally, BHAs may contain only a limited number of sensors and have limited data processing capability. The operating life of the drill bit, mud motor, bearing assembly, and other elements of the BHA may depend upon operational parameters of these elements, and the downhole conditions, including, but not limited to rock type, pressure, temperature, differential pressure across the mud motor, rotational speed, torque, vibration, drilling fluid flow rate, force on the drill bit or the weight-on-bit ("WOB"), inclination, total gravity field, gravity toolface, revolutions per minute (RPM), radial acceleration, tangential acceleration, relative rotation speed and the condition of the radial and axial bearings. The combination of the operational parameters of the BHA and downhole conditions are referred to herein as "drilling dynamics."

To supplement conventional BHA sensors, drilling dynamics data may be measured by drilling dynamics sensors. Measurement of these aspects of elements of the BHA may provide operators with information regarding performance and may indicate need for maintenance. Conventional downhole drilling dynamics sensors are located on a dedicated sub used to house the sensors. The conventional downhole drilling dynamics sensor sub is mechanically coupled to a portion of the drill string or the desired downhole drilling equipment, directly or indirectly.

SUMMARY

The present disclosure provides for a drilling dynamics data recorder positioned within a slot in a downhole tool. The drilling dynamics data recorder includes a sensor package, the sensor package including one or more drilling dynamics sensors and a processor, the processor in data communication with the one or more drilling dynamics sensors. The drilling dynamics data recorder also includes a memory module, the memory module in data communication with the one or more drilling dynamics sensors and a communication port, the communication port in data communication with the memory module. The drilling dynamics data recorder further includes an electrical energy source, the electrical energy source in electrical communication with the memory module, the one or more drilling dynamics sensors, and the processor.

In addition, the present disclosure provides for a drilling dynamics data recorder system. The drilling dynamics data recorder system includes a drilling dynamics data recorder. The drilling dynamics data recorder includes a sensor package, the sensor package including one or more drilling dynamics sensors. The drilling dynamics data recorder also includes a memory module, the memory module in data communication with the sensor package and a communication port, the communication port in data communication with the memory module. The drilling dynamics data recorder further includes a processor, the processor in data communication with the drilling dynamics sensor, and an electrical energy source, the electrical energy source in electrical communication with the memory module, the sensor package, and the processor. The drilling dynamics data recorder system also includes a downhole tool, the drilling dynamics data recorder within the downhole tool.

The present disclosure also provides for a method. The method includes providing a drilling dynamics data recorder, the drilling dynamics data recorder positioned within a downhole tool. The drilling dynamics data recorder includes a sensor package, the sensor package having one or more drilling dynamics sensors. The drilling dynamics data recorder also includes a memory module, the memory module in data communication with the sensor package and a communication port, the communication port in data communication with the memory module. The drilling dynamics data recorder further includes a processor, the processor in data communication with the one or more drilling dynamics sensors, and an electrical energy source, the electrical energy source in electrical communication with the memory module, the sensor package, and the processor. The method also includes positioning the downhole tool within a wellbore, taking measurements using the drilling dynamics sensors, and transmitting the measurements from the drilling dynamics sensors to the memory module. The method further includes memory logging the measurements from the one or more drilling dynamics sensors in the memory module to form drilling dynamics data.

The present disclosure also provides for a downhole tool having a bearing assembly. The bearing assembly may include an upper bearing housing. The upper bearing housing may include an upper bearing housing outer surface. The upper bearing housing outer surface may be generally cylindrical along a bearing housing longitudinal axis. The upper bearing housing may include an upper bearing housing bore formed therein defining an upper bearing housing inner surface. The upper bearing housing bore may be generally cylindrical and may be formed along a bore longitudinal axis. The bore longitudinal axis may be formed at an angle to the bearing housing longitudinal axis. The bearing assembly may include a lower bearing housing. The lower bearing housing may be mechanically coupled to the upper bearing housing. The lower bearing housing may include a lower bearing housing bore formed along the bore longitudinal axis defining a lower bearing housing inner surface. The bearing assembly may include a driveshaft positioned within and concentric with the upper bearing housing bore and the lower bearing housing bore such that it extends along the bore longitudinal axis. The downhole tool may also include a first drilling dynamics data recorder positioned within a slot in the upper bearing housing. The drilling dynamics data recorder includes a sensor package, the sensor package including one or more drilling dynamics sensors and a processor, the processor in data communication with the one or more drilling dynamics sensors. The drilling dynamics data recorder also includes a memory module, the memory module in data communication with the one or more drilling dynamics sensors and a communication port, the communication port in data communication with the memory module. The drilling dynamics data recorder further includes an electrical energy source, the electrical energy source in electrical communication with the memory module, the one or more drilling dynamics sensors, and the processor.

The present disclosure also provides for a downhole tool. The downhole tool may include a housing rotatably coupled to and positioned about a mandrel. The downhole tool may include a steering blade positioned on the housing. The steering blade may be extendable by an extension force to contact a wellbore, the extension force caused by a differential pressure between a steering cylinder and a pressure in a surrounding wellbore. The differential pressure may be caused by fluid pressure of a fluid within the steering cylinder. The steering cylinder may be positioned within the housing. The steering blade may be at least partially positioned within the steering cylinder. The steering cylinder fluidly coupled to a steering port. The downhole tool may include an adjustable orifice. The adjustable orifice may be fluidly coupled between the interior of the mandrel and the steering cylinder. The adjustable orifice may be adjustable between an open position and at least one of a partially open position and a closed position. The downhole tool further includes a bit box, the bit box coupled to the mandrel and an upper mandrel, the upper mandrel coupled to the mandrel. The downhole tool also includes one or more drilling dynamics data recorders, each of the drilling dynamics data recorders positioned within a slot in the downhole tool.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
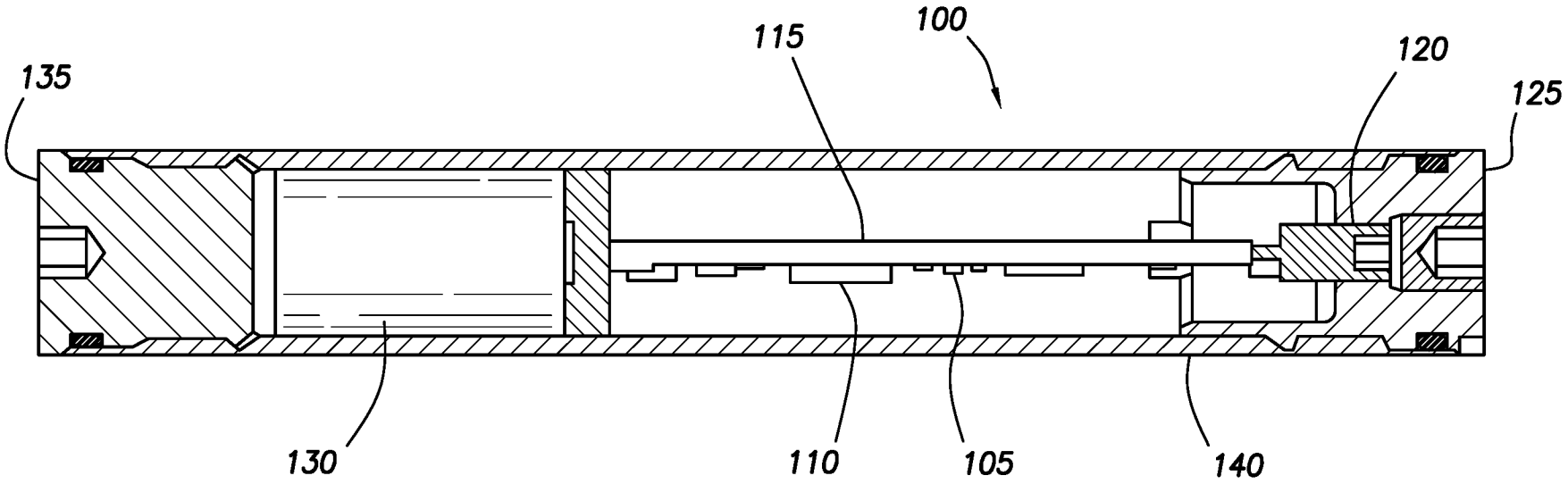
FIG. 1 depicts a cross section of a drilling dynamics data recorder consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts an embodiment of drilling dynamics data recorder 100 consistent with at least one embodiment of the present disclosure. The embodiment of drilling dynamics data recorder shown in FIG. 1 is a "pressure barrel" design. Drilling dynamics data recorder 100 includes sensor package 110. Sensor package 110 may include drilling dynamics sensors including, but not limited to, low-g accelerometers for determination of inclination, total gravity field, radial acceleration, tangential acceleration, and/or low-g vibration sensing; and/or gravity toolface; high-g accelerometers for shock sensing; temperature sensors; three-axis gyroscopes for rotation speed (angular velocity) computation; Hall-effect sensors to measure relative rotation speed, along with a magnetic marker[s]; one or more strain gauges to measure one or more of tension, compression, torque on bit, weight on bit, bending moment, bending toolface, and pressure; and magnetometers for rotation speed (angular velocity) computation. Sensor package 110 may include any or all of drilling dynamics sensors listed and may include other drilling dynamics sensors not listed. Sensor package 110 may include redundant sensors, for example and without limitation, two 3-axis low-g accelerometers and/or two 3-axis gyro sensors. Redundant sensors may improve reliability and accuracy. Further, the drilling dynamics sensors may be used for determination of other drilling dynamics data other than that listed. In certain embodiments, the drilling dynamics sensors are digital, solid-state sensors. The digital, solid-state sensors may create less noise, have a smaller footprint, have lower mass, be more shock-resistant, be more reliable and have better power management than analog sensors. In certain embodiments, the accelerometers may be three-axis accelerometers. The three-axis accelerometers may be digital or analog sensors, including, but not limited to quartz accelerometers. In some embodiments, the gyroscopes may be three-axis gyroscopes.

As used herein, low-g accelerometers may measure up to between +/−16G. As used herein, high-g accelerometers may measure up to between +/−200G. Rotation speed in RPM (revolutions per minute) may be measured, for example, between 0 and 500 RPM. Temperature may be measured, for example, between −40° C. and 175° C., between −40° C. and 150° C. or between −40° C. and 125° C. As further described herein below, the measurement range of the sensors may be programmable while drilling dynamics data recorder 100 is within the wellbore. For example, the low-g accelerometers measurement range may be changed from +/−4G to +/−16G while drilling.

With further attention to FIG. 1, drilling dynamics data recorder 100 may include memory module 115 in data communication with sensor package 110. Memory module 115 is adapted to store data gathered by the sensors in sensor package 110. Memory module 115 is in data communication with communication port 120. Communication port 120 is adapted to provide a data communications link between memory module 115 and a surface processor. Communication port 120 may be adapted to communicate with other processors in a communication bus (e.g. MWD tool) via a common communication bus, for example, transmitting drilling dynamics data, statistics based on drilling dynamics data, rock mechanics information, or a combination thereof to surface via MWD.

Also depicted in FIG. 1 is processor 105. Processor 105 may be in data communication with the sensors in sensor package 110 and memory module 115. Processor 105 may control the operation of the sensors in sensor package 110, as described herein below. Processor 105 may include application software/firmware stored on a computer readable media, such as program Flash memory, which is part of Processor 105. One non-limiting example of processor 105 with program Flash memory is a 16-bit microcontroller, Model SM470R1B1M-HT from Texas Instruments (Dallas, Tex., USA). The application software/firmware may include instructions, for example and without limitation, for executing deep-sleep mode, standby mode, and active mode, as described herein below. The application software/firmware in processor 105 may be loaded and replaced, via communication port bus 176 through communication port 120, by a surface processor. Drilling dynamics data recorder 100 may further include a real-time clock, an oscillator, a fuse, and a voltage regulator. Processor 105 includes, but is not limited to a microcontroller, microprocessor, DSP (digital signal processor), DSP controller, DSP processor, FPGA (Field-Programmable Gate Array) or combinations thereof.

Memory module 115, processor 105, and sensor package 110 and/or the sensors in sensor package 110 may be in electrical communication with electrical energy source 130. Electrical energy source 130 provides power to processor 105, memory module 115, and the sensors in sensor package 110. In some non-limiting embodiments, electrical energy source 130 may be a lithium battery. In yet other embodiments, electrical energy source 130 may be electrically connected to sensors in sensor package 110 indirectly through a voltage regulator. In other embodiments, electrical energy source 130 may be positioned in a package separate from sensor package 110. In certain embodiments, electrical energy source 130 is a battery, such as a rechargeable battery or a non-rechargeable battery. In other embodiments, electrical energy source 130 may be a rechargeable or non-rechargeable battery with an energy harvesting device. The energy harvesting device may be a piezo-electric energy harvester or a MEMS energy harvester.

As depicted in FIG. 1, processor 105, sensor package 110, memory module 115, communication port 120, and electrical energy source 130 may be housed within pressure barrel 140. In the embodiment depicted in FIG. 1, pressure barrel 140 is cylindrical or generally cylindrical. In other embodiments, pressure barrel 140 may be of other shapes adapted to contain processor 105, sensor package 110, memory module 115, communication port 120, and electrical energy source 130. In some embodiments, the pressure within pressure barrel 140 is atmospheric or near-atmospheric pressure. In some embodiments, the pressure rating for pressure barrel 140 may be at least 15,000 psi. In some embodiments, the downhole battery life of electrical energy source 130 may be at least 240 hours (or 10 days), and in some embodiments, memory module 115 may have at least 16 M Bytes of storage. In some embodiments, memory module 115 may have up to 4 G Bytes of storage.

As further shown in FIG. 1, end caps 125, 135 may be fitted to the ends of pressure barrel 140. In certain embodiments, communication port 120 may protrude through memory dump end cap 125.

Figure 1A:
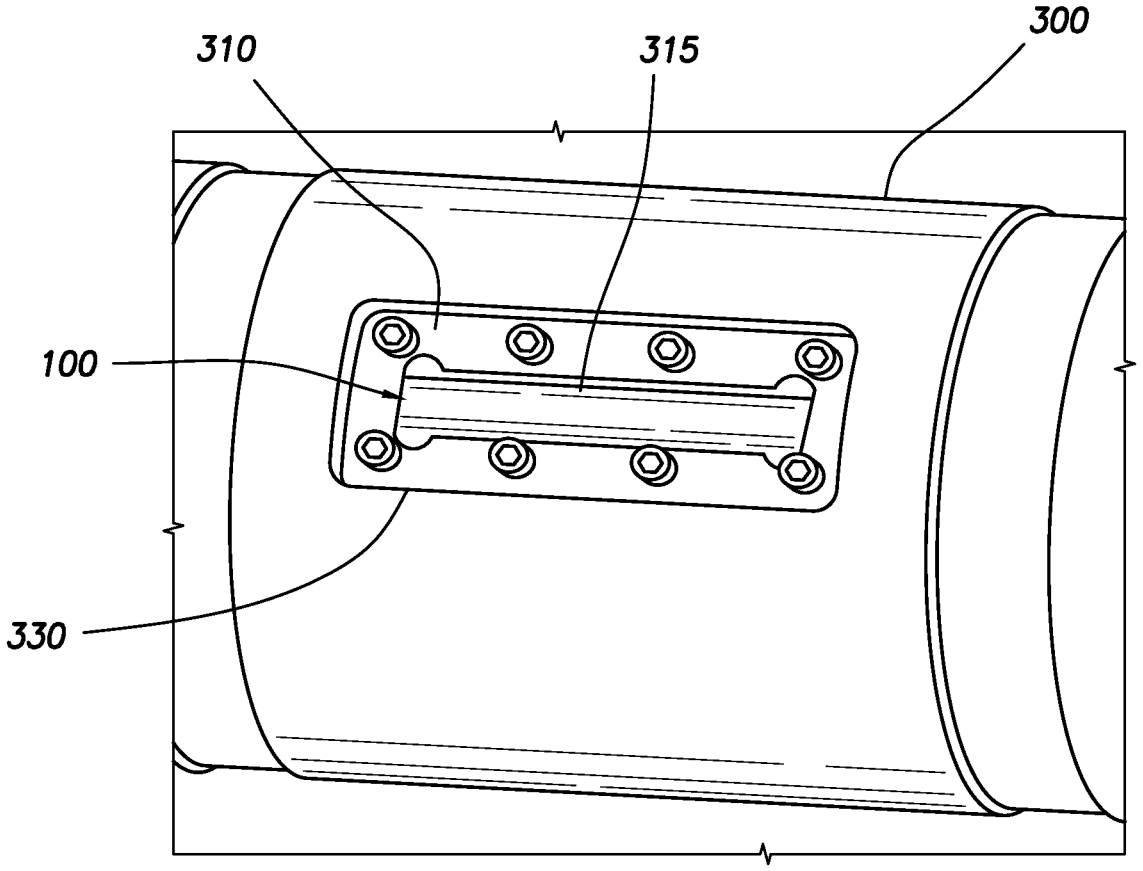
FIG. 1A depicts the drilling dynamics data recorder of FIG. 1 within a downhole tool consistent with at least one embodiment of the present disclosure.
Figure 1B:
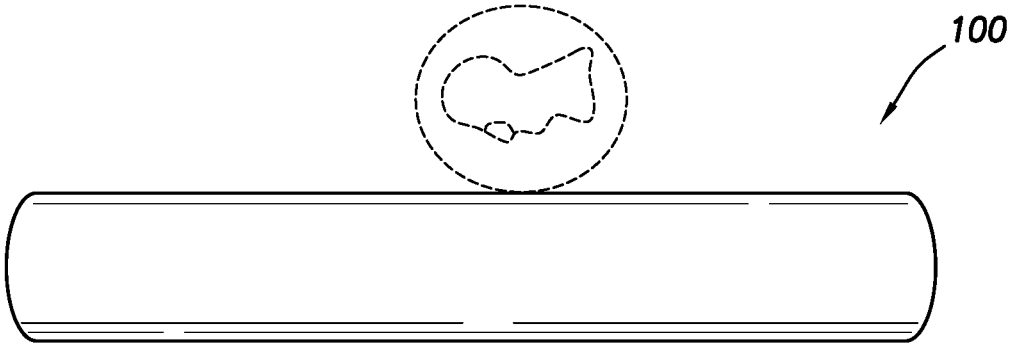
FIG. 1B is a photograph of the drilling dynamics data recorder of FIG. 1.
Figure 1C:
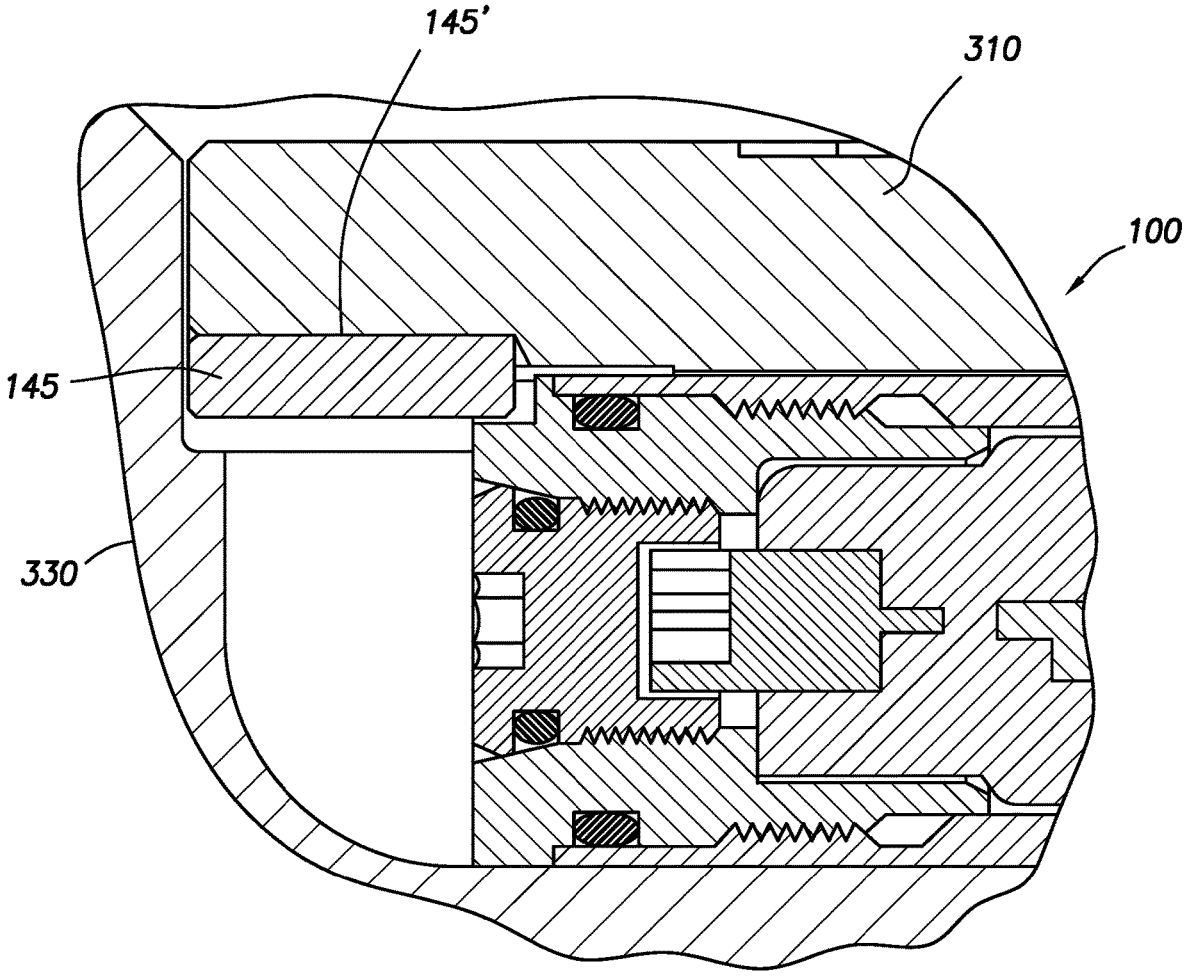
FIG. 1C is a partial cross-section of a drilling dynamics data recorder and hatch cover consistent with at least one embodiment of the present disclosure.

FIG. 1A depicts drilling dynamics data recorder 100 within downhole tool 300 in one embodiment of the present disclosure. Downhole tool 300 may be any component of a drill or tool string within a wellbore, and may include, for example and without limitation, a component of a BHA, drill bit, stabilizer, cross-over, drill pipe, drill collar, pin-box connection, jar, reamer, underreamer, friction reducing tool, string stabilizer, near-bit stabilizer, mud motor, turbine, stick-slip mitigation tool, or bearing housing. As shown in FIG. 1A, drilling dynamics data recorder may be placed behind hatch cover 310 in slot 315 in downhole tool 300. Slot 315 may be machined or drilled, for example, into outside surface 330 of downhole tool 300. FIG. 1B depicts the relative size of drilling dynamics data recorder 100 consistent with certain embodiments of the present disclosure. The size of drilling dynamics data recorder 100 depicted in FIG. 1B is not limiting and may be of any size consistent with usage in downhole tool 300. In some embodiments, as depicted in FIG. 1C, drilling dynamics data recorder 100 may include location pin 145. Location pin 145 may engage with locator slot 145' of hatch cover 310.

Figure 2:
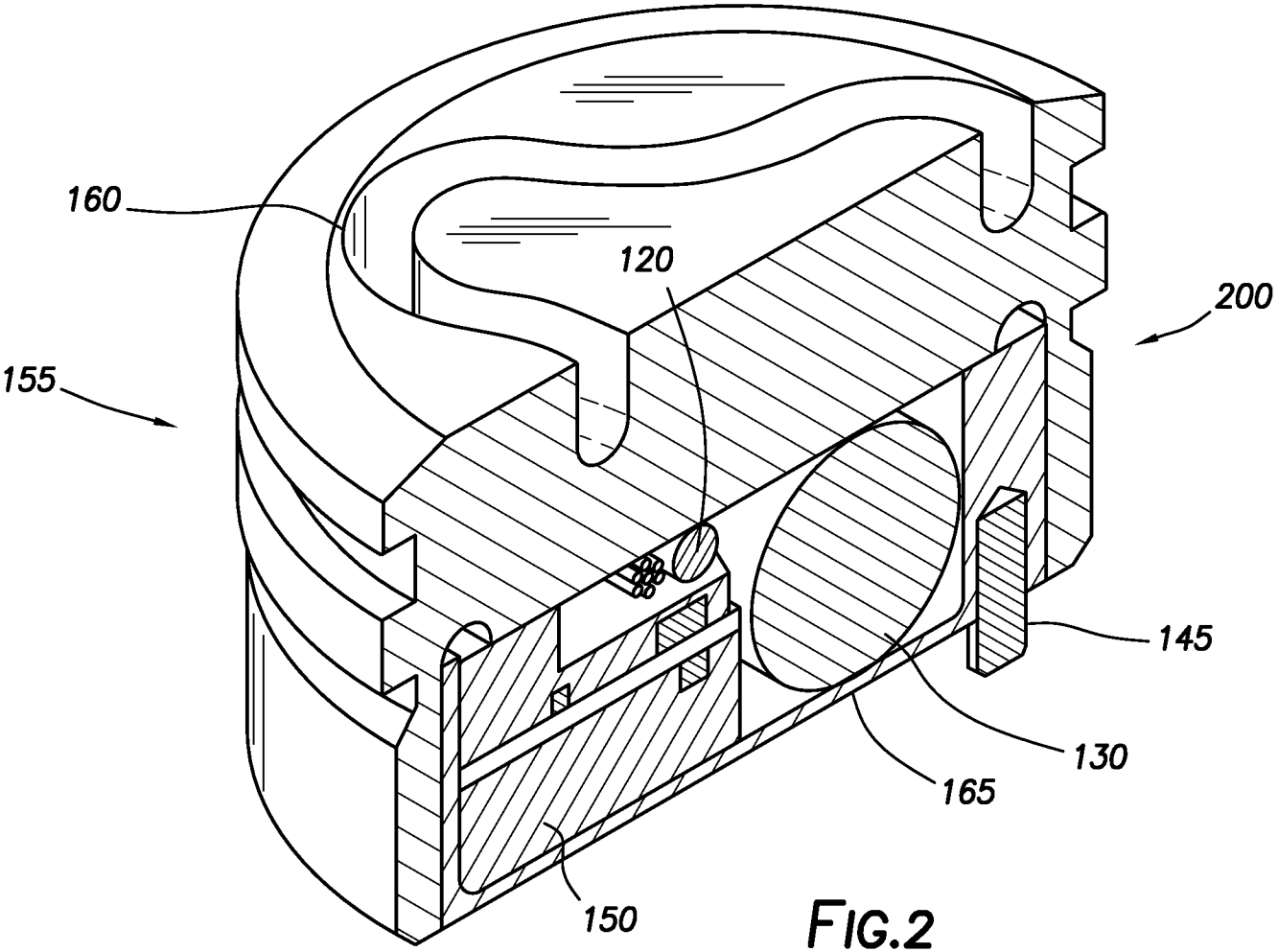
FIG. 2 depicts a cross section of a drilling dynamics data recorder consistent with at least one embodiment of the present disclosure.

FIG. 2 depicts drilling dynamics data recorder 200 consistent with certain embodiments of the present disclosure. The embodiment of drilling dynamics data recorder 200 shown in FIG. 2 is a "hockey-puck" design. Drilling dynamics data recorder 200 includes communication port 120 and electrical energy source 130. Drilling dynamics data recorder 200 also includes data/sensor module 150. Data/sensor module 150 may include a processor, sensor package containing sensors, and memory module, as those elements are described above with respect to drilling dynamics data recorder 100. Data/sensor module 150 may be in data communication with communication port 120.

Figure 2A:
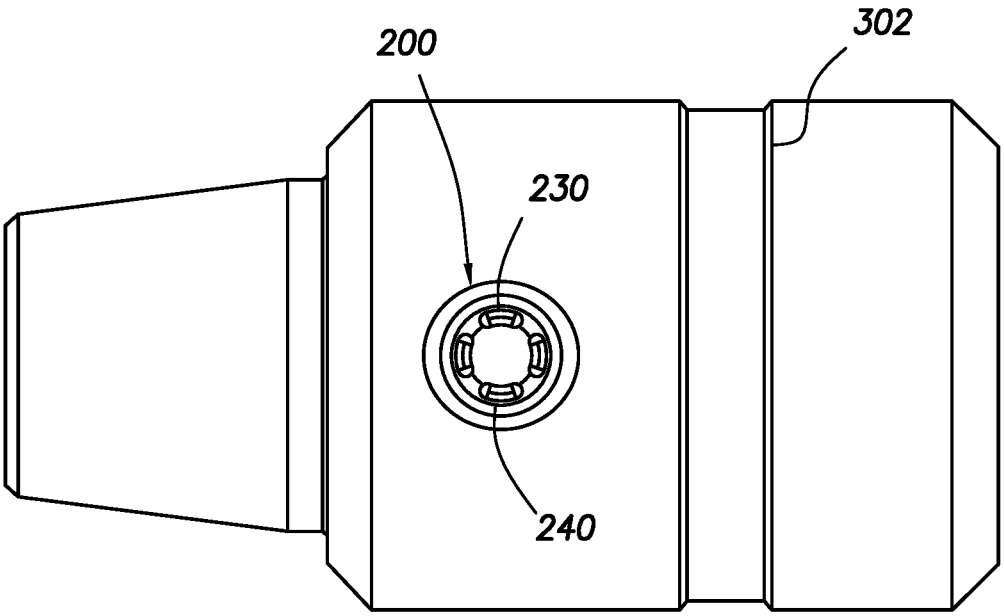
FIG. 2A depicts the drilling dynamics data recorder of FIG. 2 within a downhole tool consistent with at least one embodiment of the present disclosure.

The hockey-puck design of drilling dynamics data recorder 200 depicted in FIG. 2 may include disk 155. In some embodiments, disk 155 may include recorder cap 160 and recorder carrier 165. In certain embodiments, communication port 120 may be positioned within disk 155, accessible by removing recorder cap 160 from recorder carrier 165. In some embodiments, drilling dynamics data recorder 200 may include location pin 145 formed as part of or mechanically coupled to recorder carrier 165. In some embodiments, communication port 120 may be positioned proximate to or within location pin 145. FIG. 2A depicts a non-limiting embodiment of the present disclosure drilling dynamics data recorder 200 within bit sub 302 of, for example and without limitation, a motor mandrel. As depicted in FIGS. 2C, 2D, bit sub 302 may be mechanically coupled to motor mandrel 305. Motor mandrel 305 may include pin-down lower coupler 307*a* as depicted in FIG. 2C, or may include box-down lower coupler 307*b* as depicted in FIG. 2D. In certain embodiments, drilling dynamics data recorder 200 may be positioned within screw housing 230. Screw housing may include screw housing threads for threadedly connecting to threaded slot 240, as shown in FIG. 2A. The hockey puck design of drilling dynamics data recorder 200 may be used, for example and without limitation, in areas with limited space such as a motor mandrel bit box, turbine mandrel, a steerable tool bit box, a vertical drilling tool bit box, a steerable tool upper mandrel, a vertical drilling tool upper mandrel, stabilizer, ball seat or a shank of a drill bit. In some embodiments, drilling dynamics data recorder 100 or 200 may be used in any of these tools.

Figure 2B:
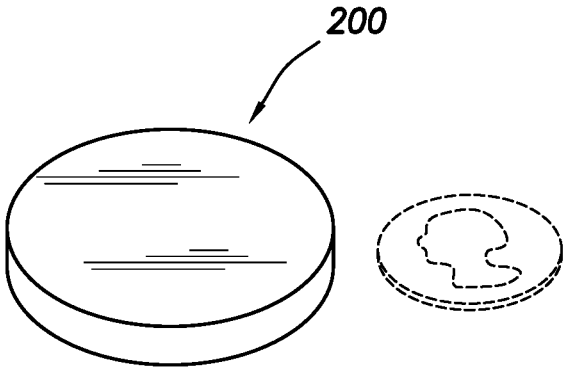
FIG. 2B is depicts the drilling dynamics data recorder of FIG. 2.
Figure 2C:
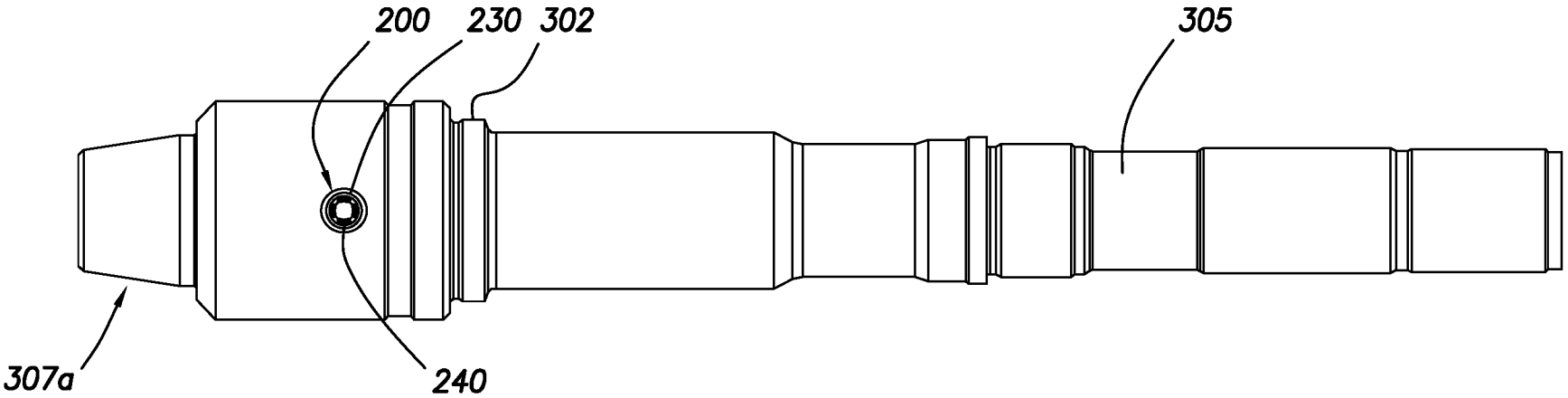
FIG. 2C is a side view of a motor mandrel including a drilling dynamics data recorder consistent with at least one embodiment of the present disclosure.
Figure 2D:
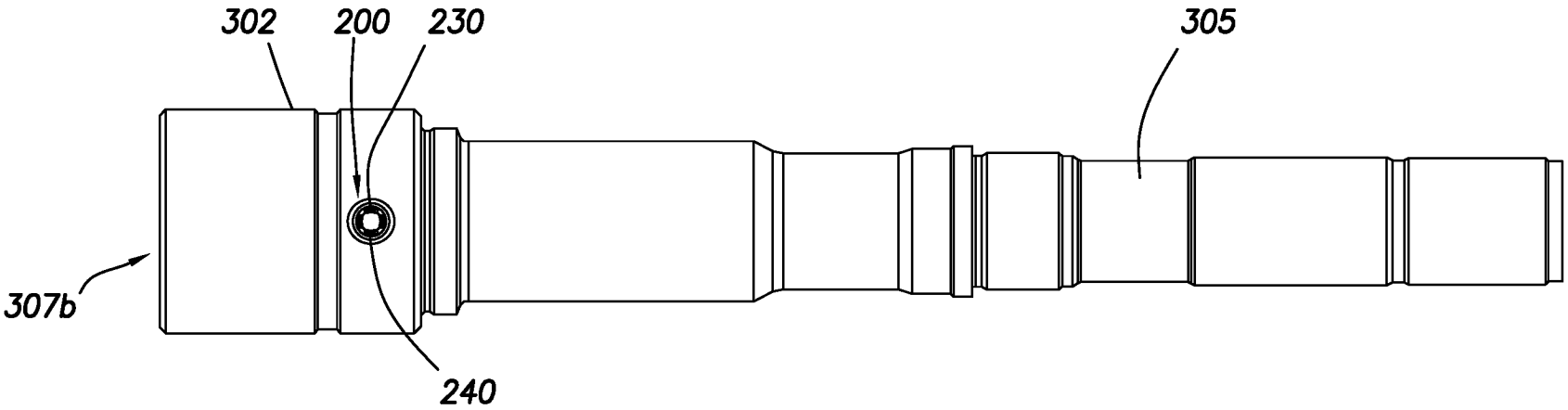
FIG. 2D is a side view of a motor mandrel including a drilling dynamics data recorder consistent with at least one embodiment of the present disclosure.

FIG. 2B depicts the relative size of drilling dynamics data recorder 200 consistent with certain embodiments of the present disclosure. The size of drilling dynamics data recorder 200 depicted in FIG. 2B is not limiting and may be of any size consistent with usage in downhole tool 300.

In certain embodiments, drilling dynamics data recorder 100 and drilling dynamics data recorder 200 are self-contained in that while recording data, no power is supplied from outside drilling dynamics data recorder 100 or drilling dynamics data recorder 200, respectively. In other embodiments, electrical power may be supplied from outside drilling dynamics data recorder 100 and 200, such as from a self-contained, separate electrical power module, for example, batteries.

Figure 14:
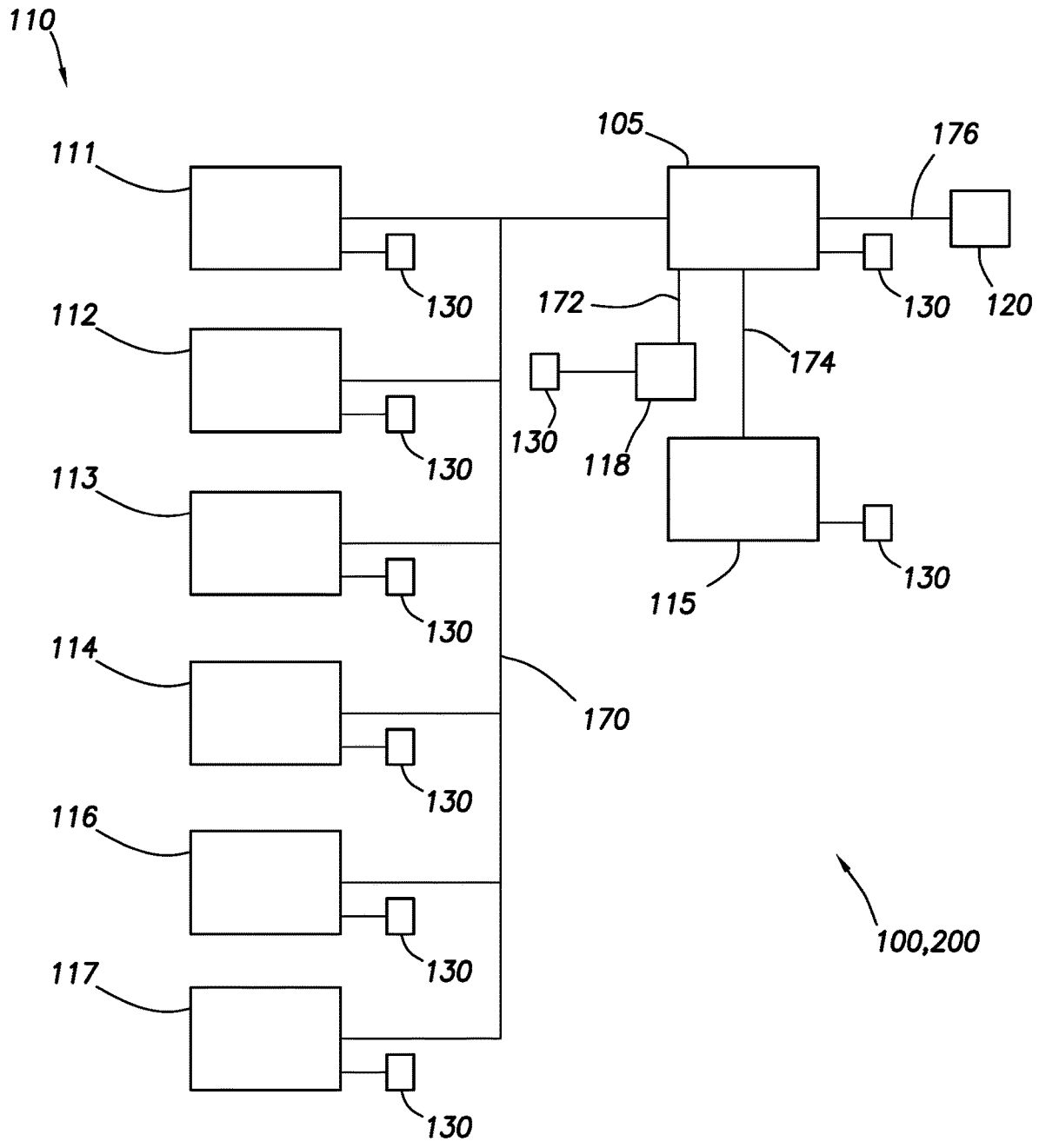
FIG. 14 is a block diagram of a drilling dynamics data recorder consistent with at least one embodiment of the present disclosure.

FIG. 14 depicts a block diagram of drilling dynamics data recorder 100, 200. Drilling dynamics data recorder includes sensor package 110 which includes one or more sensors. In the embodiment shown in FIG. 14, the sensors include low-g accelerometer 111, high-g accelerometer 112, gyroscope 113, and temperature sensor 114. In some embodiments, such as the embodiment shown in FIG. 14, the sensors also include magnetometer 116 and pressure sensor 117. In other embodiments, sensor package 110 may include any of sensors 111, 112, 113, 114, 116, and 117. Sensors 111, 112, 113, 114, 116, and 117 may be in data communication with processor 105 through sensor communication bus 170. Sensor communication bus 170 may be a digital communication bus, such as an SPI (Serial Peripheral Interface) bus or an $I^2C$ (Inter-Integrated Circuit) bus.

In certain embodiments, Hall-effect sensor 118 is in data communication with processor 105 through Hall-effect sensor bus 172. Hall-effect sensor bus 172 may be a digital communication bus, such as an SPI or an $I^2C$ bus. In some embodiments, Hall-effect sensor 118 is directly connected to processor 105 via an input port, for example, an interrupt pin or an analog-to-digital-converter pin. In other embodiments, Hall-effect sensor 118 may be a digital Hall-effect sensor or analog (ratio-metric) Hall-effect sensor. In other embodiments, Hall-effect sensor 118 may be omitted.

In the embodiment depicted in FIG. 14, memory module 115 is in data communication with processor 105 through memory communication bus 174. Memory communication bus 174 may be a CAN (Controller Area Network) bus, an SPI or an $I^2C$ bus in certain non-limiting examples. Thus, sensors 111, 112, 113, 114, 116, and 117 are in data communication with memory module 115 through sensor communication bus 170, processor 105, and memory communication bus 174. Hall-effect sensor 118 is in data communication with memory module 115 through Hall-effect sensor bus 172, processor 105 and memory communication bus 174. Memory module 115 may contain multiple memory devices, such as between 2 and 8 memory devices or 4 memory devices. Memory device may preferably be non-volatile, such as Flash or EEPROM (Electrically Erasable Programmable Read-Only Memory) device. One non-limiting example of EEPROM device is a 1-kbit SPI EEPROM, Model 25LC010A from Microchip (Chandler, Ariz., USA).

As further shown in FIG. 14, processor 105 is in data communication with communication port 120 through communication port bus 176. Communication port bus may be a digital communication bus, including, but not limited to, a SCI (Serial Communication Interface) bus, a UART (Universal Asynchronous Receiver/Transmitter) bus, a CAN bus, a SPI bus or a $I^2C$ bus. Communication port 120 may be in data communication with memory module 115 through memory communication bus 174, processor 105, and communication port bus 176. One non-limiting example of processor 105 with such communication bus feature is a 16-bit microcontroller, Model SM470R1B1M-HT from Texas Instruments (Dallas, Tex., USA).

Figure 15:
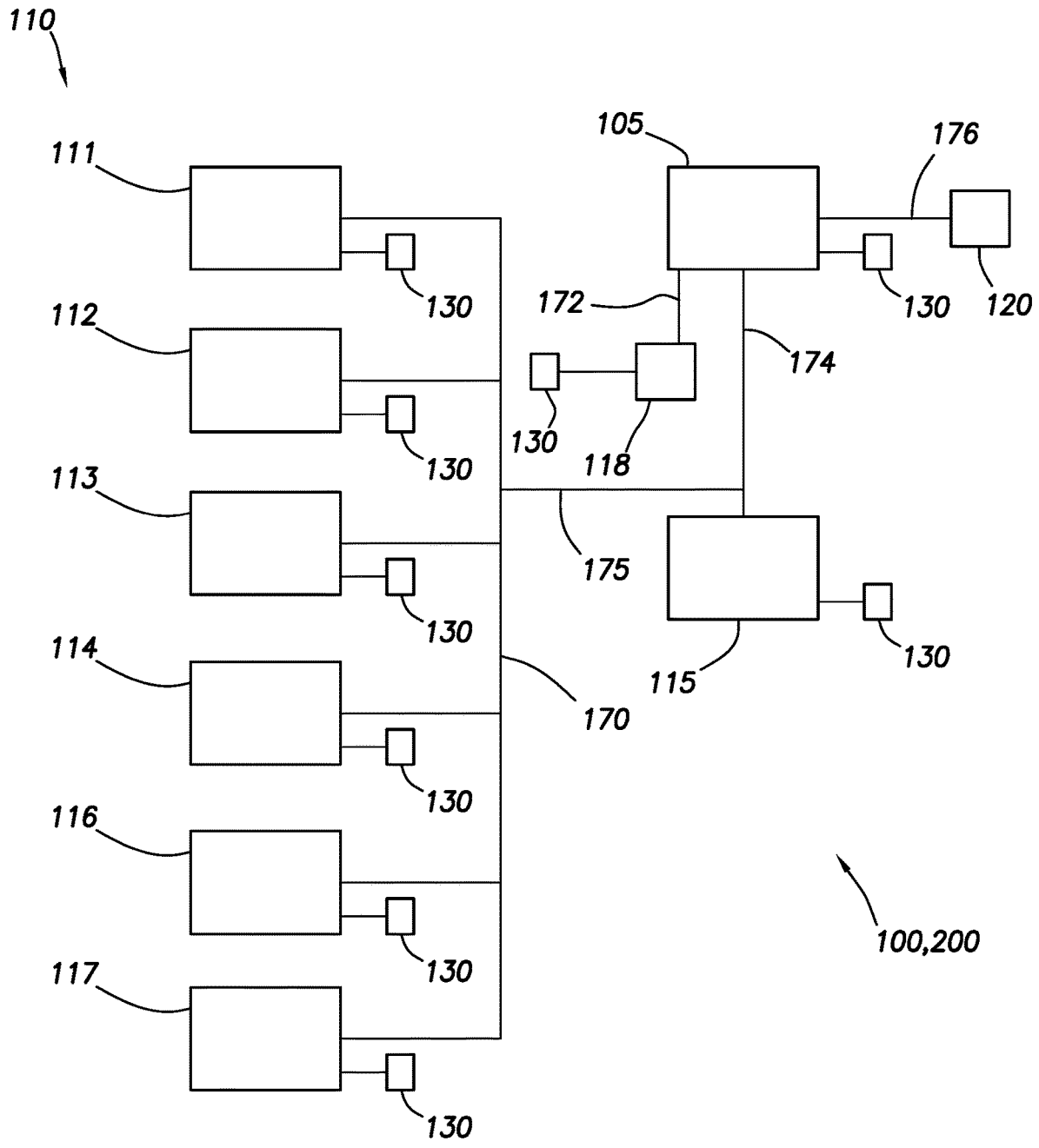
FIG. 15 is a block diagram of a drilling dynamics data recorder consistent with at least one embodiment of the present disclosure.

FIG. 15 depicts another embodiment of a block diagram of drilling dynamics data recorder 100, 200. In FIG. 15, sensor communication bus 170 and memory communication bus 174 are connected to form sensor-memory bus 175.

In the embodiments shown in FIGS. 14 and 15, electrical energy source 130 is in electrical connection with each of sensors 111, 112, 113, 114, 116, 117, processor 105, and memory module 115. In some embodiments, electrical energy source 130 may be electrically connected to each of sensors 111, 112, 113, 114, 116, 117 directly. In other embodiments, electrical energy source 130 may be electrically connected to each of sensors 111, 112, 113, 114, 116, 117 indirectly through a connection to sensor package 110. In yet other embodiments, electrical energy source 130 may be electrically connected to each of sensors 111, 112, 113, 114, 116, 117 indirectly through a voltage regulator.

Figure 3:
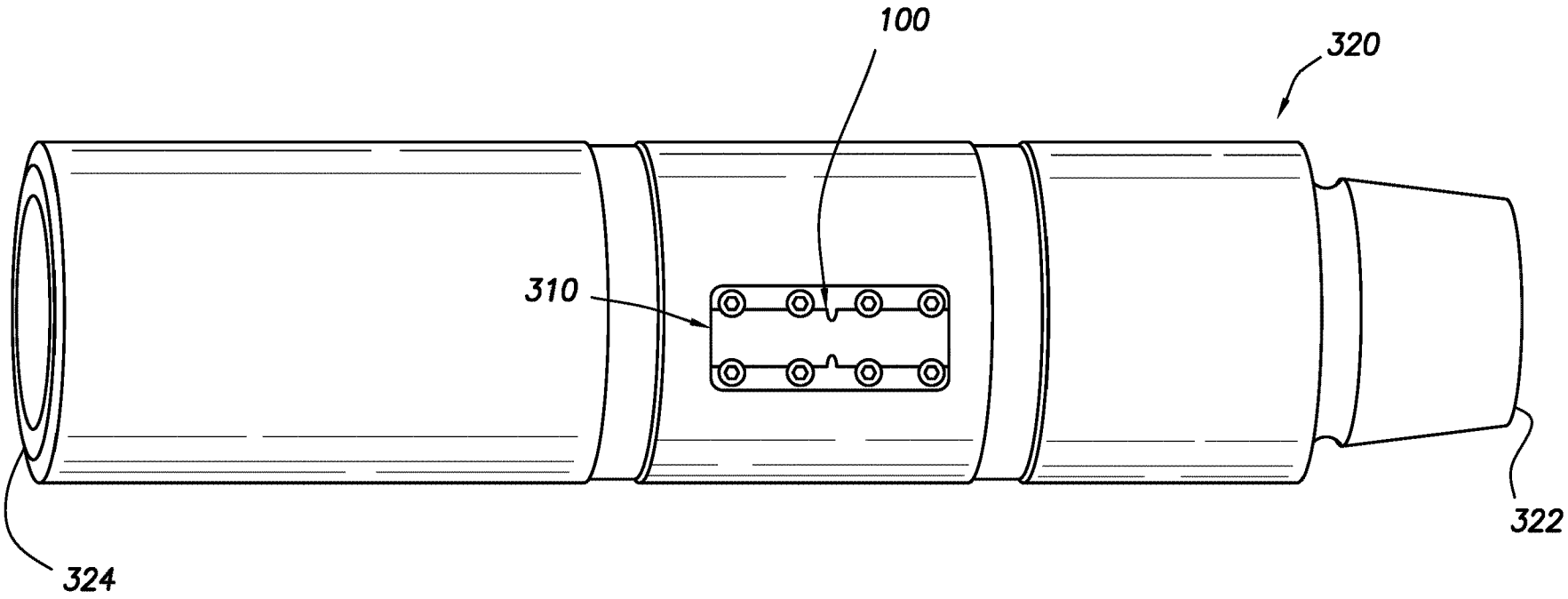
FIG. 3 depicts a drilling dynamics data recorder within a carrier sub consistent with at least one embodiment of the present disclosure.

FIG. 3 depicts drilling dynamics data recorder 100 within carrier sub 320 consistent with at least one embodiment of the present disclosure. In other embodiments, drilling dynamics data recorder 200 may be positioned within carrier sub 320. Carrier sub 320 may be inserted into a drill string, for examples and without limitation, between two joints of a drill string. In some embodiments, carrier sub 320 may be a bit sub. In some embodiments, carrier sub 320 may include male threaded connection 322 and female threaded connection 324 for threaded insertion into the drill string. Although not depicted, in other embodiments, carrier sub 320 may include two female threaded connections or two male threaded connections.

Figure 4:
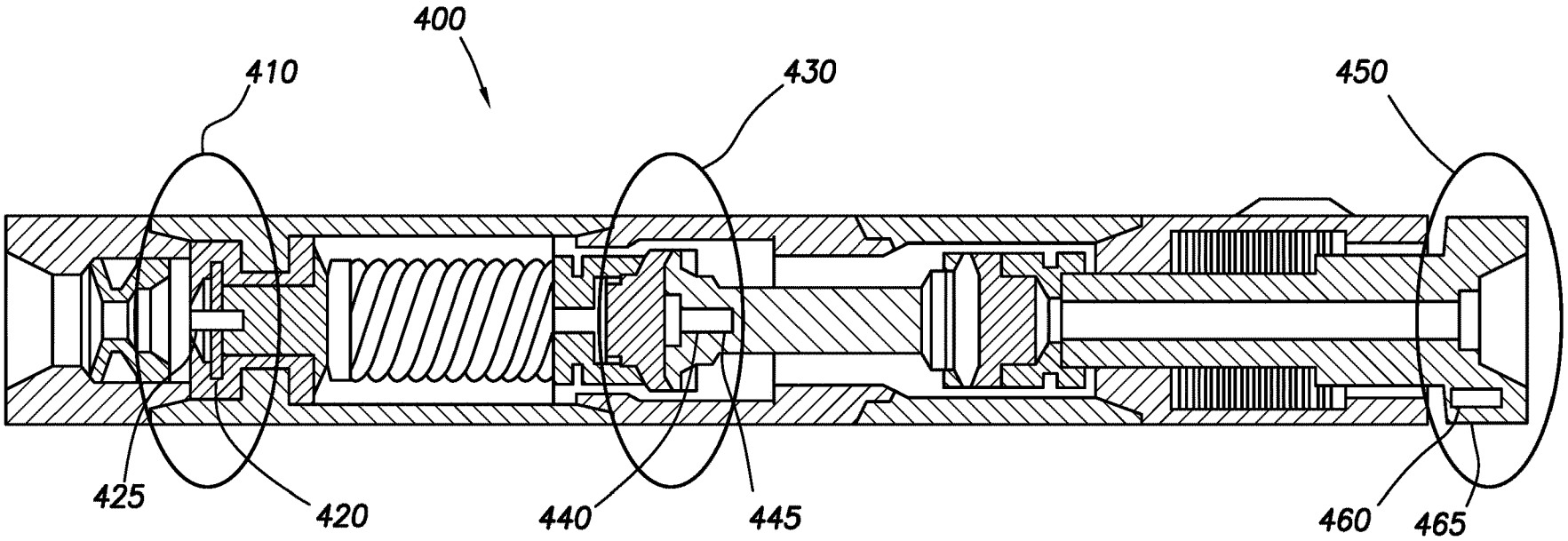
FIG. 4 depicts drilling dynamics data recorders within a mud motor consistent with at least one embodiment of the present disclosure.
Figure 4A:
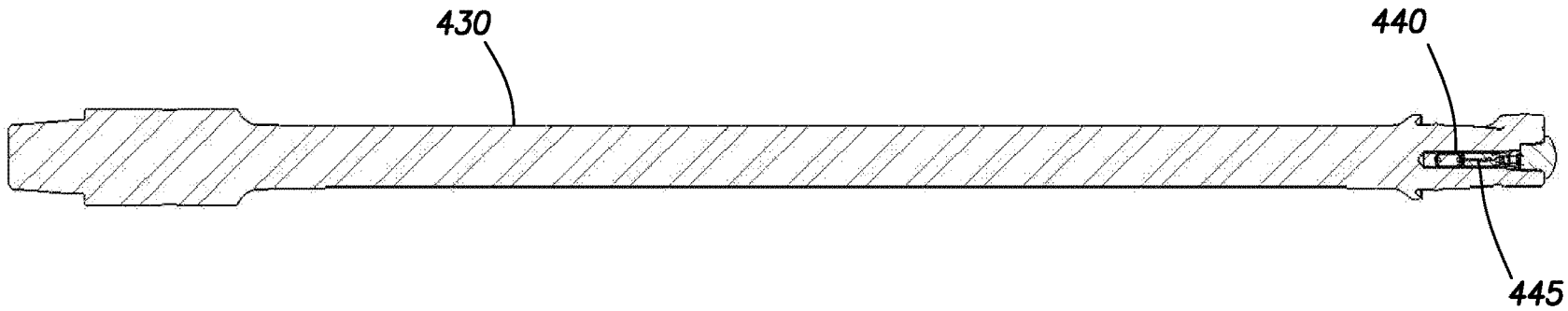
FIG. 4A depicts a transmission of a mud motor consistent with at least one embodiment of the present disclosure.

Drilling dynamics data recorder 100, 200 may be used with a variety of downhole tools of which bit sub 302 is a part. In one non-limiting example, drilling dynamics data recorder 100 may be used with mud motor 400, as shown in FIG. 4. Mud motor 400 may include rotor catch 410 within a top sub, transmission 430 and bit box 450. As shown in FIG. 4, rotor catch recorder 425 may be positioned within rotor catch slot 420, located, for instance, proximate rotor catch 410, and bit box recorder 465 may be positioned in bit box slot 460, located proximate bit box 450. In certain embodiments, such as shown in FIG. 4, transmission recorder 445 may be positioned within transmission slot 440 located proximate transmission 430. Although depicted at an upper end of transmission 430, transmission slot 440 and transmission recorder 445 may be positioned at any position within transmission 430, including, for example and without limitation, at a lower end of transmission 430 as depicted in FIG. 4A. Rotor catch recorder 425, bit box recorder 465 and transmission recorder 445 may include sensors for measuring lateral and axial shock and vibration, string and drill bit RPM, toolface, inclination, total gravity field, temperature, radial acceleration, tangential acceleration, and combinations thereof, for example.

Figure 5:
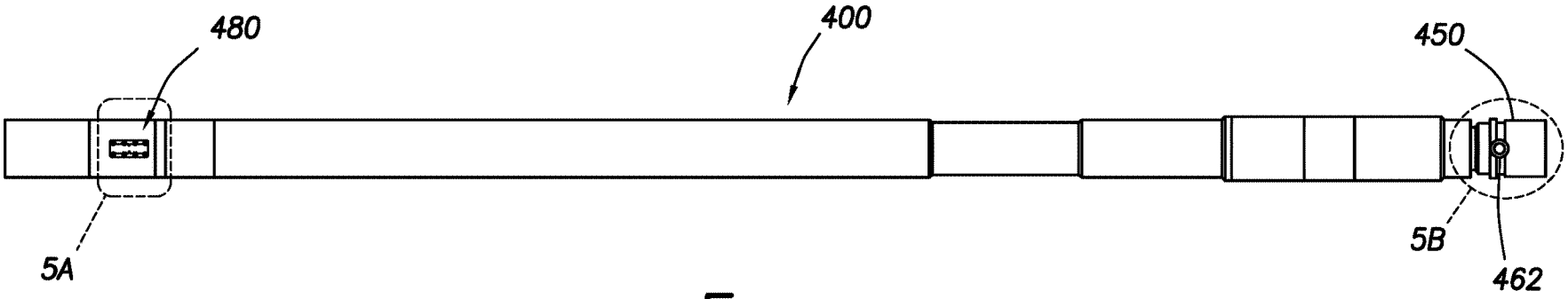
FIG. 5 depicts drilling dynamics data recorders within a mud motor consistent with at least one embodiment of the present disclosure.
Figure 5B:
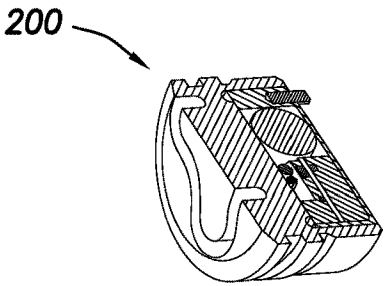
FIG. 5B depicts a drilling dynamics data recorder consistent with certain embodiments of the present disclosure
Figure 5A:
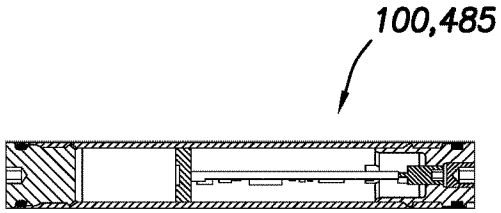
FIG. 5A depicts a drilling dynamics data recorder consistent with certain embodiments of the present disclosure.

FIG. 5 depicts another embodiment of the use of drilling dynamics data recorder 100, 200 in conjunction with mud motor 400 (shown in FIGS. 5A and 5B, respectively). In the embodiment depicted in FIG. 5, drilling dynamics data recorder 100 may be used for top sub recorder 485 positioned in top sub 480 and drilling dynamics data recorder 200 may be used for bit box recorder 465, positioned in bit box threaded slot 462.

Figure 6:
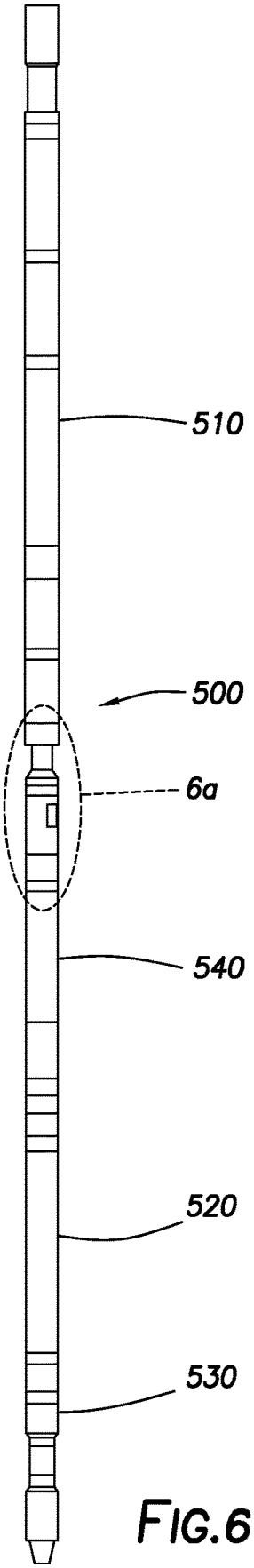
FIG. 6 depicts a drilling dynamics data recorder within a friction reduction tool consistent with at least one embodiment of the present disclosure.
Figure 6A:
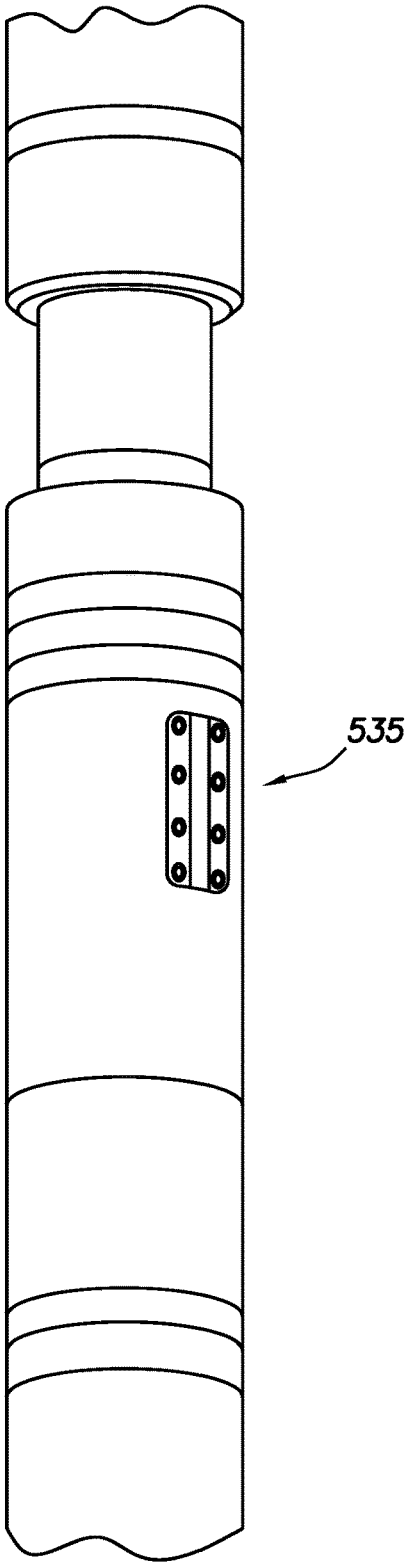
FIG. 6A depicts a drilling dynamics data recorder within the friction reduction tool of FIG. 6 consistent with at least one embodiment of the present disclosure.

In another embodiment, drilling dynamics data recorder 100, 200 may be used in conjunction with a friction reduction tool. Non-limiting examples of friction reduction tools may be found in U.S. Pat. No. 6,585,043 entitled "Friction Reducing Tool" and U.S. Pat. No. 7,025,136 entitled "Torque Reduction Tool," which are incorporated herein by reference. FIG. 6 depicts one embodiment of the use of drilling dynamics data recorder 100 in friction reduction tool 500. Friction reduction tool 500 may include amplifier section 510 in mechanical connection with pulser section 520. Pulser section may include valve section 540 in mechanical and fluid and/or electrical connection with power section 530. In the embodiment shown in FIGS. 6 and 6A, drilling dynamics data recorder 100 may be positioned in friction reduction recorder slot 535. Sensors within friction reduction recorder data dynamics recorder may be used to determine the frequency and intensity of operation of friction reduction tool 500. Friction reduction recorder slot 535 may be located within pulser section 520 or amplifier section 510. As shown in FIG. 6, friction reduction recorder slot 535 is positioned within amplifier section 510.

Figure 7:
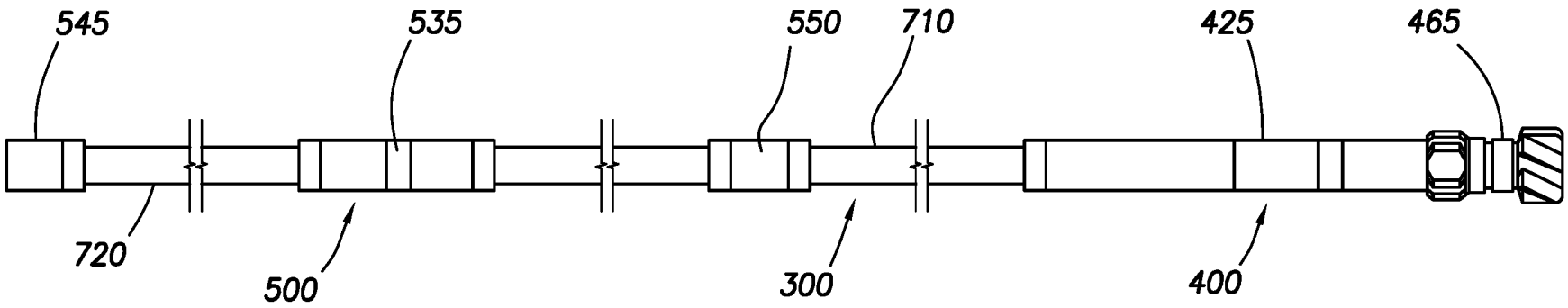
FIG. 7 depicts drilling dynamics data recorders within a friction reduction tool and carrier subs consistent with at least one embodiment of the present disclosure.

Drilling dynamics data recorder 100, 200 within carrier sub 320 may be used in conjunction with a variety of downhole tool subcomponents that make up downhole tool 300. In one non-limiting example, drilling dynamics data recorder 100 may be used with a friction reduction tool, as shown in FIG. 6 and a mud motor, as shown in FIG. 5. As discussed above with respect to mud motor 400, one or more of rotor catch recorder 425, top sub recorder 485, and bit box recorder 465 may be positioned in mud motor 400. Friction reduction recorder slot 535 may be positioned within friction reduction tool 500. As shown in FIG. 7, friction reduction tool 500 and mud motor 400 may be mechanically coupled by intermediate drill string section 710. Intermediate carrier sub 550 containing drilling dynamics data recorder 100 may be positioned within intermediate drill string section 710. In certain embodiments, as shown in FIG. 7, upper carrier sub 545 may be positioned within upper drill string section 720. The sensors within drilling dynamics data recorders 100 within upper carrier sub 545 and intermediate carrier sub 550 may be used to gather data to evaluate transmission of oscillation through bit box 450 and the drill string.

Figure 8B:
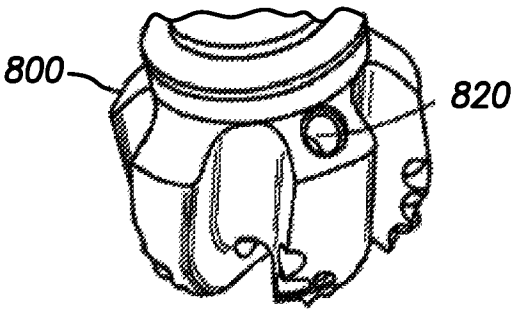
FIGS. 8A-8D depict slots for drilling dynamics data recorders within different portions of a drill bit consistent with embodiments of the present disclosure.
Figure 8A:
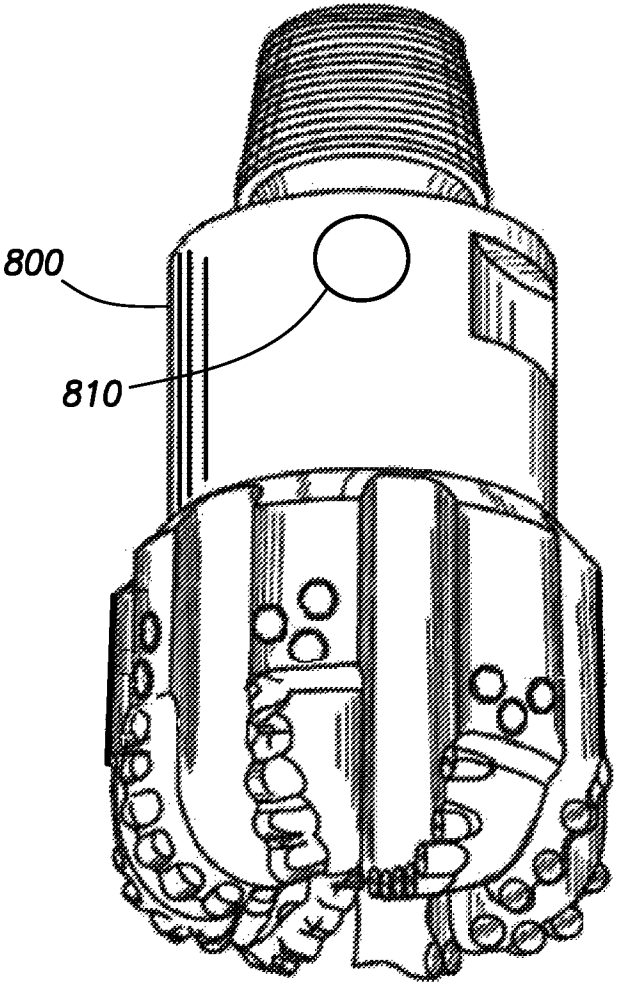
Figure 8D:
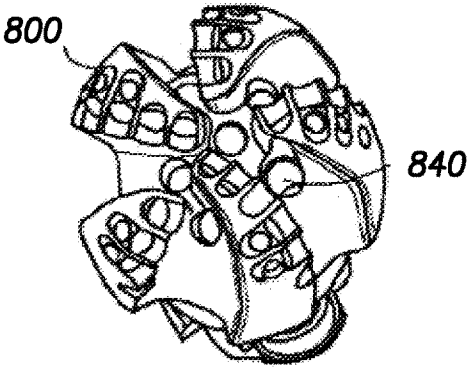
Figure 8C:
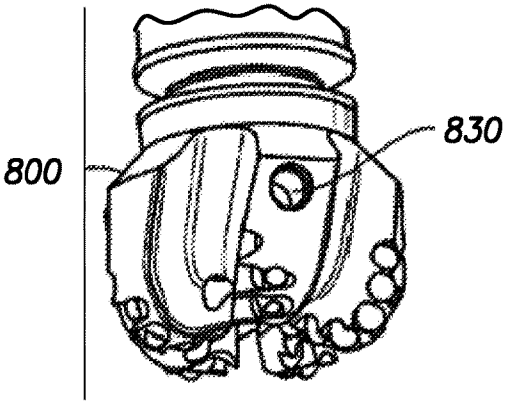

In another embodiment, drilling dynamics data recorder 100, 200 may be positioned within a drill bit. In some embodiments, the sensors within drilling dynamics data recorder 100, 200 may be used to determine bit dynamics and the operating condition of the bit. FIGS. 8A-8D depict locations in which drilling dynamics data recorders 100 may be positioned within drill bit 800. FIG. 8A depicts shank slot 810. FIG. 8B depicts blade shoulder threaded slot 820. FIG. 8C blade threaded slot 830. FIG. 8D depicts body threaded slot 840.

Figure 9:
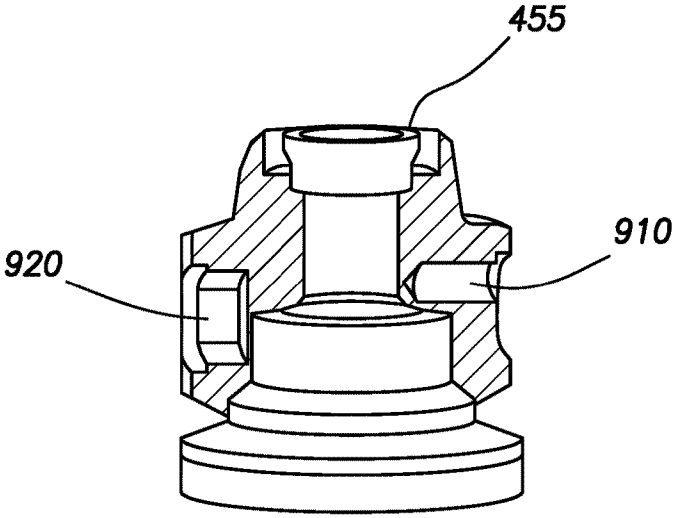
FIG. 9 depicts slots for drilling dynamics data recorders within a drill bit shank consistent with embodiments of the present disclosure.

FIG. 9 depicts slots for use with drilling dynamics data recorder 100, 200 within drill bit shank 455. In the example shown in FIG. 9, slot 910 and threaded slot 920 are shown for use with drilling dynamics data recorder 100, 200, respectively.

Figure 10B:
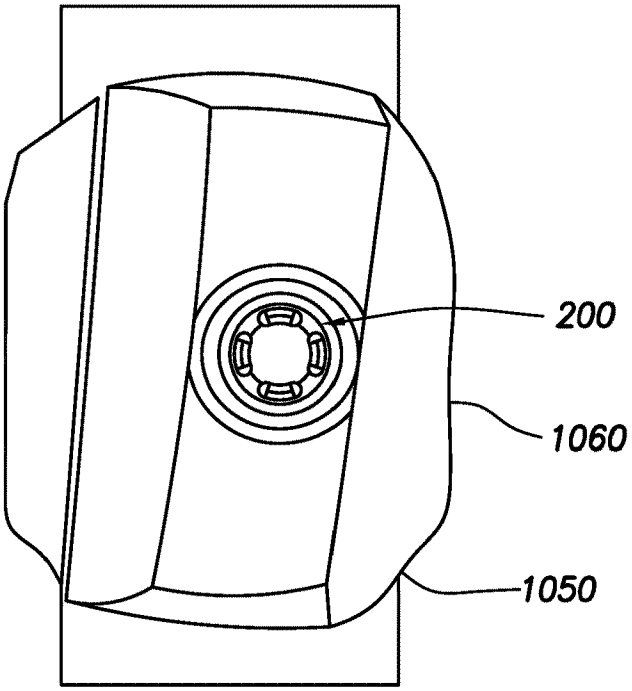
FIGS. 10A and 10B depict drilling dynamics data recorders in stabilizers consistent with certain embodiments of the present disclosure.
Figure 10A:
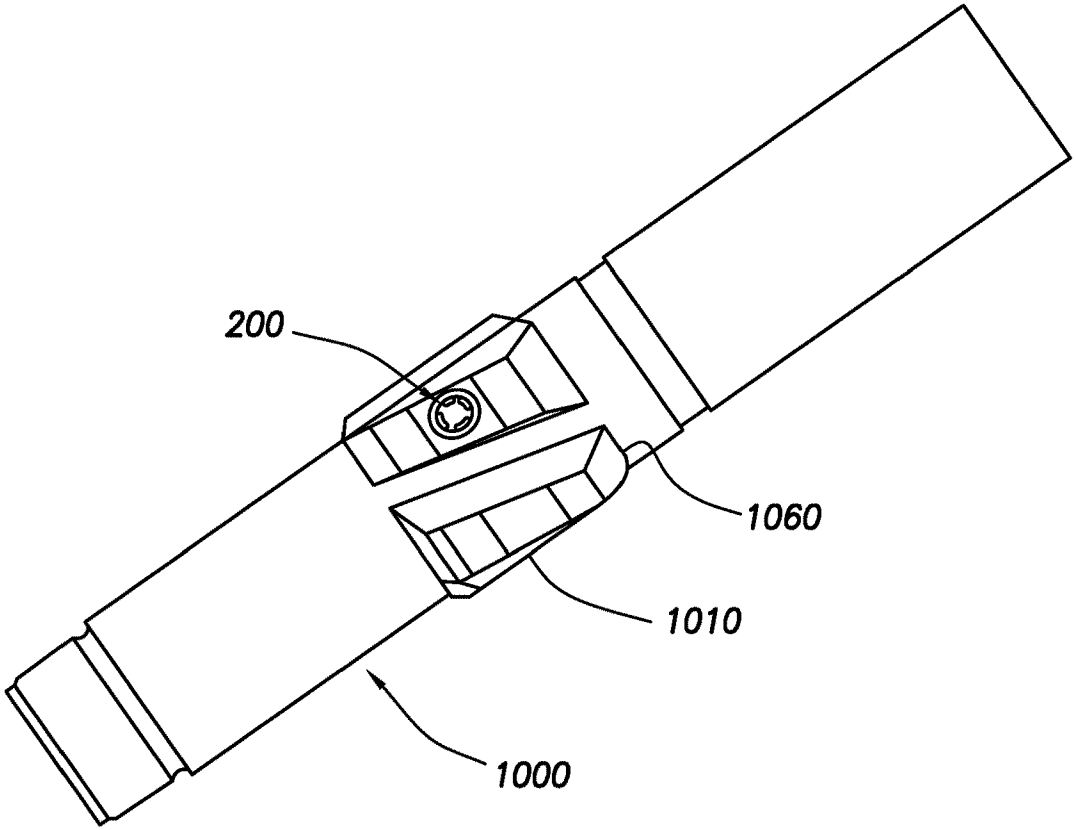

FIGS. 10A and 10B depict drilling dynamics data recorder 200 in stabilizer 1000 and stabilizer 1050, respectively for use in, for example, a coring or drilling assembly. FIG. 10A depicts drilling dynamics data recorder 200 positioned in blade 1060 of stabilizer body 1010. In some embodiments, drilling dynamics data recorder 200 may be positioned in between adjacent blades 1060 in stabilizer body 1010. FIG. 10B depicts drilling dynamics data recorder 200 positioned in blade 1060.

Figure 11:
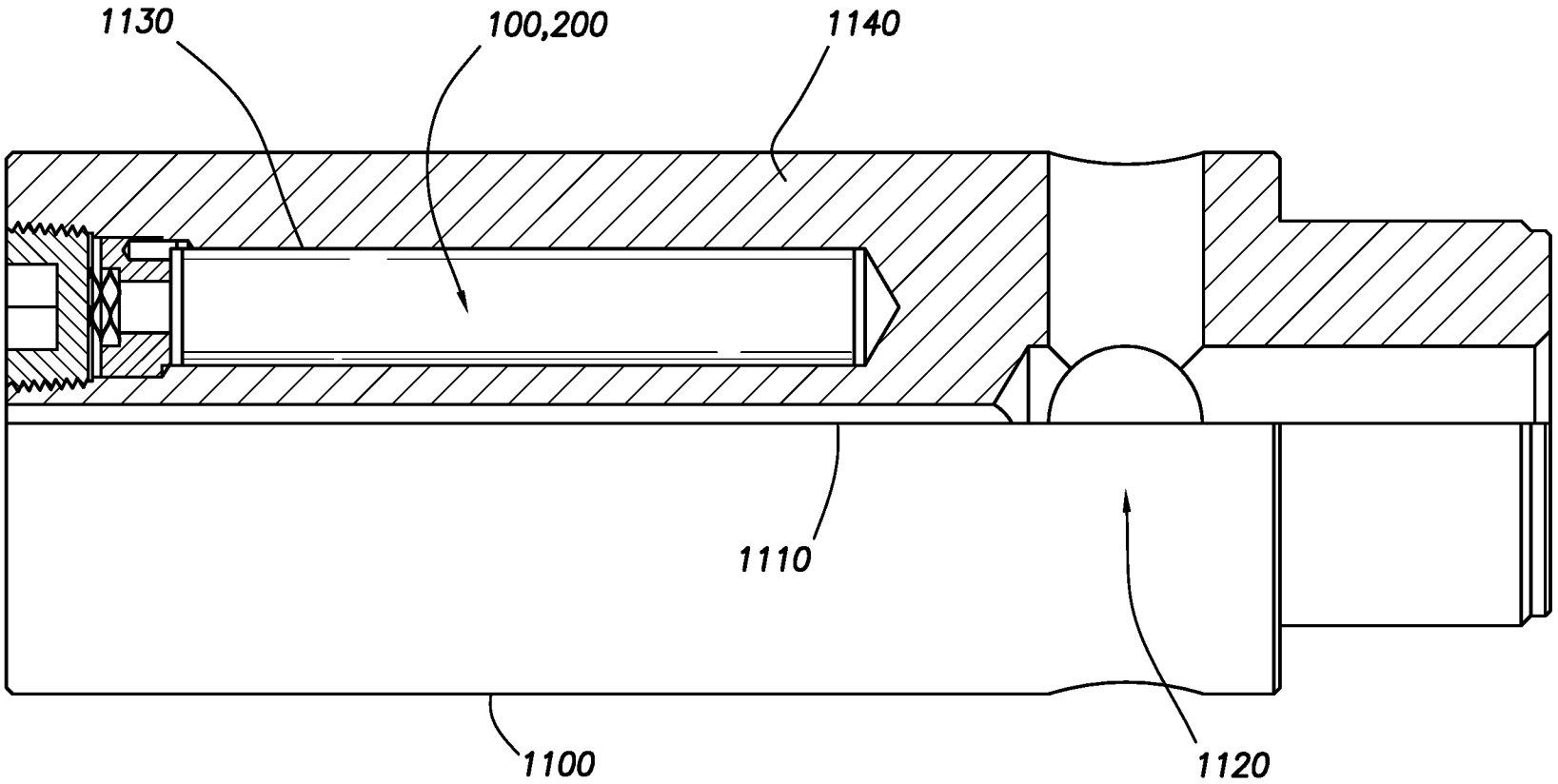
FIG. 11 depicts a ball seat assembly having a drilling dynamics data recorder consistent with certain embodiments of the present disclosure.

FIG. 11 depicts ball seat assembly 1100 for use, for example, with a coring assembly. Ball seat assembly 1100 includes inner bore 1110 in which ball seat 1120 is positioned. In the embodiment shown in FIG. 11, drilling dynamics data recorder 100, 200 may be positioned within ball seat slot 1130 formed within ball seat outer wall 1140 proximate ball seat 1120. In certain embodiments, a drilling dynamics data recorder 100, 200 may be positioned within near bit stabilizer 1000, 1050 as discussed herein above, and another drilling dynamics data recorder 100, 200 positioned within ball seat assembly 1100. The drilling dynamics data recorder 100, 200 within near-bit stabilizer 1000, 1050 may measure shock, vibration, rotation speed (in RPM), inclination, toolface, total gravity field, radial acceleration, tangential acceleration or a combination thereof, for example. Sensor measurements taken by sensors within near-bit stabilizer 1000, 1050 in combination with sensor measurements taken by sensors within ball seat assembly 1100 may determine drilling dynamics throughout the coring assembly.

Figure 12:
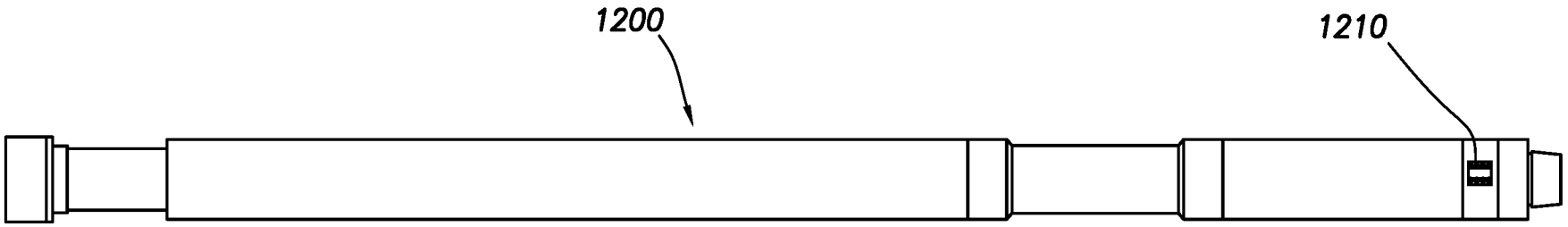
FIG. 12 depicts a stick-slip mitigation tool having a drilling dynamics data recorder consistent with certain embodiments of the present disclosure.
Figure 13:
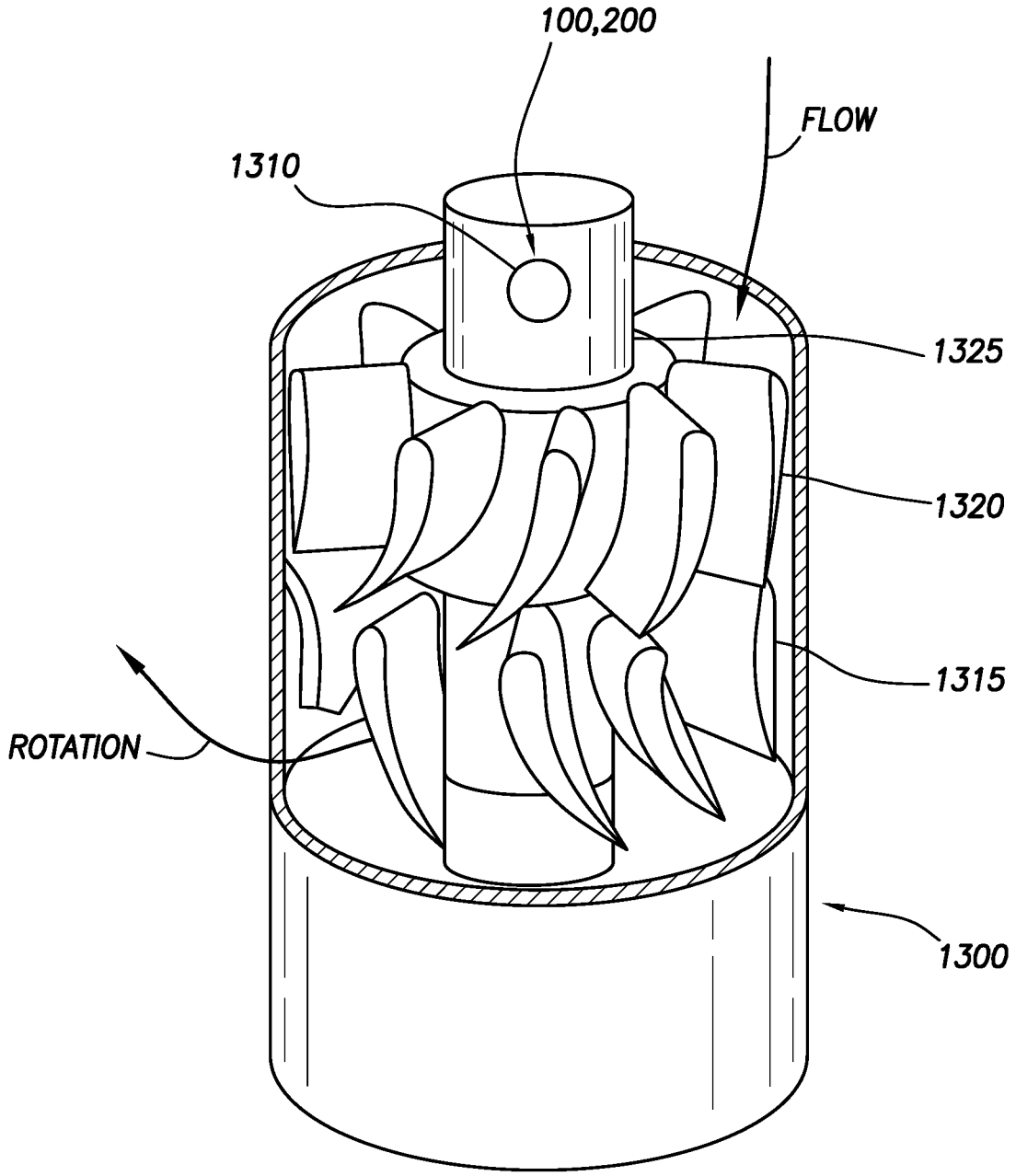
FIG. 13 depicts a turbine having a drilling dynamics data recorder consistent with certain embodiments of the present disclosure.

FIG. 12 depicts drilling dynamics data recorder 100, 200 positioned within stick-slip mitigation tool 1200 in stick-slip tool slot 1210. Stick-slip mitigation tool 1200 may also be referred to as a constant weight-on-bit tool. FIG. 13 depicts drilling dynamics data recorder 100, 200 positioned within turbine 1300 in turbine slot 1310. In some embodiments, drilling dynamics data recorder 100, 200 may be positioned within rotor 1315, stator 1320, or output shaft 1325 of turbine 1300.

In operation, downhole tool 300 is located within the wellbore. During the drilling process, the sensors in sensor package 110 may measure drilling dynamics data; the drilling dynamics data may be stored in memory module 115, referred to herein as "memory logging." When downhole tool 300 is retrieved from the wellbore, drilling dynamics data may be retrieved from memory module 115 through communication port 120 for use by a surface processor. The surface processor may use the drilling dynamics data for post-run evaluation of drilling dynamics, frequency spectrum, statistical analysis, and Condition Based Monitoring/Maintenance (CBM). In some embodiments, frequency spectrum analysis may be done, for example, by applying discrete Fourier transform (or fast Fourier transform) to burst data. In some embodiments, statistical analysis may be done, for example, calculating minimum, maximum, median, mean, mode, standard deviation, and variance of burst data. Statistical analysis may include making histograms of, for example, temperature, vibration, shock, inclination, rotation speed, rotation speed standard deviation, and vibration/shock standard deviation. Temperature histograms may include, for example, accumulating the data points in certain temperature bins over multiple deployments (runs) of the sensors and downhole tools.

CBM is maintenance performed when a need for maintenance arises. This maintenance is performed after one or more indicators show that equipment is likely to fail or when equipment performance deteriorates. CBM may apply systems that incorporate active redundancy and fault reporting. CBM may also be applied to systems that lack redundancy and fault reporting.

CBM may be designed to maintain the correct equipment at the right time. CBM may be based on using real-time data, recorded data, or a combination of real-time and recorded data to prioritize and optimize maintenance resources. Observing the state of a system is known as condition monitoring. Such a system will determine the equipment's health, and act when maintenance is necessary. Ideally, CBM will allow the maintenance personnel to do only the right things, minimizing spare parts cost, system downtime and time spent on maintenance.

Drilling dynamics data, such as high-frequency continuously sampled and recorded data, wherein high-frequency data refers to data at 800 Hz-3200 Hz, may be used for rock mechanics analysis. Such rock mechanics analysis include the analysis/identification of fractures, fracture directions, rock confined/unconfined compressive strength, Young's modulus of elasticity, and Poisson's ratio. Such rock mechanics analysis may be accomplished by combining with surface measured parameters, such as WOB (weight on bit), TOB (torque on bit), RPM (revolutions per minute), ROP (rate of penetration), and flow rate. Pseudo formation-evaluation log, such as pseudo-sonic log, pseudo-neutron log, may be generated with a combination of the analysis of high-frequency continuously sampled and recorded data, along with surface parameters, and other formation-evaluation data, such as natural Gamma log and other logging-while-drilling (LWD) logs. Alternatively, high-frequency continuously-sampled data (e.g. at 800 Hz-3200 Hz) may be used for real-time rock mechanics analysis.

Power from electrical energy source 130 may be supplied to the sensors in sensor package 110. In some embodiments, the electrical power from electrical energy source 130 to the sensors in sensor package 110 is always on (powered up) but at different levels. At the lowest power level, which in some embodiments may be used while drilling dynamics data recorder 100, 200 are being transported, drilling dynamics data recorder 100, 200 may be in "deep-sleep mode." In deep sleep mode, the real-time clock, sensors, for example, sensors 111, 112, 113, 114, 116, 117 and 118, memory module 115, and voltage regulator are powered off and processor 105 is placed in sleep mode. In certain embodiments, current consumption of this deep-sleep mode may be between 1 uA and 200 uA. In sleep mode, processor 105 does not function, except to receive a "wake-up" signal. The wake-up signal may, in some embodiments, be received through communication port 120. In some embodiments, drilling dynamics data recorder 100, 200 may be placed in deep sleep mode by a software command to processor 105 through communication port 120. Drilling dynamics data recorder 100, 200 may be transitioned from deep-sleep mode to standby mode by communicating the wake-up signal to processor 105 through communication port 120 while processor 105 is in passive mode. One non-limiting example of the wake-up signal implementation is to use a communication interrupt feature of processor 105 on communication port bus 176. One non-limiting example of processor 105 with such feature is a 16-bit microcontroller, Model SM470R1B1M-HT from Texas Instruments (Dallas, Tex., USA).

Deep-sleep mode allows extension of battery life during transportation and/or storage without requiring physical disassembly of drilling dynamics data recorder 100, 200. Physical disassembly of drilling dynamics data recorder 100, 200 may damage seals, threads, wires, and other elements if done by unfamiliar technician in a remote location. The recorder may be in "deep-sleep mode" for as much as between 1 month and 1 year before it is sent downhole for dynamics data logging.

In standby mode, processor 105 and at least one sensor (active sensor) of sensor package 110 are active. Digital solid-state sensors may be put into standby mode using a digital command. Standby current to remaining sensors of sensor package 110 may be around 1 μA to 200 uA. Once an active mode predetermined event criterion is met, as determined, for example, by the active sensor, processor 105 sends a command to the remaining sensors of sensor package 110 to begin measurement of data and to memory module 115 to begin logging data ("active mode").

FIG. 14 is a block diagram of an embodiment of drilling dynamics data recorder 100, 200. Drilling dynamics data recorder 100, 200 may include sensor package 110 having a plurality of sensors.

The active mode predetermined event criterion may be, for example, a temperature, acceleration, acceleration standard deviation, rotation speed standard deviation, or inclination threshold as determined by the active sensor. The active mode predetermined event may also be a drill string or bit rotation rate threshold. In some embodiments, the active mode predetermined event criterion may be a combination of one or more of a temperature threshold, acceleration threshold, acceleration standard deviation threshold, rotation speed standard deviation threshold, inclination threshold, drill string rotation rate threshold, or bit rotation rate threshold. In some embodiments, the active mode threshold that predetermines event criterion may be stored in digital, solid-state sensors, which may generate interrupt events to processor 105. For example, one non-limiting example of a digital, solid-state sensor with such feature is an $I^2C$ digital temperature sensor, Model MCP9800 from Microchip (Chandler, Ariz., USA). Temperature thresholds with hysteresis (e.g. upper threshold and lower threshold) may be stored in MCP9800. In certain embodiments, all sensors are non-active during standby mode and the drill string or bit rotation (using accelerometers, gyros, magnetometers or a combination thereof) may be communicated to and received by drilling dynamics data recorder 100, 200 via downlink communication from the surface. In certain embodiments, downlink communication may be accomplished by mud-pulse telemetry, electro-magnetic (EM) telemetry, wired-drill-pipe telemetry or a combination thereof. In other embodiments, downlink communication may be accomplished by varying the drill string rotation rate, for example and not limited to the method described in U.S. Patent Application No. 62/303,931, entitled System and Method for Downlink Communication, filed Mar. 4, 2016.

In certain embodiments, during active mode, once a predetermined passive mode criterion has been met, processor 105 may send a command to the sensors of sensor package 110 and memory module 115 to return to standby mode, thereby discontinuing measurement of data by the sensors and logging of data by memory module 115. The passive mode predetermined event criterion may be, for example, a temperature threshold, acceleration threshold, acceleration standard deviation threshold, RPM threshold, or inclination threshold as determined by one or more sensors of sensor package 110. In some embodiments, the passive mode thresholds that predetermine event criterion may be stored in digital, solid-state sensors, which may generate interrupt events to processor 105. One non-limiting example of digital, solid-state sensor with such feature is an $I^2C$ digital temperature sensor, Model MCP9800 from Microchip (Chandler, Ariz., USA). Temperature thresholds with hysteresis (e.g. upper threshold and lower threshold) may be stored in MCP9800. In one non-limiting example, the digital, solid state sensor made may change from the passive mode (no logging) to the active mode (logging) and from the active mode (logging) to the passive mode (no logging) multiple times, based on one or more, or a combination of event thresholds.

In active mode, sensors in sensor package 110 are turned on for a predetermined duration at a predetermined log interval for measurement of drilling dynamics data. Examples of predetermined duration include 1-10 seconds. Examples of predetermined log intervals are every 1, 2, 5, 10, 20, 30, or 60 seconds and durations between those values. Predetermined log intervals for each of the sensors in sensor package 110 may be the same or different. Predetermined durations for each of the sensors in sensor package 110 may be the same or different.

In certain embodiments, the sensors of sensor package 110 record burst data to memory module 115 at a burst data frequency. In some embodiments, the burst data frequency may, for example and without limitation, be 20 Hz or more, 50 Hz or more, 100 Hz or more, 200 Hz or more, 400 Hz or more, 800 Hz or more, 1600 Hz or more, or 3200 Hz or more. Examples of burst data log interval include every 1, 2, 5, 10, 20, 30, or 60 seconds. The sensor burst data may be buffered in digital sensors in the built-in sensor memory, which may be configured as FIFO (first-in first-out) memory. In certain embodiments, processor 105 does not store sensor burst data in processor's RAM (random access memory), i.e., sensor data is sent directly from the sensors in sensor package 110 to memory module 115. In certain embodiments, processor 105 may store a predetermined number of samples of sensor burst data (for example, just one sample of sensor burst data) in the RAM of processor 105 prior to sending the sensor burst data to memory module 115. In other embodiments, high-frequency sampling data, for example, at 3200 Hz, is continuously stored to memory module 115, such as continuously bursting and recording.

The use of the FIFO memory of a sensor may reduce processor 105 processing capability requirements and processor 105 power consumption. In certain embodiments, the number of the FIFO memories of a sensor may be between 32 and 1025 data points, or between 32 and 512 data points per sensor axis. One FIFO memory may hold, for example, 16 bits or 32 bits, depending on the sensor output resolution. For example, a 3-axis sensor may contain up to 16-bit×100-points×3-axis=48000 bits of FIFO memory. In some embodiments, the sensors of sensor package 110 may record statistics of some or each of the sensors. For example, the statistics of the high-g 3-axis accelerometer data, such as minimum, maximum, mean, median, root-mean-squared, standard deviation, and variance values may be recorded by the sensor package and, in certain embodiments, transmitted to memory module 115. In some embodiments, sensor package 110 may record burst data of the low-g 3-axis digital accelerometer data and 3-axis digital gyroscope. In other embodiments, sensor package 110 may record continuously sampled data, for example, at 1600 Hz, of the 3-axis digital accelerometer data and 3-axis digital gyroscope. Raw analog-to-digital counts for accelerometers and gyroscopes, i.e., a number representing voltage, may be recorded in memory module 115 without temperature calibration or conversion to final units. In certain embodiments, temperature calibration may be performed by processor 105 for drilling dynamics data measured by the sensors of sensor package 110. Temperature calibration may correct for the scale drift factor and offset drift over temperature. In certain embodiments, temperature calibration may be accomplished, for example, by look-up tables.

In some embodiments, ranges of some or all of the sensors in sensor package 110 may be changed while drilling dynamics data recorder 100, 200 is within the wellbore. For example, the low-G accelerometer sensing range is programmable and changeable downhole from +/−4G to +/−16G and all ranges therebetween. Ranges may be changed based on attainment of a predetermined range threshold value or by communication by downlink from the surface. Examples of predetermined range thresholds include, but are not limited to values of rotation speed standard deviation, acceleration standard deviation, or combinations thereof.

In certain embodiments, sampling frequency of some or all of the sensors in sensor package 110 may be changed while drilling dynamics data recorder 100, 200 is within the wellbore. Sample frequency may be changed based on attainment of a predetermined sampling threshold value or by communication by downlink from the surface. Examples of predetermined sampling thresholds include, but are not limited to, values of rotation speed standard deviation, acceleration standard deviation, or combinations thereof.

In some embodiments, some or all of the sensors in sensor package 110 may include an anti-aliasing filter on one or all of the axes of the sensor. The frequency of the anti-aliasing filter may be changed while drilling dynamics data recorder 100, 200 is within the wellbore. For example, the anti-aliasing filter may be changed to between 25 Hz and 3200 Hz for accelerometers. In some embodiments, the anti-aliasing filter frequency may be changed when sampling frequency is changed to avoid aliasing.

In some embodiments, drilling dynamics data recorder 100, 200 communicates with an MWD tool through communications port 120. In one non-limiting example, statistics of downhole dynamics data (for example, maximum shock, RPM standard deviation, mean vibration, median inclination, etc.) may be transmitted to surface via an MWD mud-pulse telemetry, electro-magnetic (EM) telemetry, EM short-hop telemetry, wired-drill-pipe telemetry or a combination thereof.

In some embodiments, drilling dynamics data recorder 100, 200 may be positioned in an existing downhole tool. In some embodiments, drilling dynamics data recorder 100, 200 may be added to the existing downhole tool without altering the tool length or mechanical integrity of the tool. In some such embodiments, a slot as described herein above may be formed in one or more components of the existing downhole tool, and one or more drilling dynamics data recorders 100, 200 may be placed therein.

Figure 17:
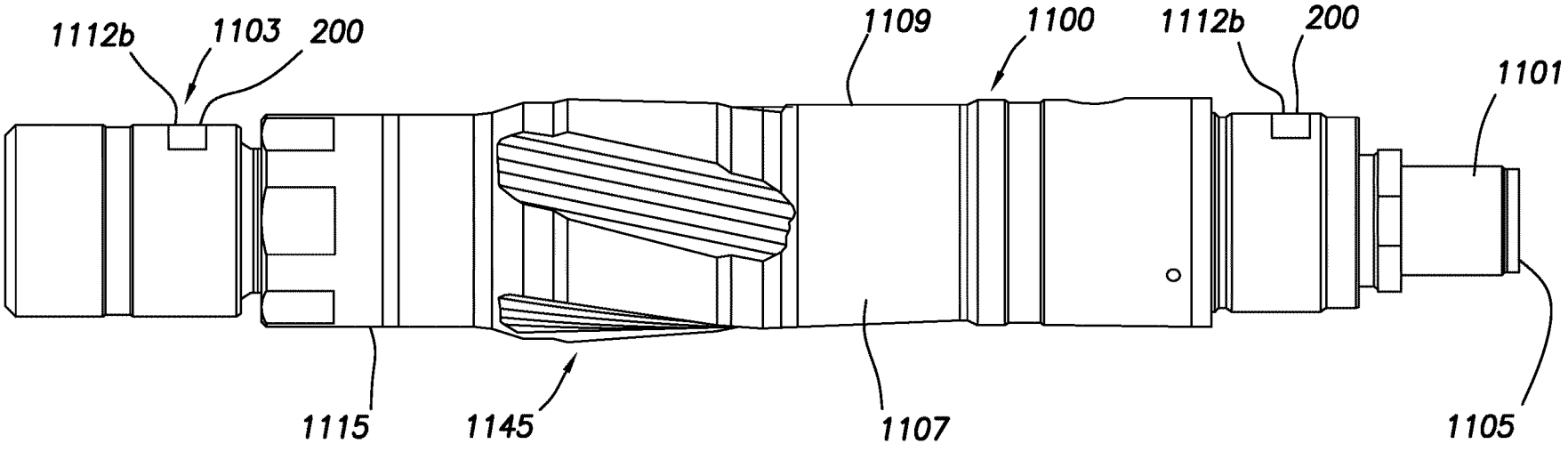
FIG. 17 is an elevation view of a bearing assembly consistent with at least one embodiment of the present disclosure.
Figure 18:
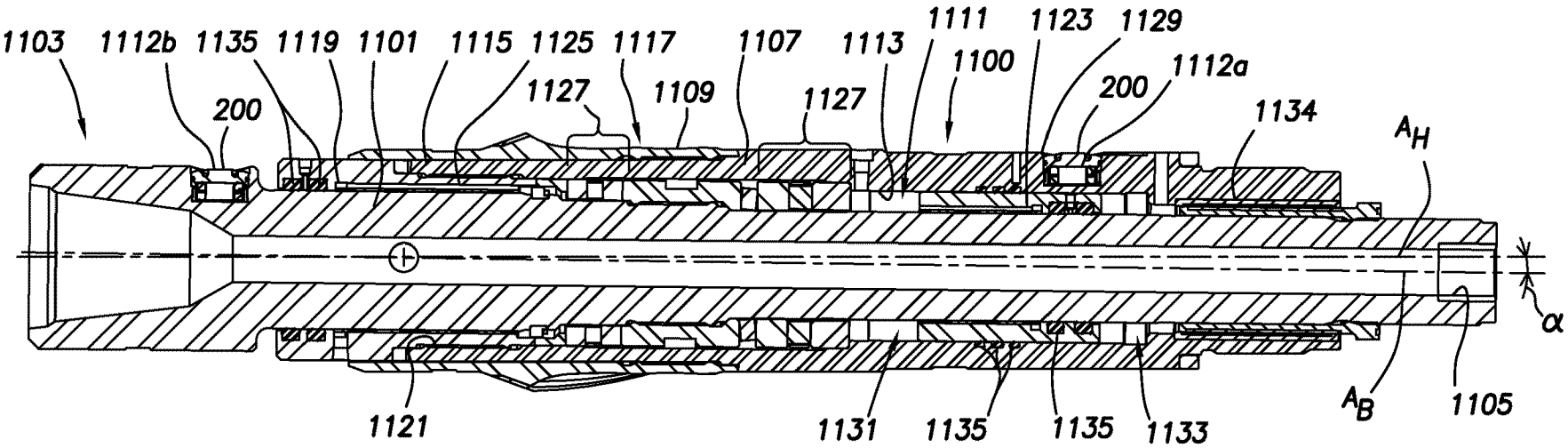
FIG. 18 is a cross section view of the bearing assembly of FIG. 17.

FIG. 17 depicts bearing assembly 1100. FIG. 18 depicts bearing assembly 1100 having one or more drilling dynamics data recorders 200 consistent with at least one embodiment of the present disclosure. Bearing assembly 1100 may be used to couple driveshaft 1101 to power section 1151 of a drilling string for use in a wellbore. In some embodiments, driveshaft 1101 may include bit box 1103 positioned at a lower end of driveshaft 1101. As used herein, the terms "upper" and "lower" refer to relative directions while bearing assembly 1100 is positioned within a wellbore towards the surface and away from the surface respectively. Bit box 1103 may, for example and without limitation, be used to couple a drilling bit to driveshaft 1101. In some embodiments, driveshaft 1101 may include coupler 1105 for coupling driveshaft 1101 to a shaft such as a transmission shaft of a power section such as an electric motor, turbine, or positive displacement mud motor.

In some embodiments, bearing assembly 1100 may include upper bearing housing 1107. Upper bearing housing 1107 may include upper bearing housing outer surface 1109. Upper bearing housing outer surface 1109 may be generally cylindrical. The cylindrical surface of upper bearing housing outer surface 1109 may define bearing housing longitudinal axis $A_H$. Upper bearing housing 1107 may include upper bearing housing bore 1111 formed therethrough defining upper bearing housing inner surface 1113. In some embodiments, upper bearing housing inner surface 1113 may be generally cylindrical. The cylindrical surface of upper bearing housing inner surface 1113 may define bore longitudinal axis $A_B$. In some embodiments, bearing housing longitudinal axis $A_H$ and bore longitudinal axis $A_B$ may intersect at a point denoted bend point ⊕. In some embodiments, upper bearing housing bore 1111 may be formed such that bore longitudinal axis $A_B$ is at an angle to bearing housing longitudinal axis $A_H$, denoted angle $\alpha$ in FIG. 18.

In some embodiments, bearing assembly 1100 may include lower bearing housing 1115. Lower bearing housing 1115 may be mechanically coupled to upper bearing housing 1107. In some embodiments, lower bearing housing 1115 may be mechanically coupled to upper bearing housing 1107 by a repeatable connection such as a threaded coupling depicted in FIG. 18 as threaded interface 1117, which may form a fluid seal as discussed herein below. Lower bearing housing 1115 may include lower bearing housing bore 1119 formed therethrough defining lower bearing housing inner surface 1121. Lower bearing housing bore 1119 and upper bearing housing bore 1111 may be connected and substantially concentric along bore longitudinal axis $A_B$.

In some embodiments, driveshaft 1101 may be positioned within upper bearing housing bore 1111 and lower bearing housing bore 1119. Driveshaft 1101 may be tubular and may extend substantially along bore longitudinal axis $A_B$. Driveshaft 1101 may be rotatable within upper bearing housing 1107 and lower bearing housing 1115.

In some embodiments, one or more bearings may be positioned between driveshaft 1101 and one or both of upper bearing housing 1107 and lower bearing housing 1115. For example, in some embodiments, one or more radial bearings such as upper radial bearing 1123 may be positioned between driveshaft 1101 and upper bearing housing inner surface 1113 and lower radial bearing 1125 may be positioned between driveshaft 1101 and lower bearing housing inner surface 1121. Upper radial bearing 1123 and lower radial bearing 1125 may, for example and without limitation, reduce friction between driveshaft 1101 and upper and lower bearing housings 1107, 1115 while driveshaft 1101 is rotated. Upper radial bearings 1123 and lower radial bearings 1125 may resist lateral force between driveshaft 1101 and upper and lower bearing housings 1107, 1115 during a drilling operation. Because driveshaft 1101 is at angle $\alpha$ to the direction weight is applied to the drill bit, lateral forces may be applied against upper radial bearings 1123 and lower radial bearings 1125. In some embodiments, by forming upper radial bearings 1123 and lower radial bearings 1125 as oil bearings as discussed further herein below, greater forces may be exerted on upper radial bearings 1123 and lower radial bearings 1125 than in an embodiment utilizing drilling fluid cooled bearings. In some embodiments, one or more thrust bearings 1127 may be positioned between driveshaft 1101 and one or both of upper and lower bearing housings 1107, 1115. Thrust bearings 1127 may, for example and without limitation, resist longitudinal force on driveshaft 1101 such as weight on bit during a drilling operation. In some embodiments, upper radial bearings 1123, lower radial bearings 1125, and thrust bearings 1127 may each include one or more of, for example and without limitation, diamond bearings, ball bearings, and roller bearings.

In some embodiments, one or more of upper radial bearing 1123, lower radial bearing 1125, and thrust bearings 1127 may be oil-lubricated bearings. In such an embodiment, the annular portion of upper bearing housing bore 1111 and lower bearing housing bore 1119 about driveshaft 1101 may be filled with oil. In some such embodiments, upper bearing housing bore 1111 may include piston 1129. Piston 1129 may be an annular body adapted to seal between driveshaft 1101 and upper bearing housing inner surface 1113 and slidingly traverse longitudinally. In some such embodiments, piston 1129 may separate upper bearing housing bore 1111 into an oil filled portion, denoted 1131 and a drilling fluid filled portion denoted 1133. In some such embodiments, drilling fluid filled portion 1133 may be fluidly coupled to upper bearing housing bore 1111 such that pressure from drilling fluid positioned therein causes a corresponding increase in pressure within oil filled portion 131, thereby pressure balancing the oil lubricating one or more of upper radial bearing 1123, lower radial bearing 1125, and thrust bearings 1127 with the surrounding wellbore. In some embodiments, one or more seals 1135 may be positioned between one or more of driveshaft 1101 and lower bearing housing 1115, driveshaft 1101 and upper bearing housing 1107, driveshaft 1101 and piston 1129, and piston 1129 and upper bearing housing 1107. In some embodiments, one or more fluid paths 1134 may be positioned to fluidly couple between upper bearing housing bore 1111 and fluid filled portion 1133. In some such embodiments, fluid paths 1134 may provide resistance to fluid flowing into fluid filled portion 1133 to, for example and without limitation, reduce fluid loss. In other embodiments, one or more high pressure seals may be positioned between piston 1129 and upper bearing housing bore 1111, and fluid paths 1134 may not need to produce the resistance as described. In some embodiments, because oil-filled portion 131 is sealed from fluid filled portion 1133, bearing assembly 1100 may be utilized with an air drilling operation or with highly abrasive or corrosive drilling fluid without compromising upper radial bearing 1123, lower radial bearing 1125, and thrust bearings 1127.

In some embodiments, because driveshaft 1101 is longitudinally aligned with and rotates along bore longitudinal axis $A_B$, driveshaft 1101 and any bit coupled to bit box 1103 thereof may rotate at angle $\alpha$ relative to bearing housing longitudinal axis $A_H$, and may therefore allow for a wellbore drilled thereby to be steered in a direction corresponding with the direction of angle $\alpha$, defining a toolface of bearing assembly 1100. In some embodiments, bend point $\oplus$ may be positioned at a location nearer to bit box 1103 than coupler 1105 of driveshaft 1101. Positioning bend point $\oplus$ nearer to bit box 1103 may, for example and without limitation, allow a drill bit coupled to bit box 1103 to be positioned closer to bearing housing longitudinal axis $A_H$ while remaining oriented at angle $\alpha$ to bearing housing longitudinal axis $A_H$ than an embodiment in which bend point $\oplus$ is positioned closer to coupler 1105.

Figure 20:
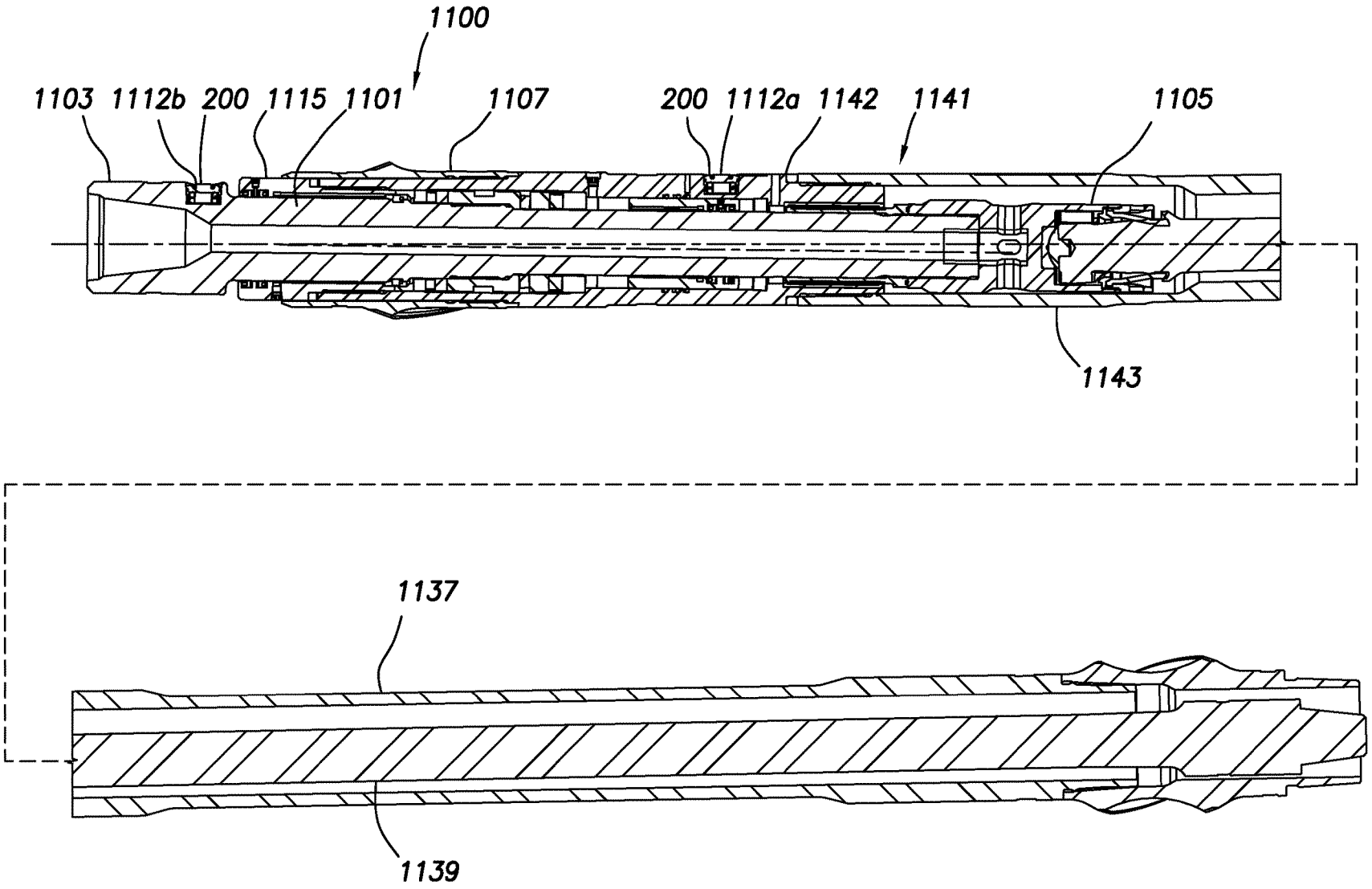
FIG. 20 depicts a cross section view of the BHA of FIG. 19.
Figure 21:
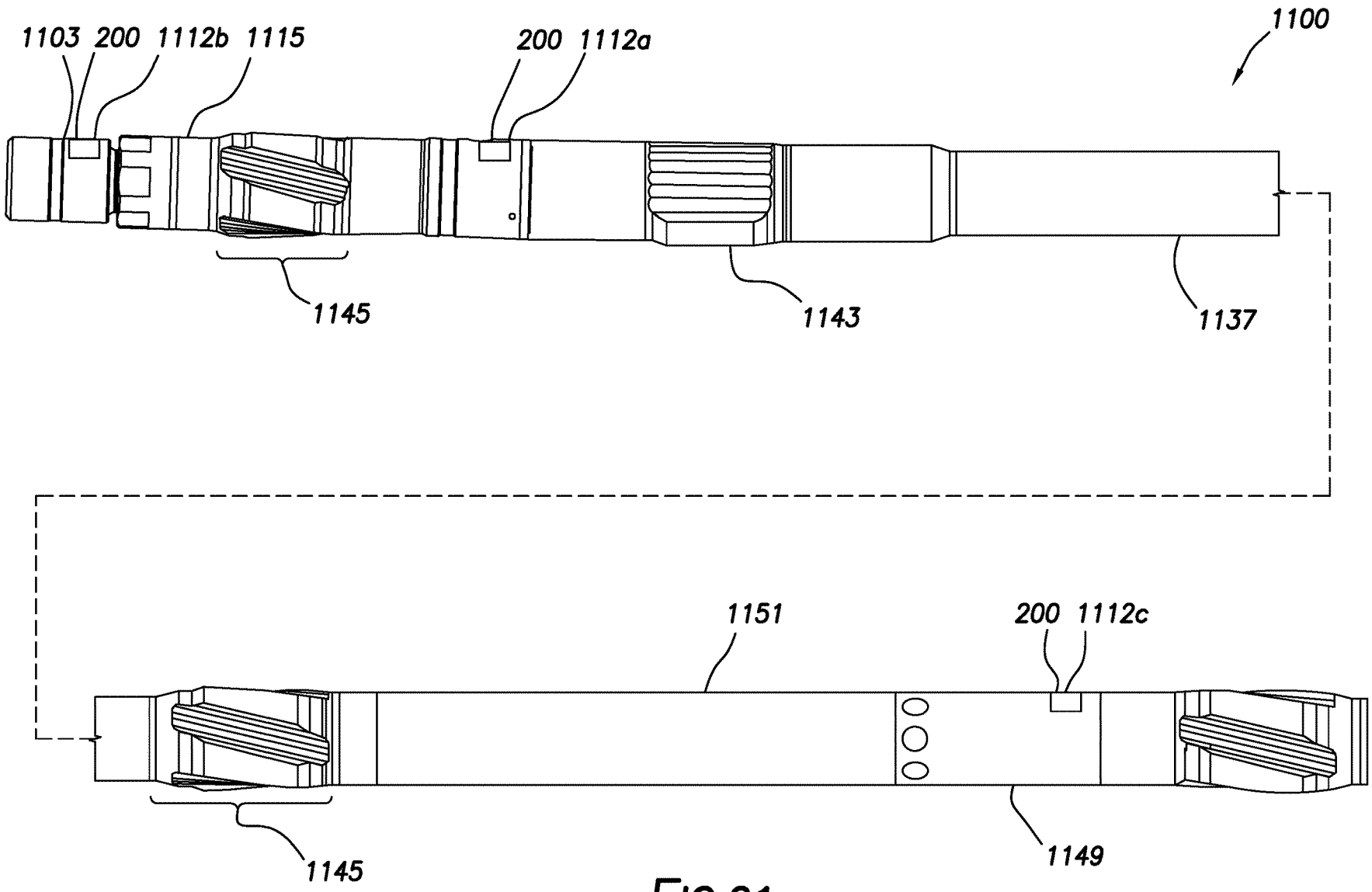
FIG. 21 depicts a downhole tool having a bearing assembly consistent with at least one embodiment of the present disclosure.

As shown in FIGS. 18 and 20, in some embodiments, upper bearing housing 1107 may include bit box slot **1112*b* formed therein and positioned adjacent to or within bit box 1103. In some embodiments, bearing housing slot 1112*a* may be formed in upper bearing housing 1107 at a radial orientation generally corresponding with the thickest portion of upper bearing housing 1107. In some embodiments, drilling dynamics data recorders 200 may be positioned within slots 1112*a*, 1112*b*. As shown in FIG. 21, a third slot 1112 positioned within top sub 1149, top sub slot 1112*c* may house drilling dynamics data records 200**.

Figure 19:
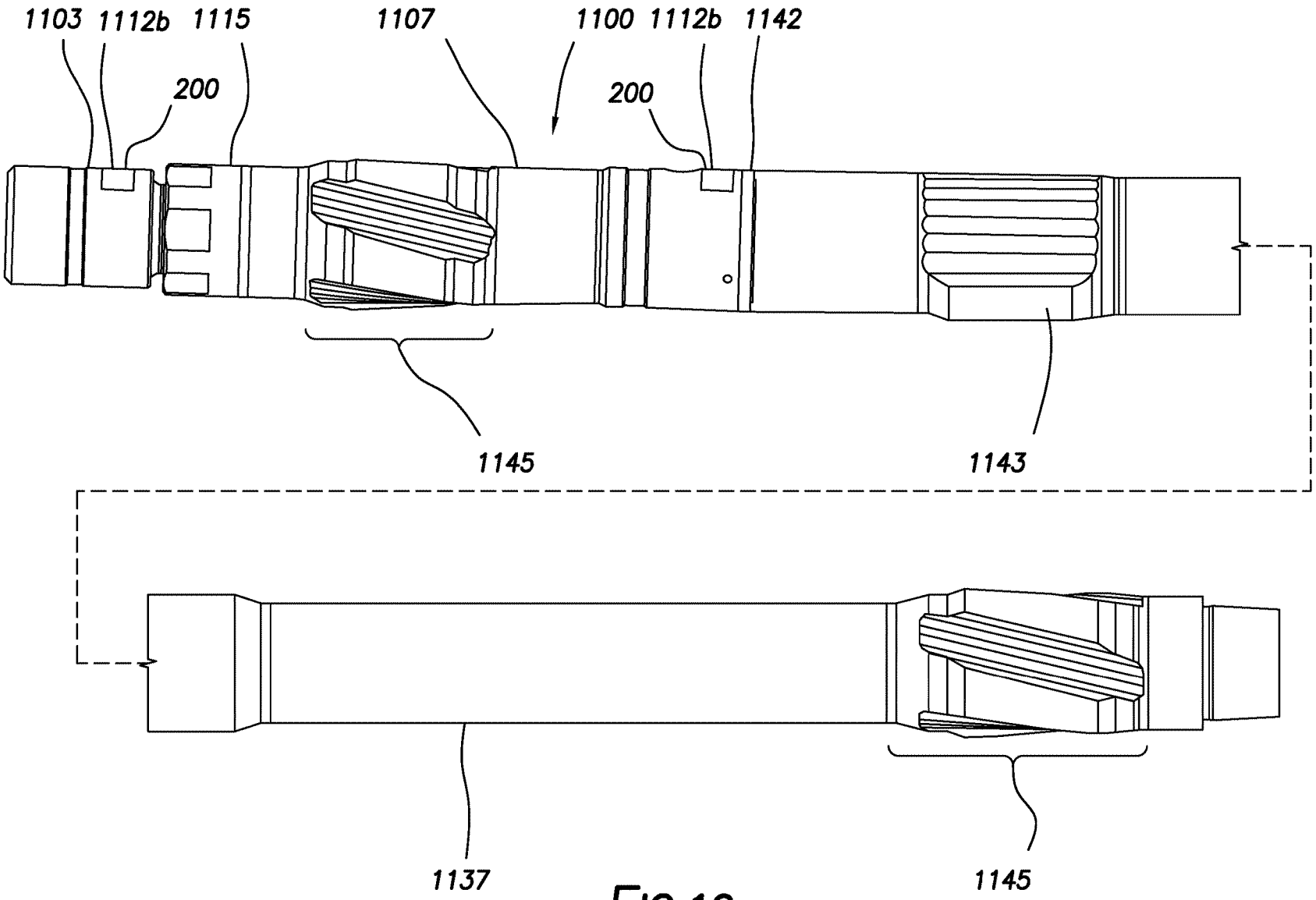
FIG. 19 depicts an elevation view of a bottom hole assembly (BHA) consistent with at least one embodiment of the present disclosure.

In some embodiments, as depicted in FIG. 19, bearing assembly 1100 may be coupled to transmission housing 1137 forming BHA. Transmission housing 1137 may couple between upper bearing housing 1107 and power section 1151 which may include a downhole motor such as a mud motor, turbine, gear-reduced turbine, or electric motor. Transmission shaft 1139 may be positioned within transmission housing 1137 and may couple to coupler 1105 of driveshaft 1101 to, for example and without limitation, transfer rotational power to driveshaft 1101. In some embodiments, transmission housing 1137 may be formed such that it includes a bend and therefore forms bent sub 1141. In some embodiments, the direction of bend of bent sub 1141 may be positioned such that it is aligned with the toolface of bearing assembly 1100, thereby increasing the effective bend of bearing assembly 1100. In some embodiments, a scribe line may be formed on an outer surface of one or both of bearing assembly 1100 and transmission housing 1137 in alignment with the direction of bend such that bearing assembly 1100 and transmission housing 1137 may be properly aligned. In some embodiments, timing ring 1142 may be positioned between transmission housing 1137 and bearing assembly 1100 to ensure the alignment. In some embodiments, as depicted in FIG. 19, bearing assembly 1100 or transmission housing 1137 may include contact pad 1143 on an outer surface thereof. In some embodiments, contact pad 1145 may be positioned on a side of bearing assembly 1100 or transmission housing 1137 opposite the toolface thereof. Contact pads 1143, 1145 may contact the surrounding wellbore and may, for example and without limitation, assist with directional drilling. Top sub 1149 may be positioned above power section 1151.

Figure 16:
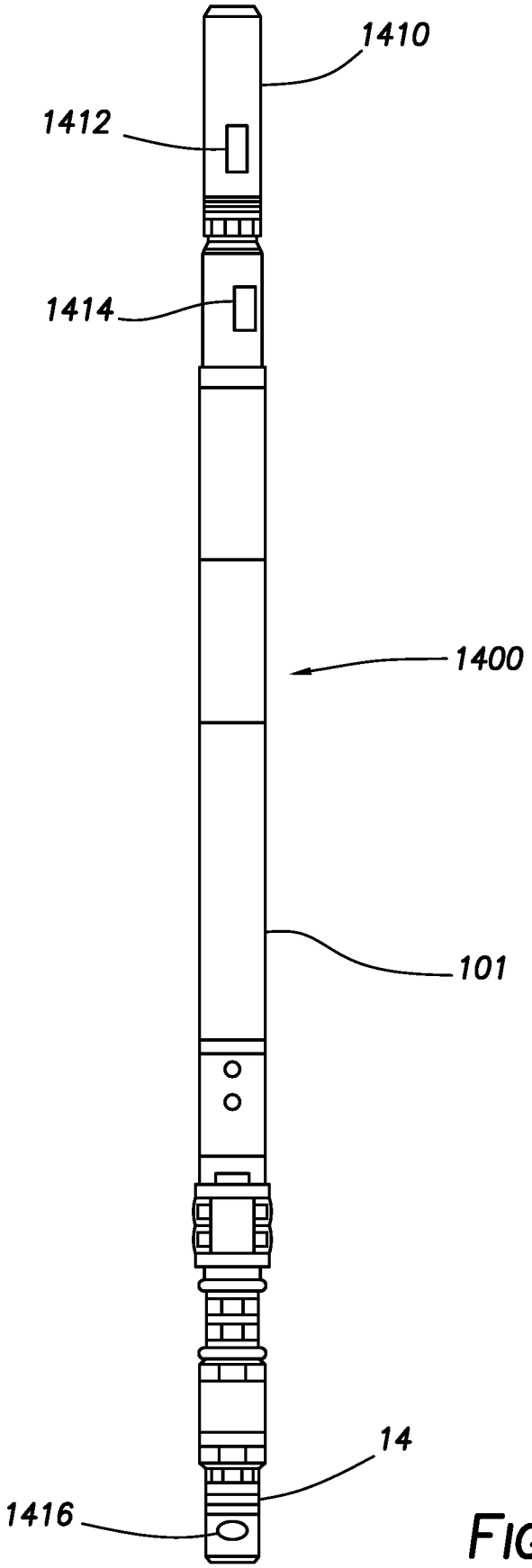
FIG. 16 depicts a steering tool having a drilling dynamics data recorder consistent with certain embodiments of the present disclosure.

In yet another embodiment, drilling dynamics data recorder 100, 200 may be positioned in a steering tool. Non-limiting examples of steering tools include a vertical and directional tool, as described herein below. As shown in FIG. 16, steering tool 1400 may include upper mandrel 1410, substantially non-rotating housing 101, and bit box 14. In the embodiment shown in FIG. 16, drilling dynamics data recorders 100, 200 may be positioned in upper mandrel slot 1412, substantially non-rotating housing slot 1414, bit box slot 1416, or a combination thereof.

Figure 22:
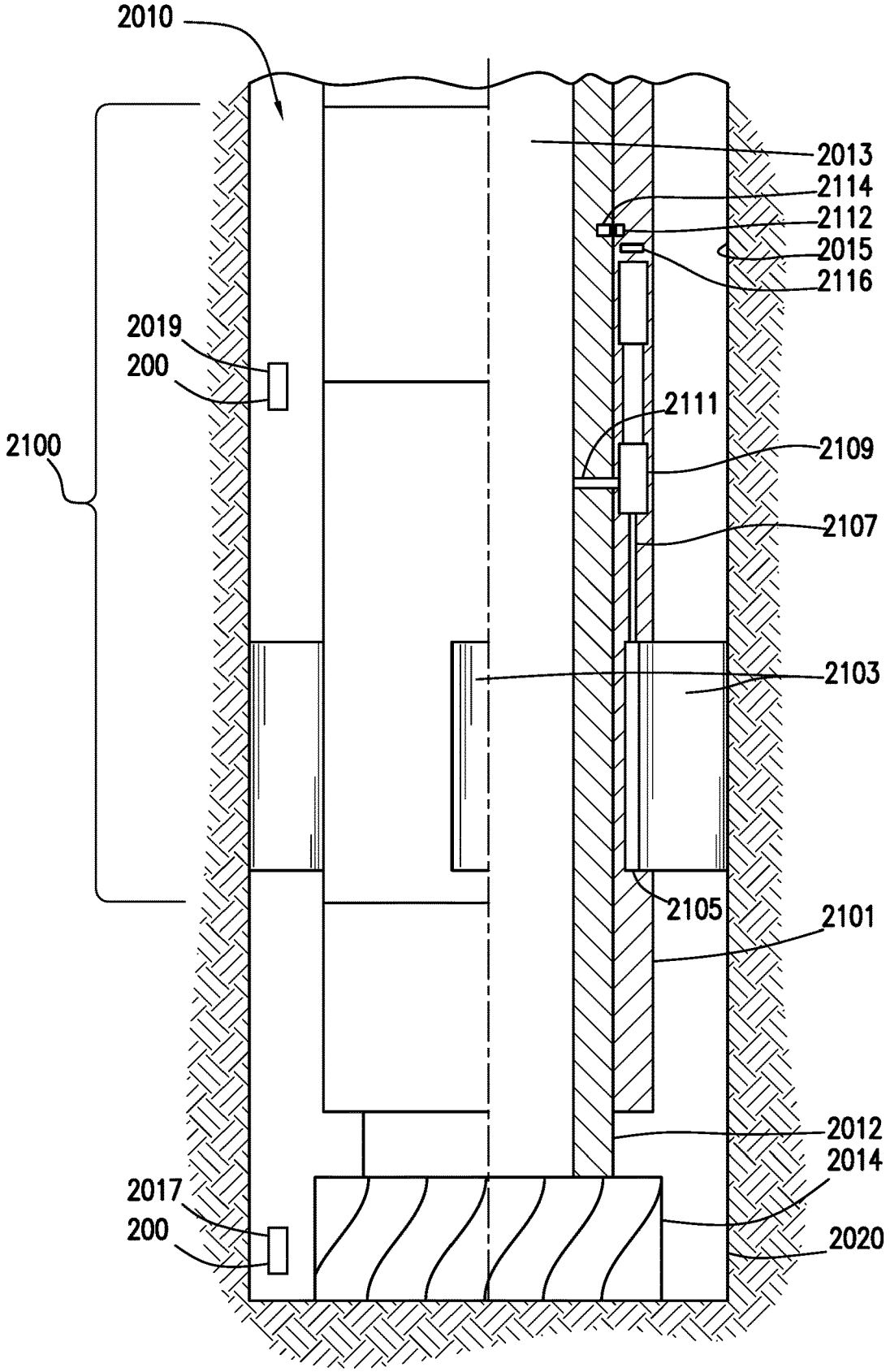
FIG. 22 depicts a schematic view of a downhole tool in partial cross section consistent with at least one embodiment of the present disclosure.
Figure 23A:
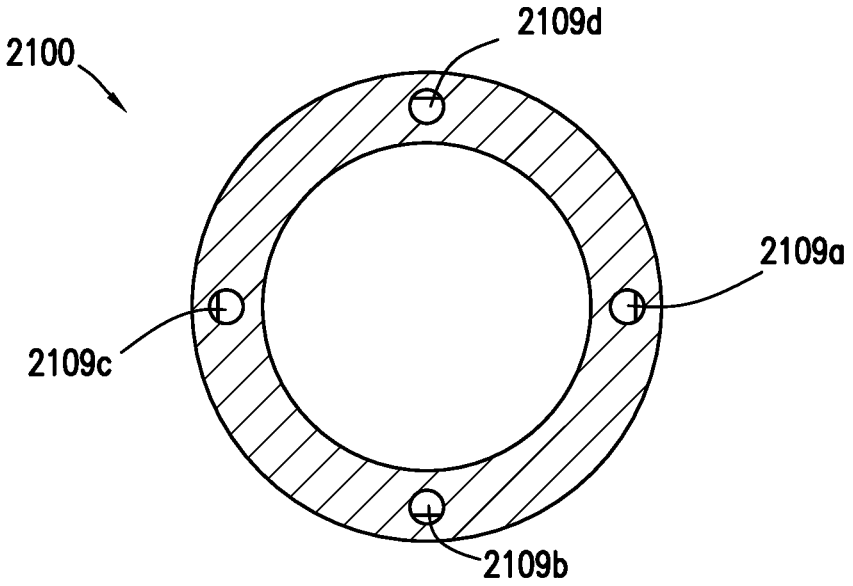
FIGS. 23A, 23B depict schematic cross sections of the downhole tool of FIG. 22 in a centralizing position.
Figure 23B:
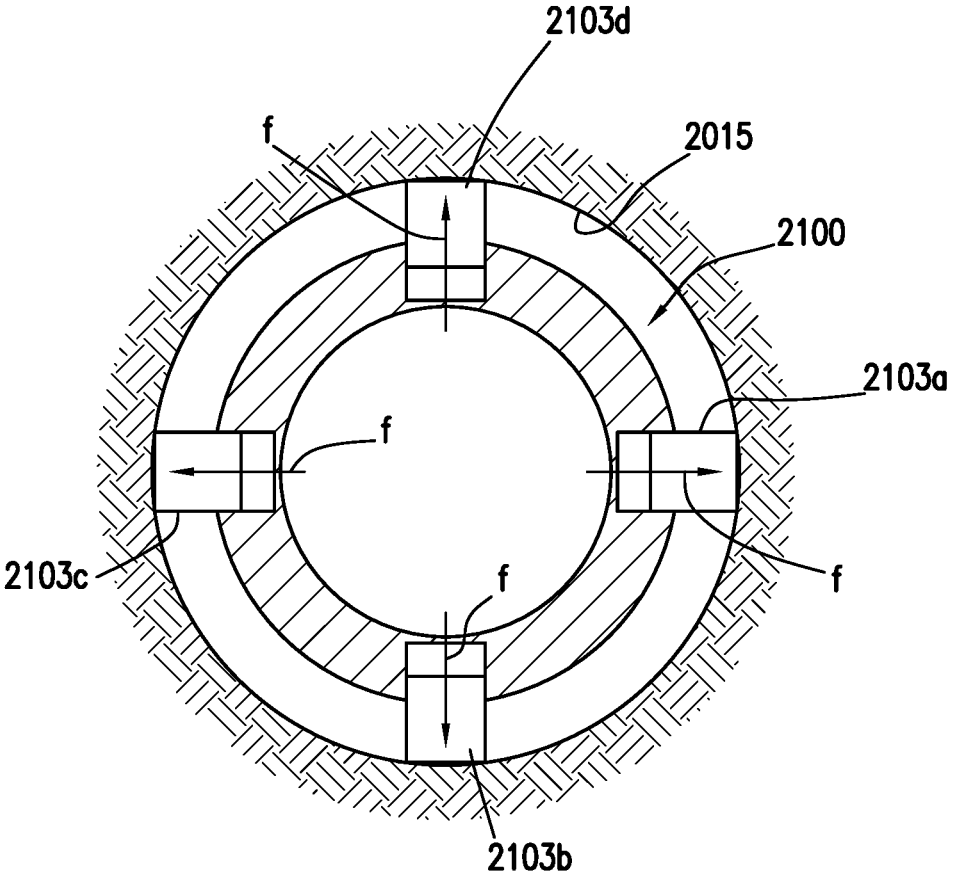

As depicted in FIG. 22, downhole steering tool 2100 may be included as part of drill string 2010. In some embodiments, downhole steering tool 2100 may be included as part of a bottomhole assembly of drill string 2010. In some embodiments, downhole steering tool 2100 may be positioned about mandrel 2012 of drill string 2010. Mandrel 2012 may be coupled to drill bit 2014 within bit box 2020 and adapted to provide rotational force thereto to form wellbore 2015. In some embodiments, mandrel 2012 may be coupled to drill string 2010 such that rotation of drill string 2010 from the surface by, for example and without limitation, a rotary table or top drive, causes rotation of mandrel 2012. In some embodiments, mandrel 2012 may be coupled to a downhole motor such as a mud motor or downhole turbine to provide rotation. Downhole steering tool 2100 may include housing 2101. In some embodiments, housing 2101 may be tubular or generally tubular. Housing 2101 may be positioned about mandrel 2012 and may be rotatably coupled thereto such that mandrel 2012 may rotate independently of housing 2101. In some embodiments, for example and without limitation, one or more bearings may be positioned between housing 2101 and mandrel 2012. Although shown as a single piece, one having ordinary skill in the art with the benefit of this disclosure will understand that housing 2101 may be formed from one or more pieces.

In some embodiments, housing 2101 may rotate at a speed that is less than the rotation rate of the drill bit and mandrel 2012. For example and without limitation, in some embodiments, housing 2101 may rotate at a speed that is less than the rotation speed of mandrel 2012. For example and without limitation, housing 2101 may rotate at a speed at least 50 RPM slower than mandrel 2012. For example and without limitation, in an instance where mandrel 2012 rotates at 51 RPM, housing 2101 may rotate at 1 RPM or less. In some embodiments, housing 2101 may rotate at a speed that is less than a percentage of the rotation speed of mandrel 2012. For example and without limitation, housing 2101 may rotate at a speed lower than 50% of the speed of mandrel 2012. In some embodiments, housing 2101, by not rotating, may maintain a toolface orientation independent of rotation of drill string 2010.

As further shown in FIG. 22, in certain embodiments, drilling dynamics drilling recorder 200 may be positioned within bit box 2014 in slot 2017 and within housing 2101 in slot 2019.

In some embodiments, downhole steering tool 2100 may include one or more steering blades 2103. Steering blades 2103 may be positioned about a periphery of housing 2101. Steering blades 2103 may be extendible to contact wellbore 2015. In some embodiments, steering blades 2103 may be at least partially positioned within steering cylinders 2105 and may be sealed thereto. Fluid pressure within each steering cylinder 2105 may increase above fluid pressure in the surrounding wellbore 2015, thereby causing a differential pressure across the steering blade 2103 positioned therein. The differential pressure may cause an extension force on steering blade 2103. The extension force on steering blade 2103 may urge steering blade 2103 into an extended position. When positioned within wellbore 2015, the extension force may cause steering blade 2103 to contact wellbore 2015. In some embodiments, steering blade 2103 may, for example and without limitation, at least partially prevent or retard rotation of housing 2101 to, for example and without limitation, less than 20 revolutions per hour.

In some embodiments, fluid may be supplied to each steering cylinder 2105 through a steering port 2107. In some embodiments, the fluid may be drilling mud. The fluid in each steering port 2107 may be controlled by one or more adjustable orifices 2109. Fluids may include, but are not limited to, drilling mud, such as oil-based drilling mud or water-based drilling mud, air, mist, foam, water, oil, including gear oil, hydraulic fluid or other fluids within wellbore 2015. Adjustable orifices 2109 may control fluid flow between an interior of mandrel 2012 and steering ports 2107. In some embodiments, each steering cylinder 2105 is controlled by an adjustable orifice 2109. In some embodiments, one or more steering blades 2103 may be aligned about downhole steering tool 2100 and may be controlled by the same adjustable orifice 2109. As used herein, "adjustable orifice" includes any valve or mechanism having an adjustable flow rate or restriction to flow.

Fluid may be supplied to each adjustable orifice 2109 from an interior 2013 of mandrel 2012. Adjustable orifice 2109 may be fluidly coupled to the interior 2013 of mandrel 2012. In some embodiments, for example and without limitation, one or more apertures 2111 may be formed in mandrel 2012 which may be coupled to each adjustable orifice 2109 allowing fluid to flow to each adjustable orifice 2109 as mandrel 2012 rotates relative to housing 2101. In some embodiments, as further discussed herein below, a diverter may be utilized.

In some embodiments, adjustable orifices 2109 may be reconfigurable between an open position and a partially open position. In some embodiments, adjustable orifices 2109 may further have a closed position. In the partially open position, adjustable orifices 2109 may remain partially open such that an amount of fluid may pass into the corresponding steering cylinder 2105. During certain operations, for instance to centralize downhole steering tool 2100 within wellbore 2015, as depicted schematically and without limitation as to structure in FIG. 2A, each adjustable orifice 2109*a-d* may remain in the partially open position, such that only a portion of the amount of fluid may pass therethrough compared to when an adjustable orifice 2109 is fully open. In some embodiments, the partially open position may allow between 0% and 50% of the flow of the opened position, between 10% and 40% of the flow of the opened position, or between 25% and 35% of the opened position. Each steering blade 2103*a-d* may thus receive a substantially equal differential pressure thereacross and may be extended to contact wellbore 2015 with approximately equal extension force, shown graphically as arrows depicting first extension force f. Steering blades 2103*a-d* may thus centralize downhole steering tool 2100 within wellbore 2015. In some embodiments, steering blades 2103*a-d* may include one or more anti-rotation features on the end thereof such that when in contact with wellbore 2015, the force exerted by each steering blade 2103*a-d* prevents or retards rotation of downhole steering tool 2100 relative to wellbore 2015.

Figure 24A:
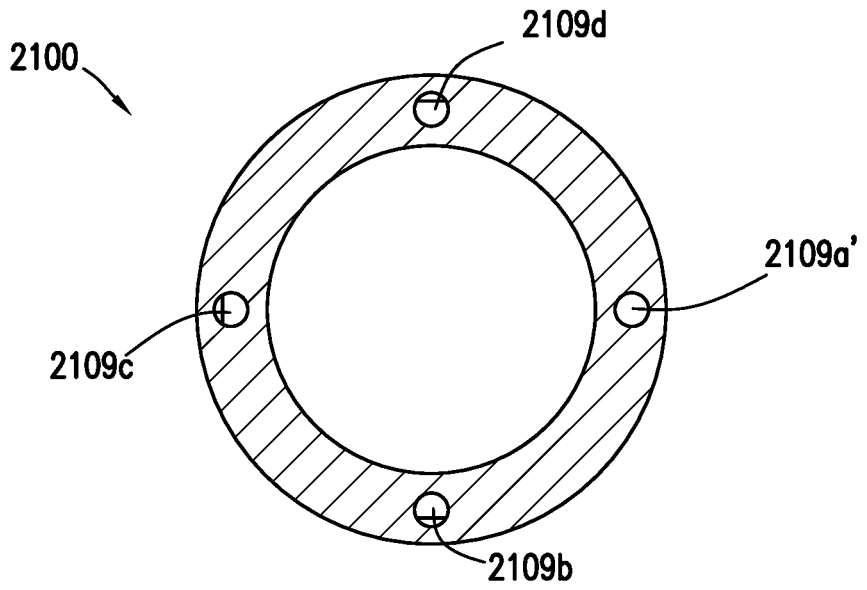
FIGS. 24A, 24B depict schematic cross sections of the downhole tool of FIG. 22 in a steering position.
Figure 24B:
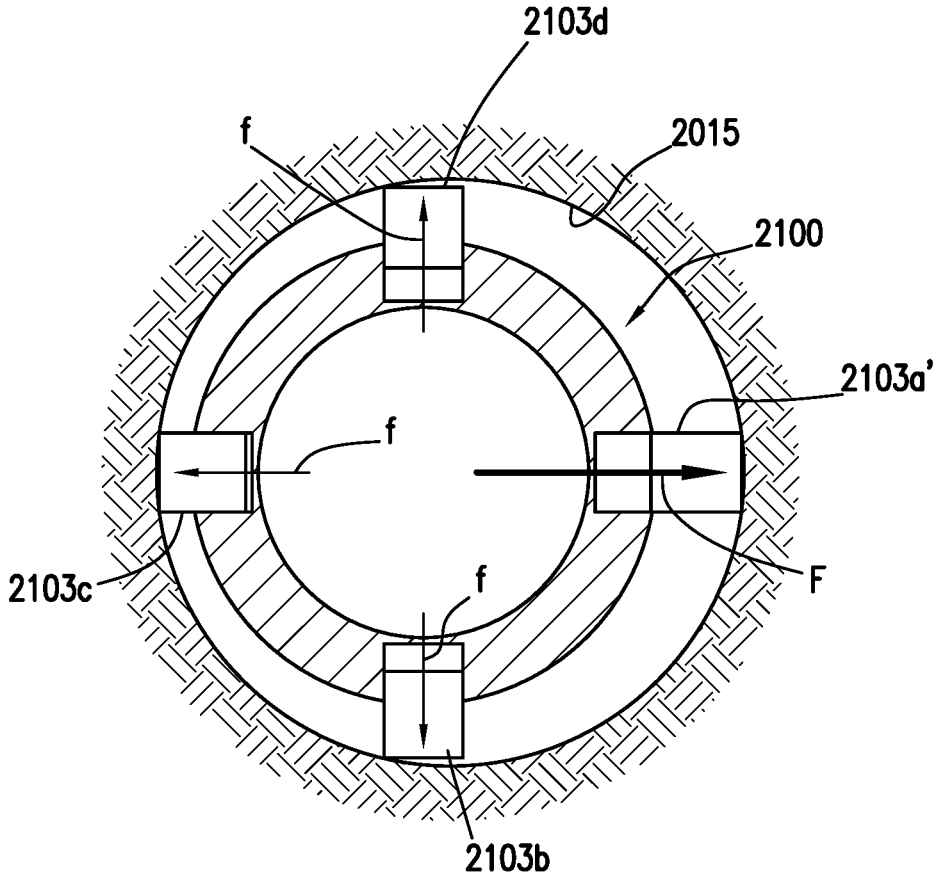

When a steering input is desired, one or more adjustable orifices (depicted as adjustable orifice 2109*a*' in FIG. 24A), may be fully opened by actuating its corresponding solenoid. The adjustable orifices 2109*b-d* not in the open position may remain in the partially open position. With adjustable orifice 2109*a*' in the open position, a larger amount of fluid may flow to the corresponding steering blade (2103*a*' in FIG. 3B), causing the differential pressure thereacross to be higher than to steering blades 2103 not corresponding to a fully open adjustable orifice 2109, and thus exerting a larger extension force, depicted as second extension force F thereupon. The opposing steering blade (here 2103*c*) (or steering blades depending on configuration) receives a smaller first extension force f, and its extension may be at least partially overcome by the extension of steering blade 2103*a*', causing downhole steering tool 2100 to be pushed away from wellbore 2015 in the direction of steering blade 2103*a*'. This second extension force F may thus cause a change in the direction in which downhole steering tool 2100 is pushed relative to wellbore 2015, referred to herein as a force-vector direction, which may alter the direction in which wellbore 2015 is drilled.

In some embodiments, when drilling a straight or nearly straight wellbore 2015, in some embodiments, all adjustable orifices 2109*a-d* may be opened, applying substantially equal pressure to all steering blades 2103, causing equal force exerted by all steering blades 2103 against wellbore 2015. Alternatively, minimum gripping force may be exerted by all steering blades 2103 against wellbore 2015 when all adjustable orifices 2109*a-d* are partially open.

Figure 25:
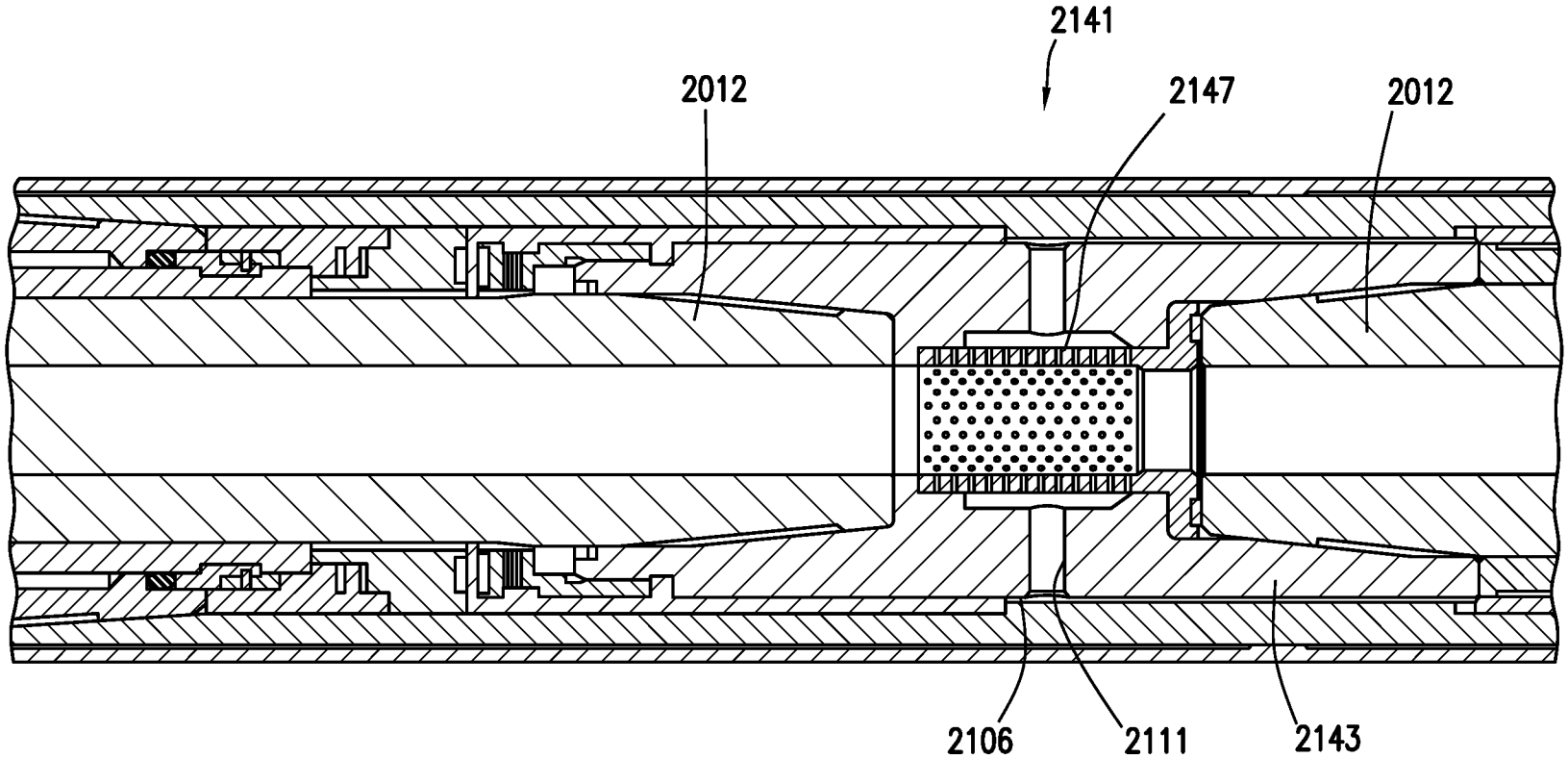
FIG. 25 depicts a cross section view of a diverter of a downhole tool consistent with at least one embodiment of the present disclosure.

In some embodiments, as depicted in FIG. 25, fluid may be supplied from the interior of mandrel 2012 (here depicted as having two subcomponents coupled to either side of diverter assembly 2141) through diverter assembly 2141. The fluid within mandrel 2012 may include, without limitation, drilling mud, such as oil-based drilling mud or water-based drilling mud; air; mist; foam; water; oil, including gear oil; hydraulic fluid; or a combination thereof. The fluid within mandrel 2012 may be supplied by one or more pumps at the surface through mandrel 2012 to, for example and without limitation, operate one or more downhole tools and clear cuttings from wellbore 2015 during a drilling operation. Fluid within mandrel 2012 may be at a higher pressure than fluid within wellbore 2015. Diverter assembly 2141 may include diverter body 2143 coupled to and rotatable with mandrel 2012. In some embodiments, diverter assembly 2141 may be formed integrally with mandrel 2012. In some embodiments, diverter assembly 2141 may contain drilling fluid filter 2147. Diverter body 2143 may include one or more apertures 111 coupling the interior of mandrel 2012 to one or more fluid supply ports 2106 formed within housing 2101. Fluid supply ports 2106 may supply fluid to adjustable orifices as described herein below. In some embodiments, approximately 4-5% of the flow going through the interior of mandrel 2012 may be diverted through diverter assembly 2141. In some embodiments, a portion of the diverted fluid may pass into one or more bearings and may exit to the annular space about downhole steering tool 2100.

In some embodiments, a controller, discussed herein below as controllers 2119 and 2237 shown in FIGS. 26A, 27A respectively, may control the actuation of adjustable orifices 2109. For the purpose of this description, controller 2119 will be discussed specifically, although one having ordinary skill in the art with the benefit of this disclosure will understand that controller 2237 may operate similarly. In some embodiments, controller 2119 may be electrically coupled to adjustable orifices 2109.

In some embodiments, controller 2119 may include one or more microcontrollers, microprocessors, FPGAs (field programmable gate arrays), a combination of analog devices, such analog integrated circuits (ICs), or any other devices known in the art. In some embodiments, downhole steering tool 2100 may include differential rotation sensor 2112, which may be operable to measure a difference in rotation rates between mandrel 2012 and housing 2101, and housing rotation measurement device or sensor 2116, which may be operable to measure a rotation rate of housing 2101. For example, in some embodiments, differential rotation sensor 2112 may include one or more infrared sensors, ultrasonic sensors, Hall-effect sensors, fluxgate magnetometers, magneto-resistive magnetic-field sensors, micro-electro-mechanical system (MEMS) magnetometers, and/or pick-up coils. Differential rotation sensor 2112 may interact with one or more markers 2114, such as infrared reflection mirrors, ultrasonic reflectors, magnetic markers, permanent magnets, electro magnets, coupled to mandrel 2012 which may be, for example and without limitation, one or more magnets or electro-magnets to interact with a magnetic differential rotation sensor 2112. Housing rotation measurement device or sensor 2116 may include one or more accelerometers, magnetometers, and/or gyroscopic sensors, including micro-electro-mechanical system (MEMS) gyros, MEMS accelerometers and/or others operable to measure cross-axial acceleration, magnetic-field components, or a combination thereof. Gyroscopic sensors and/or MEMS gyros may be used to measure the rotation speed of housing 2101 and irregular rotation speed of housing 2101, such as torsional oscillation and stick-slip. The accelerometers and magnetometers in housing 2101 may be used to calculate the toolface of downhole steering tool 2100. The toolface of downhole steering tool 2100 may, in some embodiments, be referenced to a particular steering blade 2103. In some embodiments, the toolface of downhole steering tool 2100 may be defined relative to a gravity field, known as a gravity toolface; defined relative to a magnetic field, known as a magnetic toolface; or a combination thereof. Differential rotation sensors 2112 and housing rotation measurement device or sensors 2116 may be disposed anywhere in the housing 2101. Markers 2114 may be disposed to the corresponding position on mandrel 2012, substantially near differential rotation sensors 2112.

Figure 29:
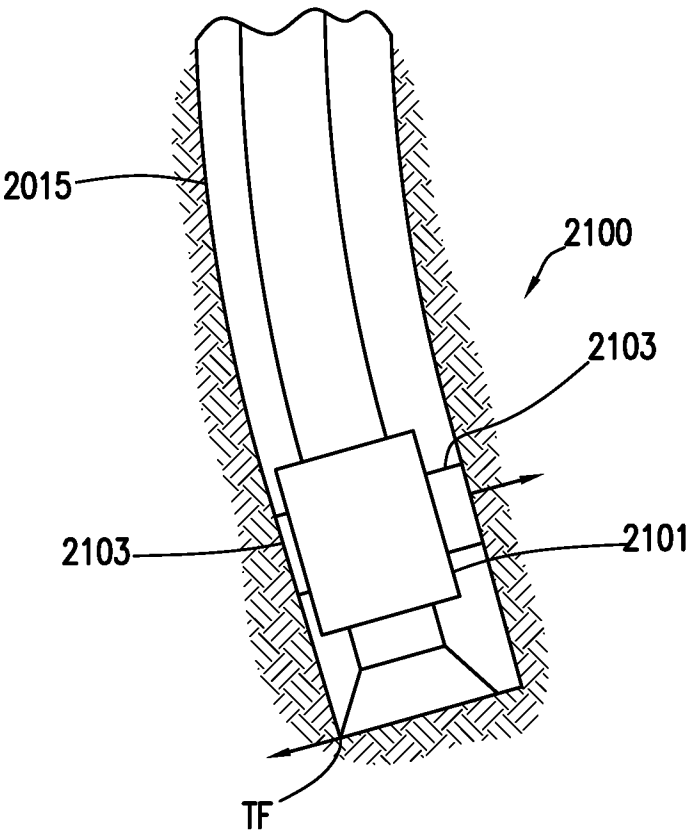
FIG. 29 depicts a cross section of a downhole tool consistent with at least one embodiment of the present disclosure.

When drilling a vertical wellbore 2015, as depicted in FIG. 29, gravity toolface may be used. To maintain verticality, gravity toolface (GTF) may be set to the low side of wellbore 2015, corresponding to a 180° gravity toolface, and at least one steering blade 2103 may apply an eccentric force to the side of wellbore 2015 opposite the target toolface (TF). In some embodiments, the steering blade 2103 may apply an eccentric force to the side of wellbore 2015 substantially opposite the target TF, such as, for example and without limitation, within 15° of 180° from the target TF.

In some embodiments, in order to drill wellbore 2015 vertically, the target gravity tool face (GTF) of downhole steering tool 2100 may be set to the low side of the borehole (GTF=180°). In some embodiments, the equation for the GTF may be given by:

$$GTF = \arctan\left(\frac{G_y}{G_x}\right).$$

The accuracy of GTF near vertical may depend on the accuracy of the transverse acceleration measurements (Gx and Gy).

Figure 30:
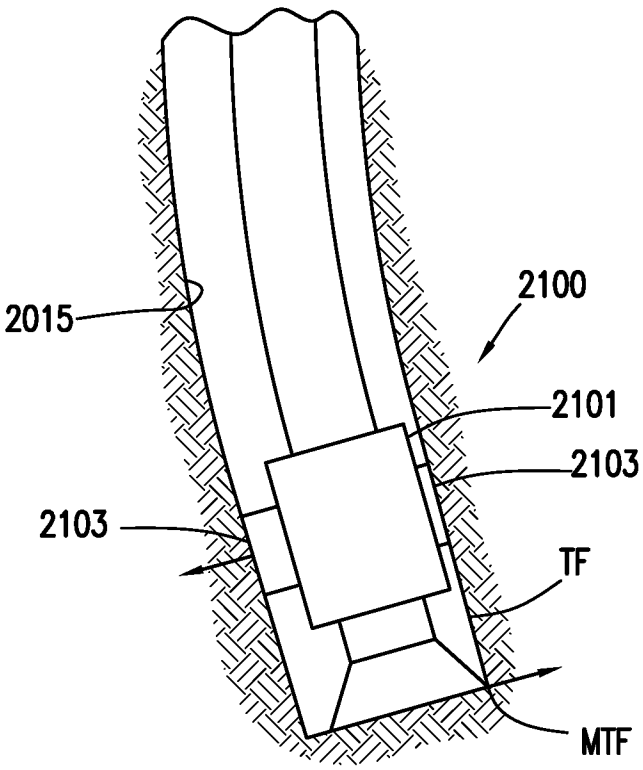
FIG. 30 depicts a cross section of a downhole tool consistent with at least one embodiment of the present disclosure.

To form a deviated wellbore, the initial change in direction of wellbore 2015, referred to herein as a kick-off from vertical, as depicted in FIG. 30, may be defined with respect to a magnetic toolface. In some embodiments, at least one steering blade 2103 may apply an eccentric force to the opposite side of the target toolface against wellbore 2015.

In some embodiments, when vertical or, for example and without limitation, within 5° to 10° of vertical, a magnetic toolface may be used. Above, for example and without limitation, 5° to 10° of inclination, a gravity toolface may be utilized.

In some embodiments, in vertical kick-off, magnetic toolface (MTF) may be used to kick off to the desired direction (e.g. referenced to magnetic field, such as north, south, east, west or magnetic toolface to be zero, referencing to the magnetic north). The equation for the MTF may be given by:

$$MTF = \arctan\left(\frac{M_y}{M_x}\right)$$

Figure 31A:
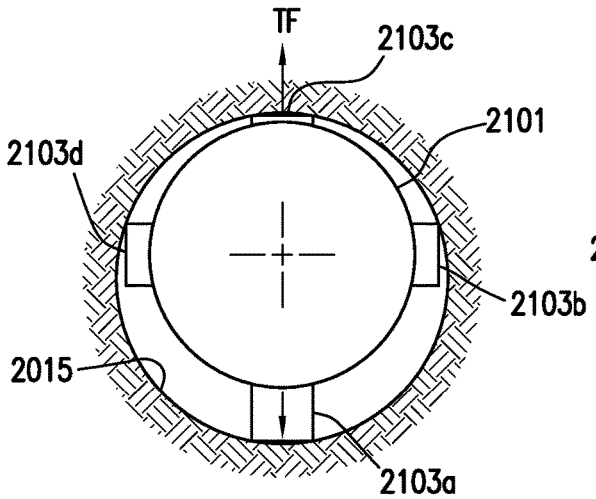
FIGS. 31A-D depict schematic cross sections of a downhole tool consistent with at least one embodiment of the present disclosure in various rotational positions.
Figure 31B:
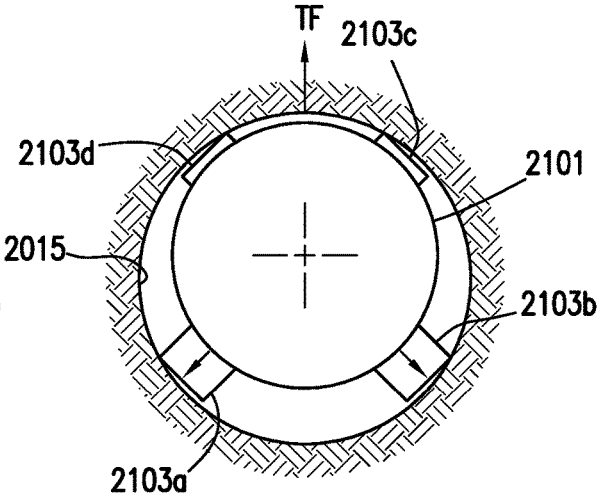
Figure 31C:
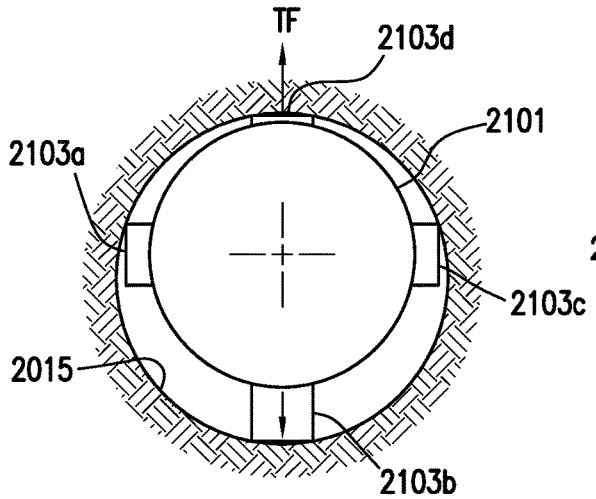
Figure 31D:
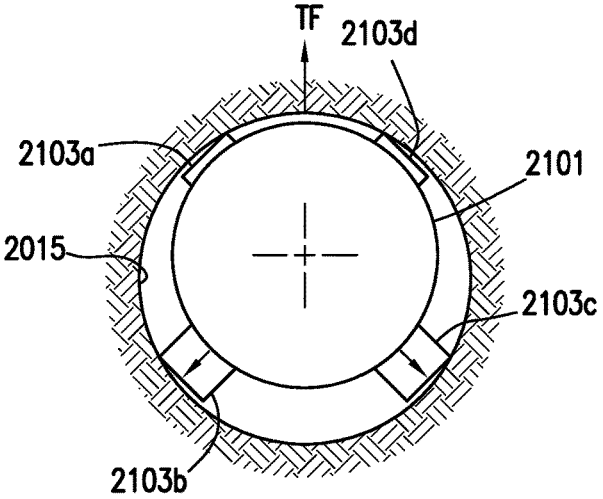

In some embodiments, as housing 2101 rotates, the steering blade or blades 2103 aligned substantially opposite of the target toolface changes. Controller 2119 may be configured to actuate either one or two adjacent steering blades 2103 to apply an eccentric steering force on wellbore 2015 to push downhole steering tool 2100 in a desired direction corresponding with the target toolface. In some embodiments, the steering blades 2103 not actuated by controller 2119 may be extended to provide gripping pressure as they are in the partially open position. For example and without limitation, as depicted in FIGS. 31A-D, as housing 2101 rotates substantially slowly, e.g. one revolution per hour, steering blades 2103*a-d*, as rotated relative to wellbore 2015, are sequentially actuated when oriented opposite the target toolface (TF). In FIG. 31A, steering blade 2103*a* is actuated. In FIG. 31B, after housing 2101 rotates, steering blades 2103*a* and 2103*b* are actuated. In FIG. 31C, steering blade 2103*b* alone is actuated, and in FIG. 31D, steering blades 2103*b* and 2103*c* are actuated.

In some embodiments, the target toolface (either MTF or GTF) may be downlinked to downhole steering tool 2100. In some embodiments, the target toolface may be computed based on the target inclination or target inclination/azimuth downlinked to downhole steering tool 2100. In some such embodiments, controller 2119 may use a closed-loop control system for inclination/azimuth hold.

Figure 26A:
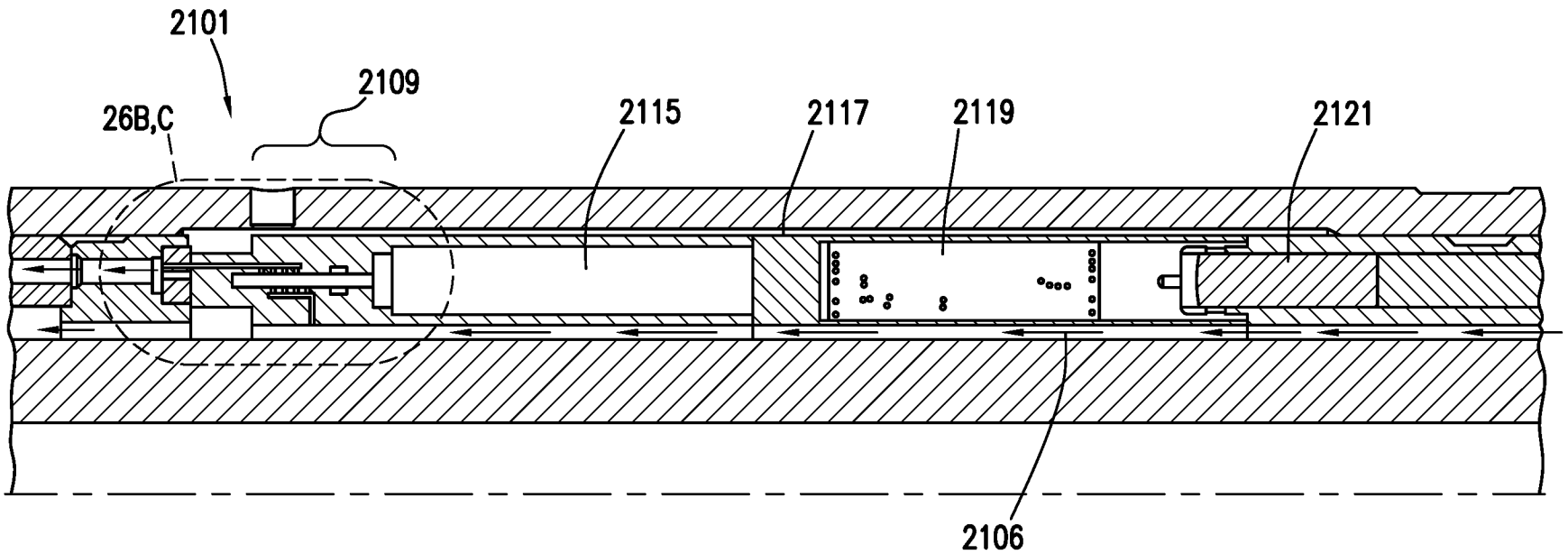
FIG. 26A depicts a partial cross section view of a downhole tool consistent with at least one embodiment of the present disclosure.

In some embodiments, as depicted in FIG. 26A, each adjustable orifice 2109 may be controlled by a corresponding solenoid actuator, referred to herein as solenoid 2115. In some embodiments, each solenoid 2115 may be positioned within compensated oil compartment 2117. Compensated oil compartment 2117 may be filled with a fluid such as an oil and prevent or restrict drilling fluid or other debris from entering compensated oil compartment 2117. In some embodiments, compensated oil compartment 2117 may be pressurized to a pressure higher than that expected of the surrounding fluid.

In some embodiments, solenoids 2115 may be controlled by controller 2119. In some embodiments, controller 2119 may be electrically coupled to solenoids 2115, and may include electronics configured to actuate solenoids 2115. In some embodiments, controller 2119 may include or be electrically coupled to one or more sensors, such as, for example and without limitation, accelerometers, gyroscopes, magnetometers, etc., and may use information detected by the one or more sensors to control solenoids 2115. In some embodiments, controller 2119 may include electronics for receiving instructions for controlling solenoids 2115. In some embodiments, controller 2119 may include one or more power supplies, such as, for example and without limitation, batteries 2121, for powering controller 2119 and solenoids 2115. Solenoids 2115 may be coupled to adjustable orifices 2109 by one or more mechanical linkages. Solenoids 2115 may be any type of solenoid known in the art, including, for example and without limitation, push solenoids, pull solenoids, rotary solenoids, and latching solenoids.

Figure 26B:
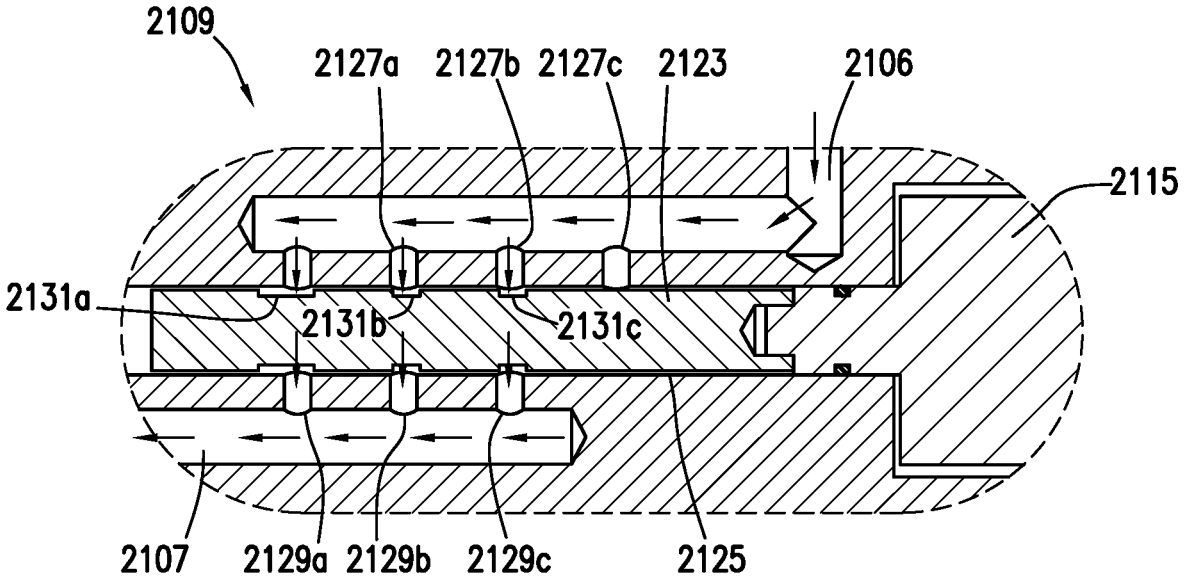
FIG. 26B depicts a detail view of the downhole tool of FIG. 26A in an open position.
Figure 26C:
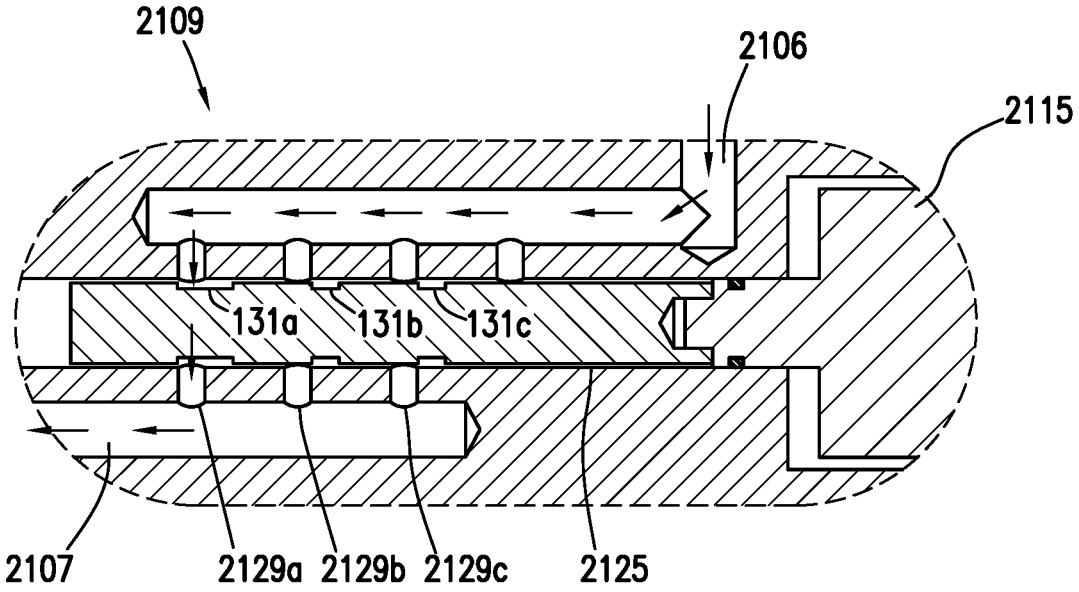
FIG. 26C depicts a detail view of the downhole tool of FIG. 26A in a partially open position.

In some embodiments, as depicted in FIG. 26B, 26C, solenoid 2115 may be coupled to piston 2123. Piston 2123 may be movable by solenoid 2115, here depicted as a linear push solenoid although other solenoids are encompassed by this disclosure. Piston 2123 may be positioned within valve cylinder 2125. Valve cylinder 2125 may include two or more input ports 2127*a-c* that are fluidly coupled with fluid supply ports 2106 as discussed herein above in fluid communication with the interior of mandrel 2012. Valve cylinder 2125 may also include output ports 2129*a-c* that are fluidly coupled to steering port 2107. In some embodiments, input ports 2127*a-c* may be aligned with output ports 2129*a-c*. In some embodiments, piston 2123 may include one or more radial grooves 2131*a-c*. Radial grooves 2131*a-c* may fluidly couple corresponding input ports 2127*a-c* and output ports 2129*a-c* when the corresponding radial groove 2131*a-c* is aligned therewith as depicted in FIG. 26B (the "open" position), and close fluid communication therebetween when not aligned therewith by movement of piston 2123 by solenoid 2115 as depicted in FIG. 26C (the "partially open" position). In some embodiments, one or more of radial grooves 2131*a-c* (here depicted as radial groove 2131*a*) may be of a sufficient width such that fluid communication between the corresponding ports, here input port 2127*a* and output port 2129*a*, is open when piston 2123 is in the partially open position, as depicted in FIG. 26C where radial groove 2131*a* is wider than radial grooves 2131*b-c*. In such an embodiment, when in the open position, i.e. adjustable orifice 2109 is open, more fluid is able to flow through than when in the partially open position, i.e. adjustable orifice 2109 is partially open, as all input ports 2127*a-c* are fluidly coupled to output ports 2129*a-c*, rather than only one input port 2127*a* to output port 2129*a* in the partially open position. One having ordinary skill in the art with the benefit of this disclosure will understand that any number of input ports and output ports may be utilized without deviating from the scope of this disclosure, and any number of ports may remain fluidly coupled in the closed position without deviating from the scope of this disclosure. In some embodiments, the number of ports may be selected such that the force required to actuate solenoid 2115 is within a desired limit.

Figure 27A:
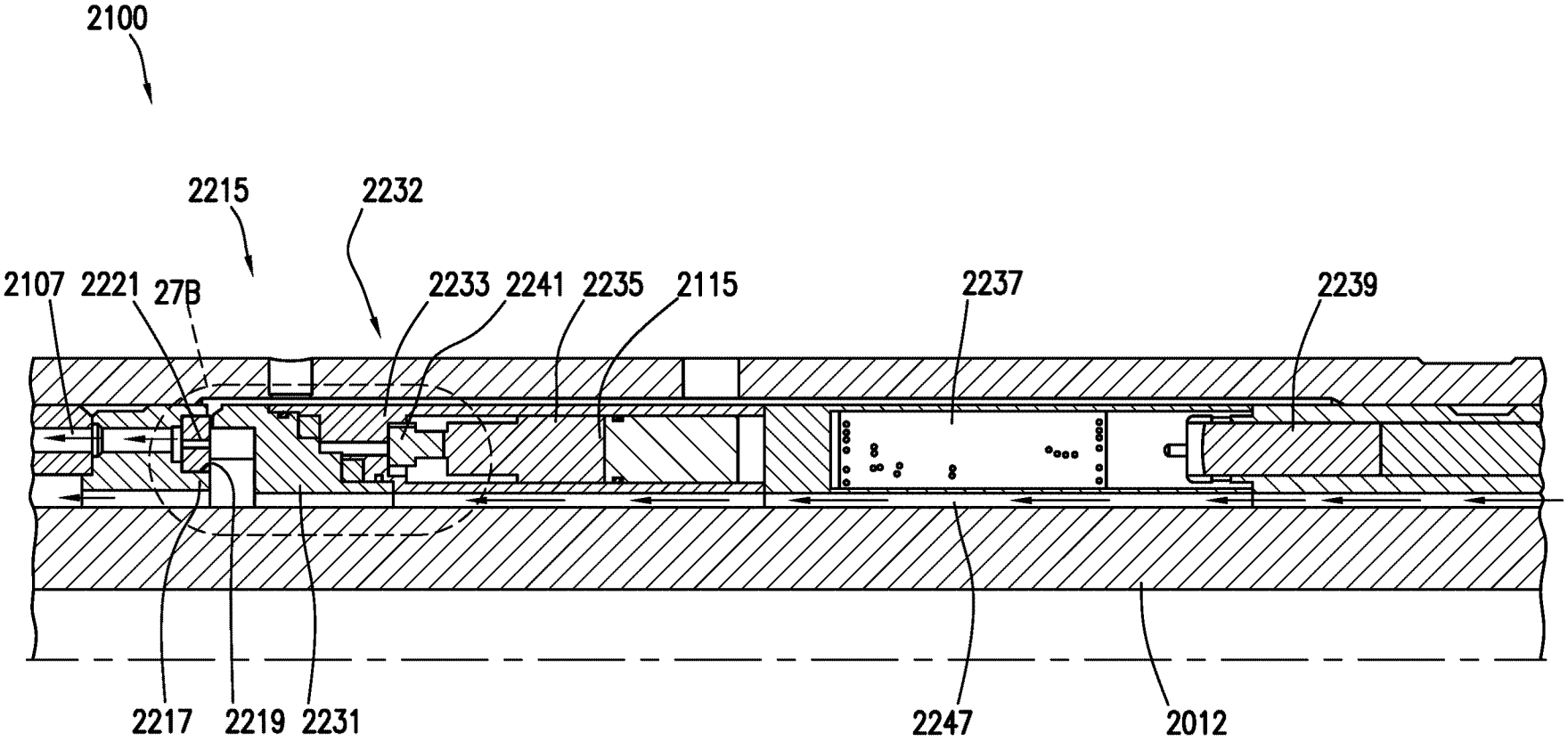
FIG. 27A depicts a partial cross section view of a downhole tool consistent with at least one embodiment of the present disclosure.
Figure 27B:
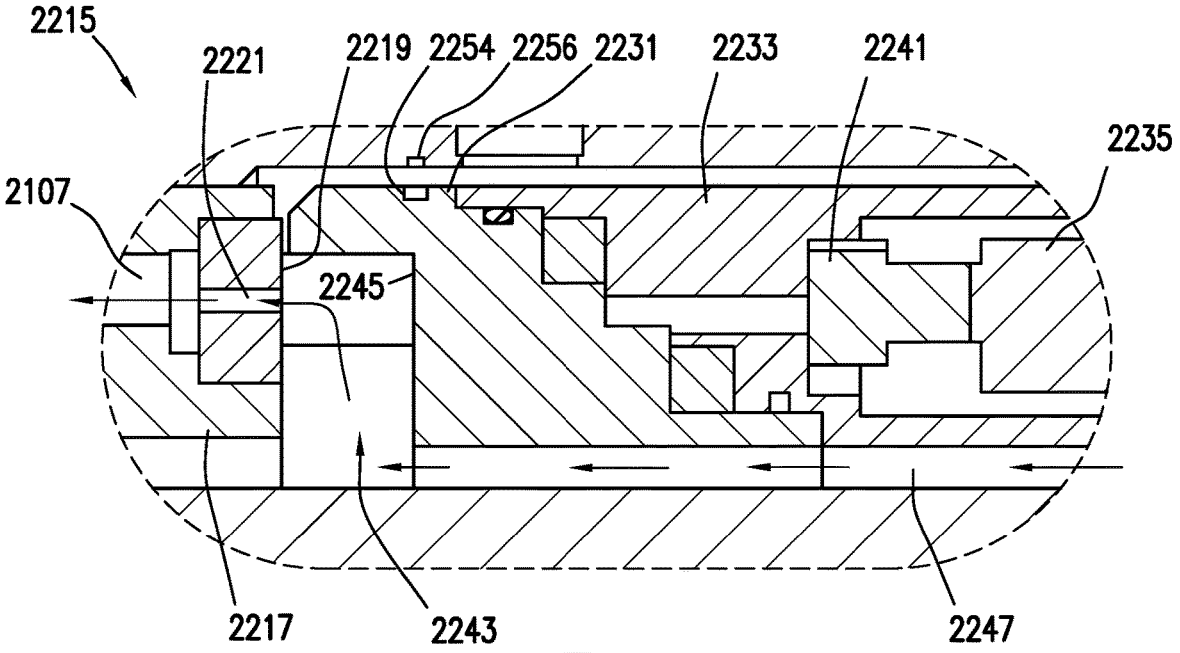
FIG. 27B depicts a detail view of the downhole tool of FIG. 27A.
Figure 27C:
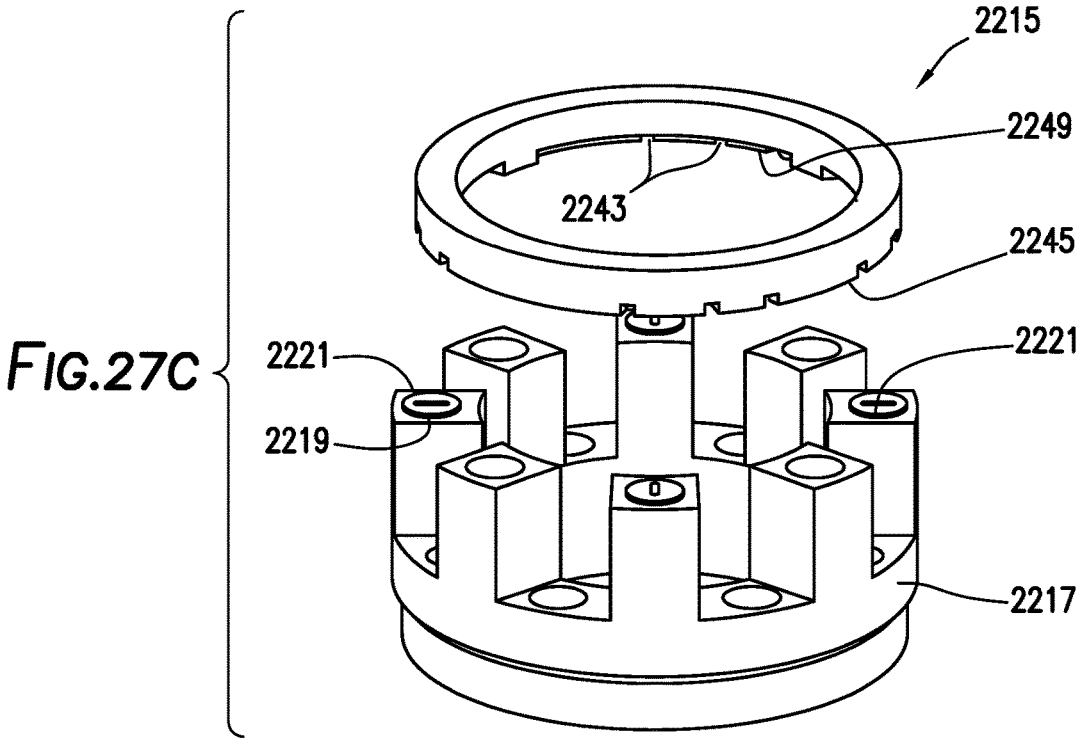
FIG. 27C depicts a perspective view of components of the downhole tool of FIG. 27A.
Figure 28A:
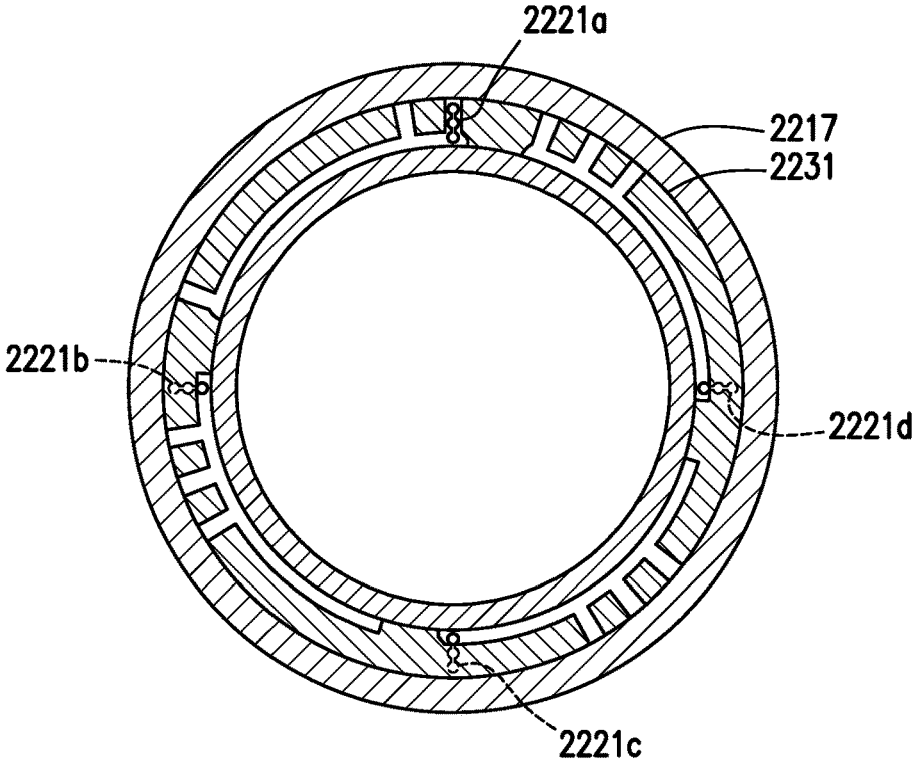
FIGS. 28A-28J depict a semitransparent view of a ring valve consistent with at least one embodiment of the present disclosure in various positions.
Figure 28B:
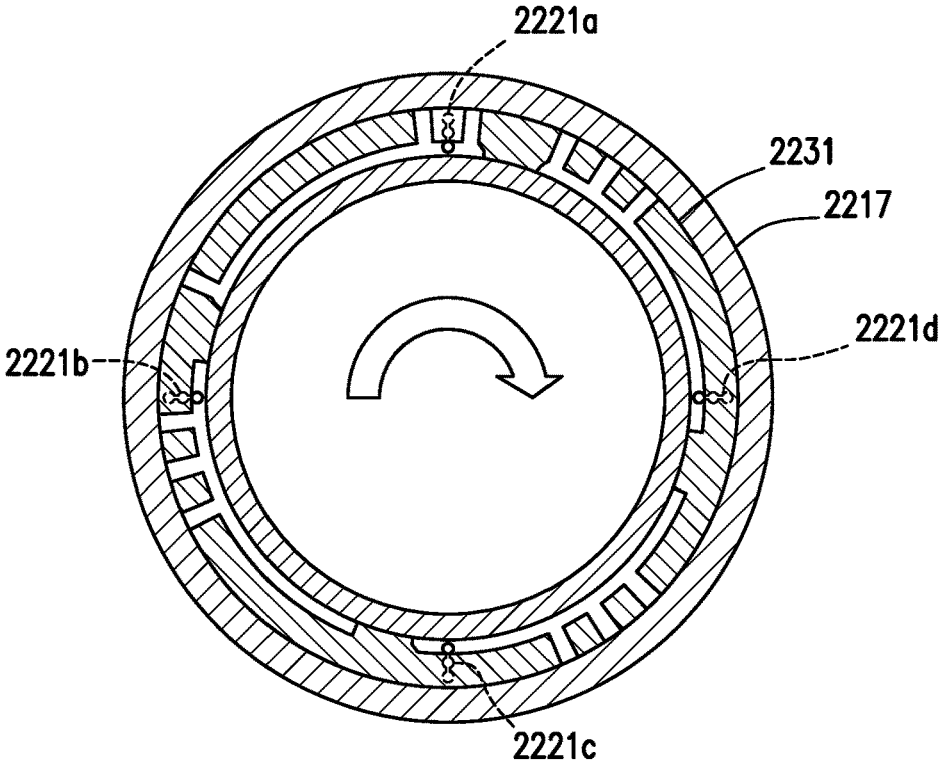
Figure 28C:
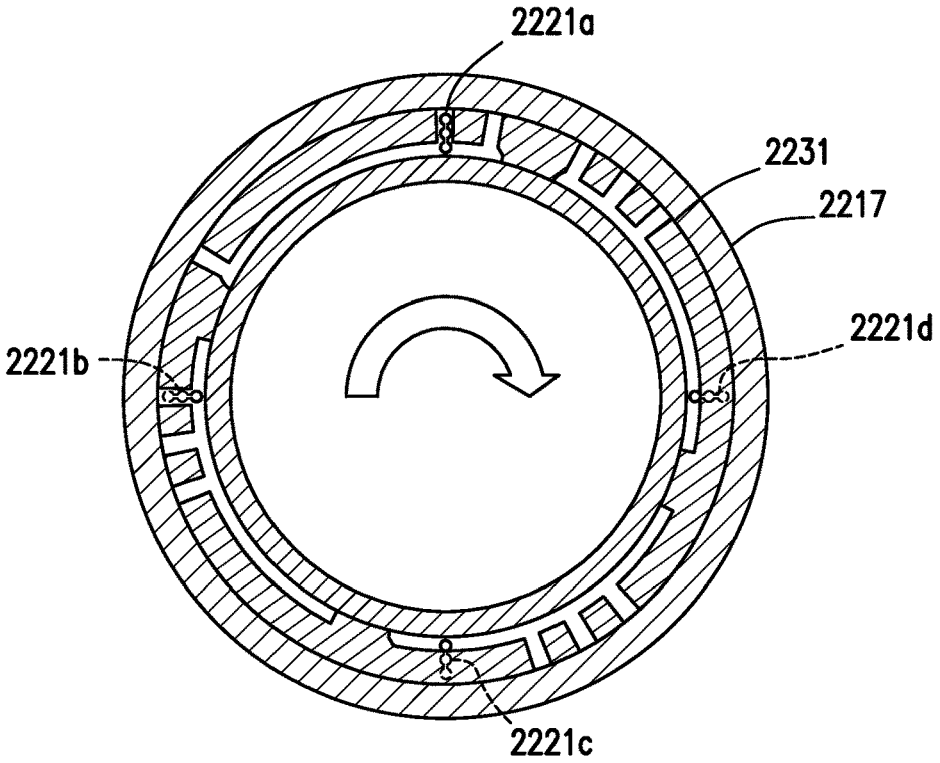
Figure 28D:
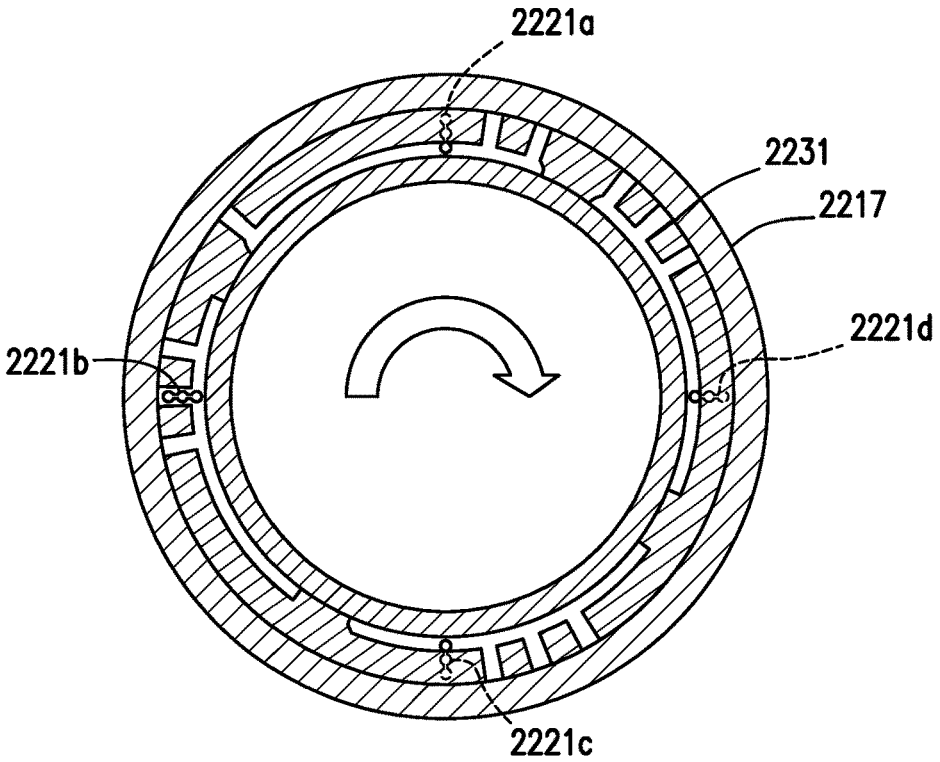
Figure 28E:
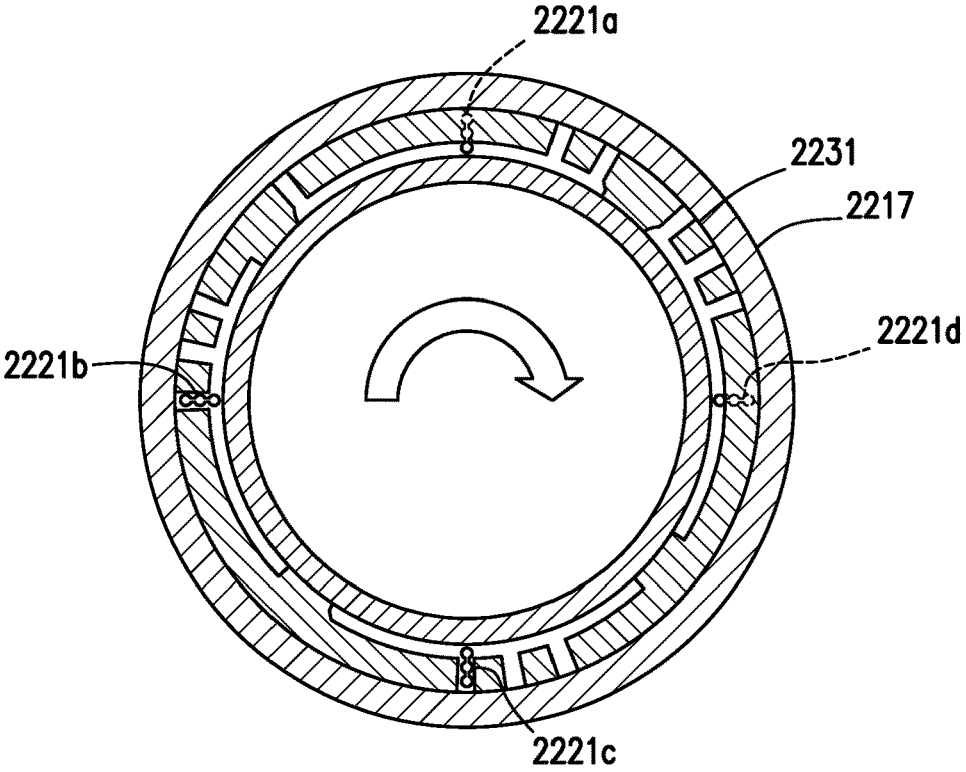
Figure 28F:
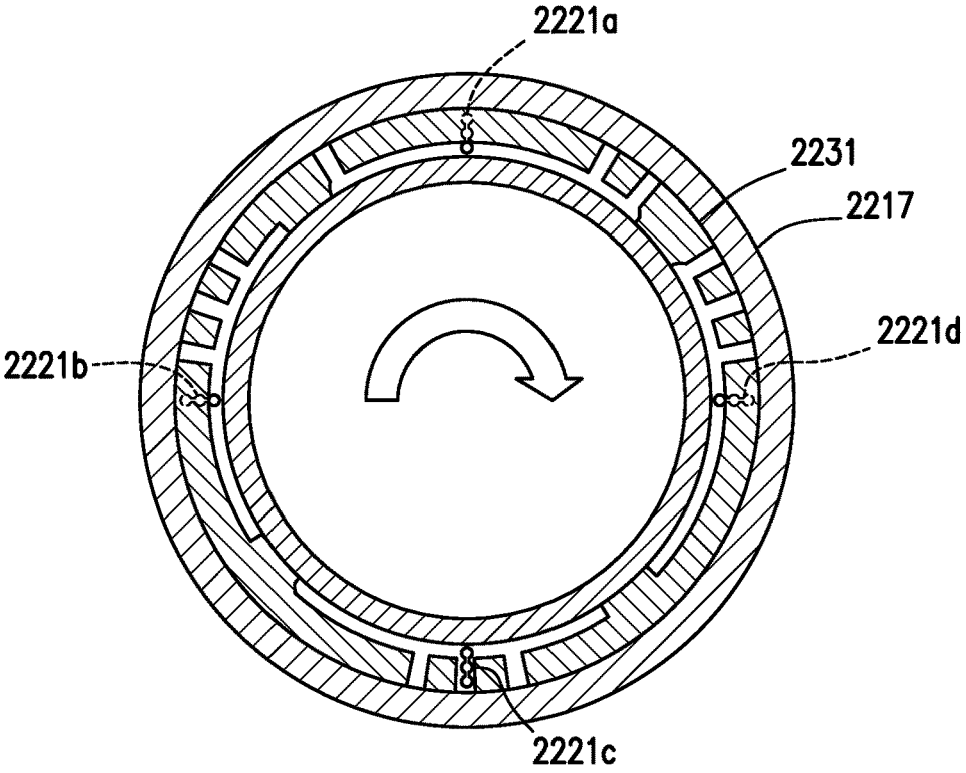
Figure 28G:
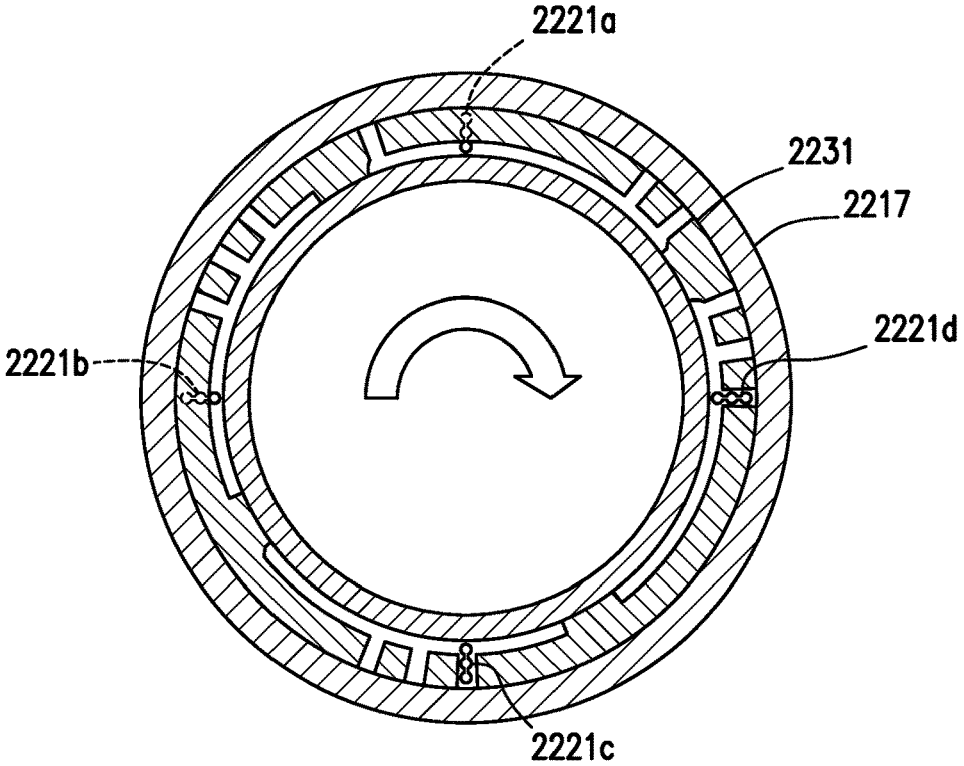
Figure 28H:
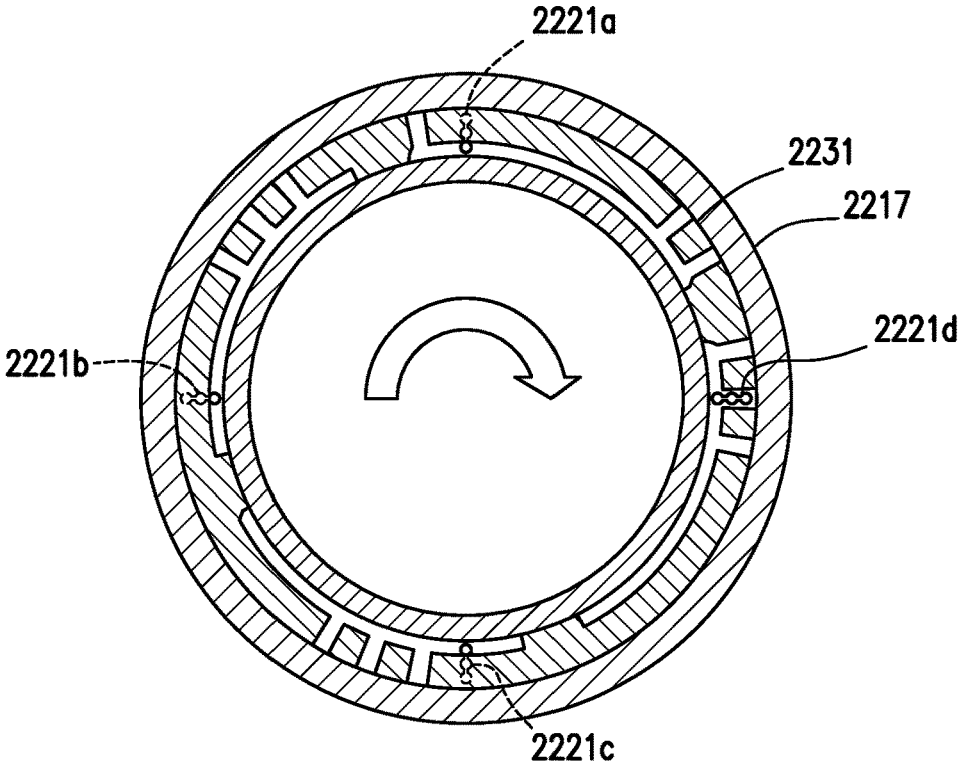
Figure 28I:
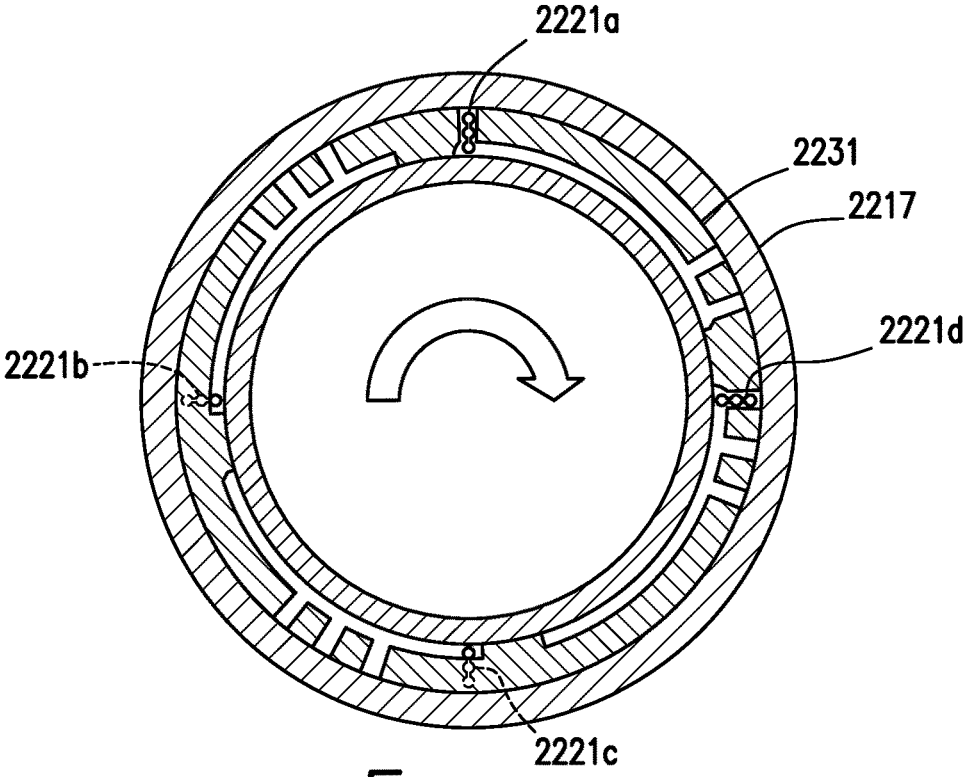
Figure 28J:
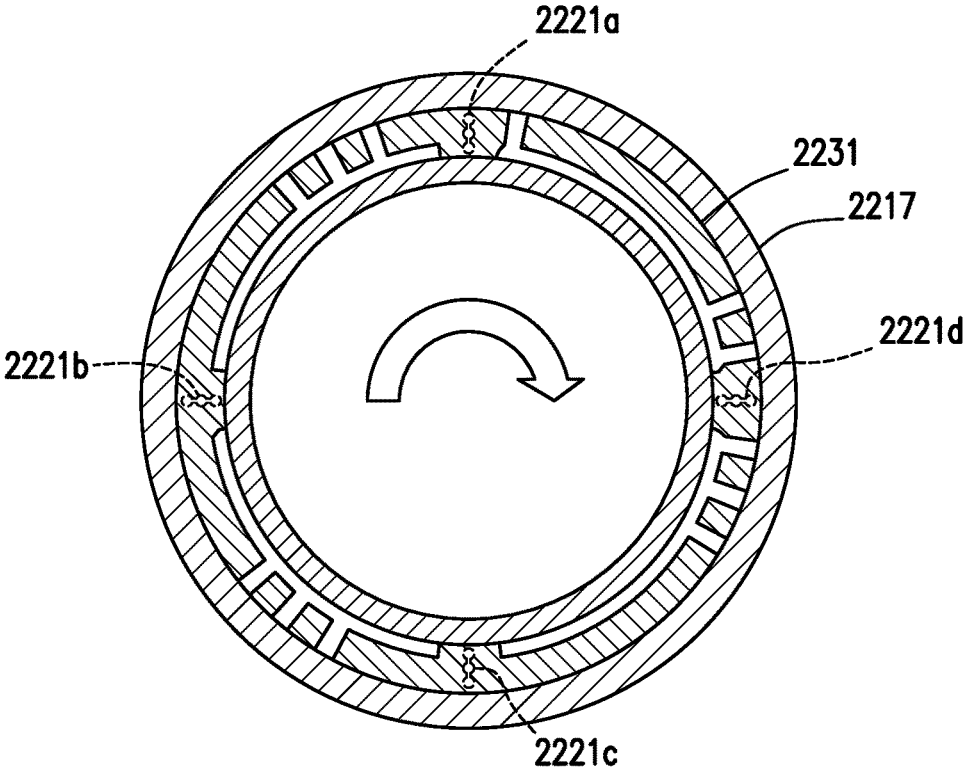

In some embodiments, as depicted in FIGS. 27A-C, adjustable orifices 2109' may be controlled by ring valve 2215. Ring valve 2215, may include manifold 2217 and valve ring 2231. Manifold 2217 may include adjustable orifices 2109' defining manifold orifices 2221 arranged about upper manifold surface 219. Each manifold orifice 2221 may be coupled to a corresponding steering port 2107. Fluids controlled by ring valve 2215 may include, but are not limited to, drilling mud, such as oil-based drilling mud or water-based drilling mud, air, mist, foam, water, oil, including gear oil, hydraulic fluid or other fluids within mandrel 2012.

Valve ring 2231 may be generally annular. Valve ring 2231 may be rotated by one or more motors 2235. In some embodiments, motor 2235 may be an electric motor, such as, for example and without limitation, a brushless DC (direct current) motor. In some embodiments, motor 2235 may be controlled by controller 2237. In some embodiments, controller 2237 may include electronics configured to actuate motor 2235. In some embodiments, controller 2237 may include one or more sensors, such as, for example and without limitation, accelerometers, gyroscopes, magnetometers, etc., and may use information detected by the one or more sensors to control motor 2235. In some embodiments, valve ring 2231 may include one or more position markers 2254 such as magnetic markers or magnets. Controller 2237 may include one or more valve ring position sensors 2256 to determine the position of valve ring 2231. Valve ring position sensors 2256 may include, for example and without limitation, one or more pick up coils, magnetometers, Hall-effect sensors, mechanical position sensors, or optical position sensors. In some embodiments, controller 2237 may include electronics for receiving instructions for controlling motor 2235. In some embodiments, controller 2237 may include one or more power supplies, such as, for example and without limitation, batteries 2239, for powering controller 2237 and motor 2235. Motor 2235 may be coupled to valve ring 2231 by one or more mechanical linkages such as gearbox 2232 which may include, for example and without limitation, drive ring 2233 and pinion 2241 or other linkages. In some embodiments, valve ring 2231 may be coupled to or formed as part of a rotor of motor 2235.

abut or be positioned in abutment with upper manifold surface 2219 such that when a slot 2243 is aligned with a manifold orifice 2221 of manifold 2217, fluid may flow through manifold orifice 2221 from fluid supply port 2247 coupled to the interior of mandrel 2012 as previously discussed herein. Valve ring 2231 may be rotated by motor 2235, moving slots 2243 into and out of alignment with adjustable orifices 2109'. In some embodiments, valve ring 2231 may be rotatable by one or more full revolutions. In some embodiments, slots 2243 may be arranged such that valve ring 2231 needs only rotate a partial turn to actuate each of adjustable orifices 2109'. In some embodiments, slots 2243 may be arranged about valve ring 2231 such that adjustable orifices 2109' opposite one another are not open at the same time. In some embodiments, slots 2243 may be arranged such that adjacent adjustable orifices 2109' may be opened at the same time.

In some embodiments, lip 2249 may be formed in lower ring surface 2245 of valve ring 2231. Lip 2249 may be positioned such that lower ring surface 2245 of valve ring 2231 partially blocks a manifold orifice 2221 when aligned with lip 2249 and not with slot 2243, thereby partially opening the manifold orifice 2221. In some embodiments, lip 2249 may be discontinuous such that all manifold orifices 2221 may be fully closed in a certain position of valve ring 231.

For example, FIGS. 7A-J depict an exemplary valve ring 2231 (in semitransparent view) positioned manifold 2217. Each drawing depicts valve ring 2231 rotated to a different angular position and with slots 2243 opening or closing one or more of manifold orifices 222*l* a-d as outlined in the following table.

TABLE 1

| Ring Valve Positions FIGS. 28A-28J | | | | | |
|---|---|---|---|---|---|
| FIG. # | Valve Ring Angular Position | Orifice 1 (221a) | Orifice 2 (221b) | Orifice 3 (221c) | Orifice 4 (221d) |
| 7A | 0° | OPEN | PARTIALLY OPEN | PARTIALLY OPEN | PARTIALLY OPEN |
| 7B | 5°* | PARTIALLY OPEN | PARTIALLY OPEN | PARTIALLY OPEN | PARTIALLY OPEN |
| 7C | 10° | OPEN | OPEN | PARTIALLY OPEN | PARTIALLY OPEN |
| 7D | 20° | PARTIALLY OPEN | OPEN | PARTIALLY OPEN | PARTIALLY OPEN |
| 7E | 30° | PARTIALLY OPEN | OPEN | OPEN | PARTIALLY OPEN |
| 7F | 40° | PARTIALLY OPEN | PARTIALLY OPEN | OPEN | PARTIALLY OPEN |
| 7G | 50° | PARTIALLY OPEN | PARTIALLY OPEN | OPEN | OPEN |
| 7H | 60° | PARTIALLY OPEN | PARTIALLY OPEN | PARTIALLY OPEN | OPEN |
| 7I | 70° | OPEN | PARTIALLY OPEN | PARTIALLY OPEN | OPEN |
| 7J | 80° | CLOSED | CLOSED | CLOSED | CLOSED |

Controller 2237 may include, for example and without limitation, one or more microcontrollers, microprocessors, FPGAs (field programmable gate arrays), a combination of analog devices, such analog integrated circuits (ICs), or any other devices known in the art, which may be programmed with motor controller logic and algorithms, including angular position controller logic and algorithms.

In some embodiments, valve ring 2231 may include one or more slots 2243 formed on lower ring surface 2245 thereof (shown in FIG. 27C). Lower ring surface 2245 may In some embodiments, although described as at a 5° offset of valve ring 2231, the position shown in FIG. 28B in which each manifold orifice 2221*a-d* is partially closed may be between any of the other positions, such as at 15°, 25°, etc. In some embodiments, though not depicted, a position of valve ring 2231 may include slots 2243 such that in a position, all manifold orifices 222*l* a-d are open. The position shown in FIG. 7B (all manifold orifices 222*l* a-d being partially open) may be used to create a substantially neutral steering tendency of downhole steering tool 2100 by exerting the same amount of force on each steering blade 2103, and in some embodiments, this valve position is used to drill a substantially straight borehole, including and but not limited to long tangent sections and horizontal sections, with some drop tendency compensation and course correction. Additionally, in some embodiments, the extension of each steering blade 2103 by the same amount of force may cause all steering blades 2103 to contact wellbore 2015 and grip thereagainst, thereby, for example and without limitation, reducing rotation of slowly rotating housing 2101.

Figure 32:
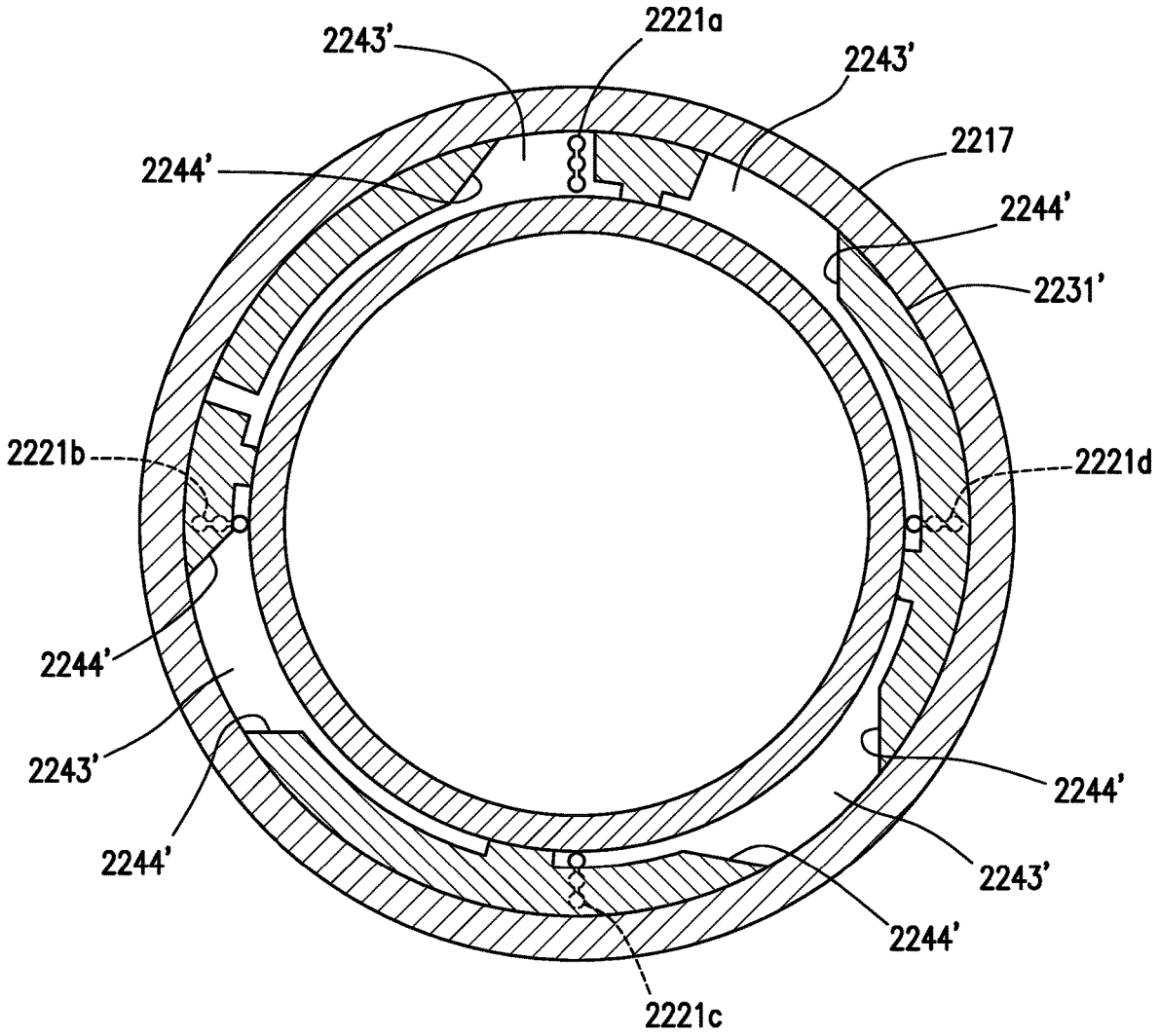
FIG. 32 depicts a semitransparent view of a ring valve consistent with at least one embodiment of the present disclosure.

In some embodiments, as depicted in FIG. 32, valve ring 2231' may include one or more slots 2243' which may include taper 2244'. Taper 2244' may, when aligned with manifold orifices 221*a-d*, partially open one or more of manifold orifices 221*a-d* depending on the rotational position of valve ring 2231'. Therefore, each of manifold orifices 221*a-d* may be partially opened and closed as valve ring 2231' is rotated. In some embodiments, taper 2244' may be formed in lip 2249'. In some embodiments, as valve ring 2231' is rotated, steering blades 2103*a-d* as previously discussed may be extended with variable force depending on how much of the respective manifold orifice 2221*a-d* is opened by taper 2244'. In some embodiments, the rotation of valve ring 2231' may be controlled, for example and without limitation, such that it is rotatable to a known degree increment, referred to herein as a "step." In some embodiments, for example and without limitation, each step may be 0.2°, thereby allowing a fine adjustment of the force-vector direction imparted by steering blades 2103*a-d* controlled by manifold orifices 2221*a-d* respectively. For example, where, as discussed herein above, adjacent valve ring angular positions are separated by 10°, a 0.2° step would allow 50 intermediate positions of valve ring 2231' to be reached. The force-vector direction imparted by steering blades 2103*a-d* may, in such an embodiment, therefore be controlled at 0.9° increments or having 400 discrete force-vector directions. One having ordinary skill in the art with the benefit of this disclosure will understand that by changing the degree increment of the step, the number of discrete force-vector directions may be modified without deviating from the scope of this disclosure. The ability to finely adjust the force-vector direction of downhole steering tool 2100 may thereby allow the force-vector direction to be adjusted at a fine increment to, for example and without limitation, align with the desired direction of propagation of wellbore 2015.

In some embodiments, the rotation of valve ring 2231' between a position in which one or more manifold orifices 2221*a-d* are open to a position in which one or more manifold orifices 2221*a-d* are closed may require a large amount of torque on motor 2235. This increase in torque required may, for example and without limitation, require a higher peak current and therefore larger amount of power to be supplied to motor 2235. This increase in torque required due to the increasing pressure drop across manifold orifices 2221*a-d* as they are closed may, for example and without limitation, cause valve ring 2231' to get stuck, jam, or otherwise not be able to close the respective manifold orifice 2221*a-d*.

Figure 34:
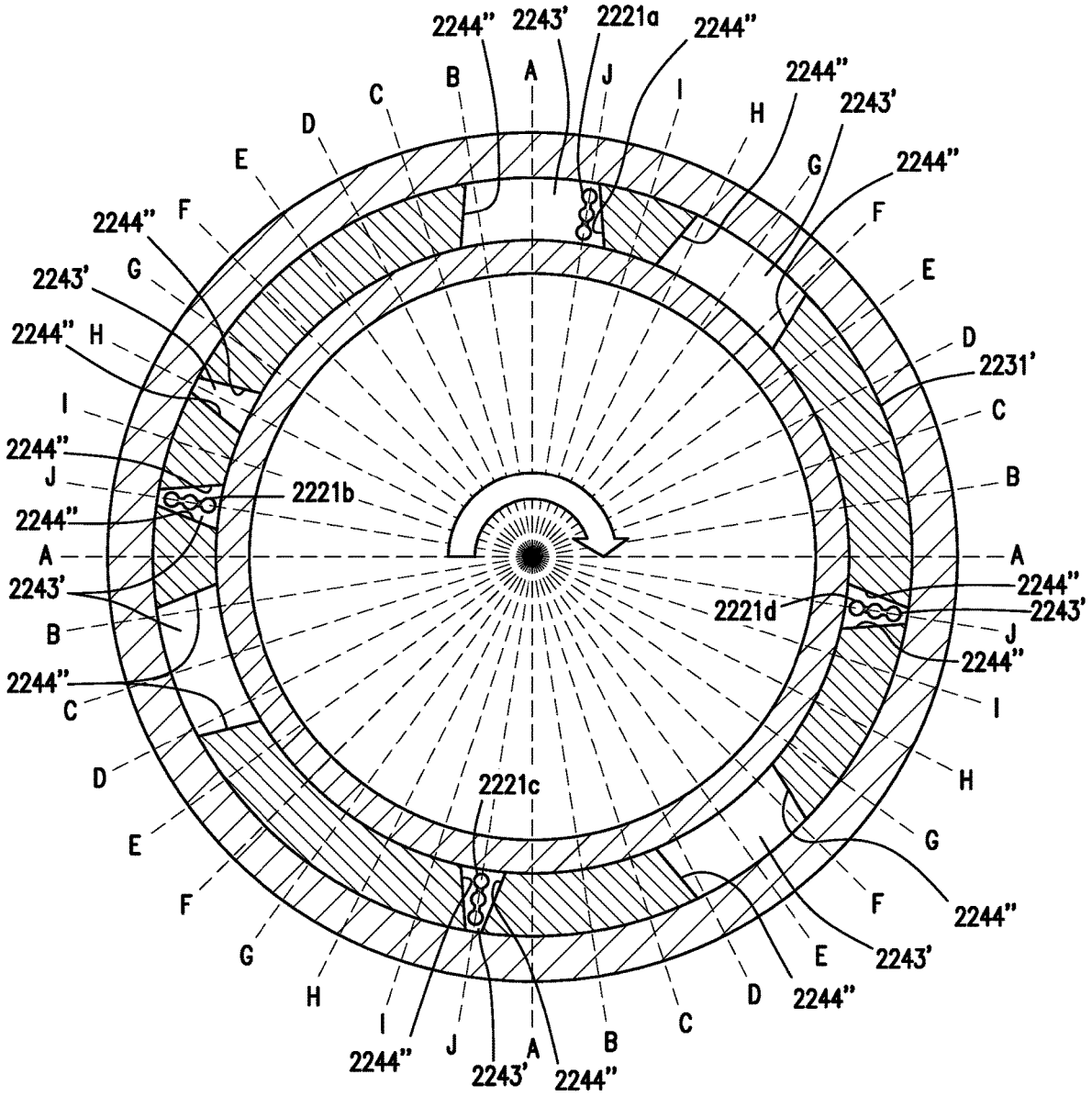
FIG. 34 depicts a semitransparent view of a ring valve consistent with at least one embodiment of the present disclosure.

In some embodiments, as depicted in FIG. 34, valve ring 2231' may be rotated to different angular positions (labeled A-J) such that slots 2243' open or close one or more of manifold orifices 2221*a-d* as outlined in Table 2 below:

TABLE 2

Ring Valve Positions FIG. 34

| Position | Valve Ring Angular Position | Orifice 1 (221a) | Orifice 2 (221b) | Orifice 3 (221c) | Orifice 4 (221d) |
|---|---|---|---|---|---|
| A | 0° | OPEN | CLOSED | CLOSED | CLOSED |
| B | 9° | OPEN | OPEN | CLOSED | CLOSED |
| C | 18° | CLOSED | OPEN | CLOSED | CLOSED |
| D | 27° | CLOSED | OPEN | OPEN | CLOSED |
| E | 36° | CLOSED | CLOSED | OPEN | CLOSED |
| F | 45° | CLOSED | CLOSED | OPEN | OPEN |
| G | 54° | CLOSED | CLOSED | CLOSED | OPEN |
| H | 63° | OPEN | CLOSED | CLOSED | OPEN |
| I | 74° | CLOSED | CLOSED | CLOSED | CLOSED |
| J | 81° | OPEN | OPEN | OPEN | OPEN |

Figure 33:
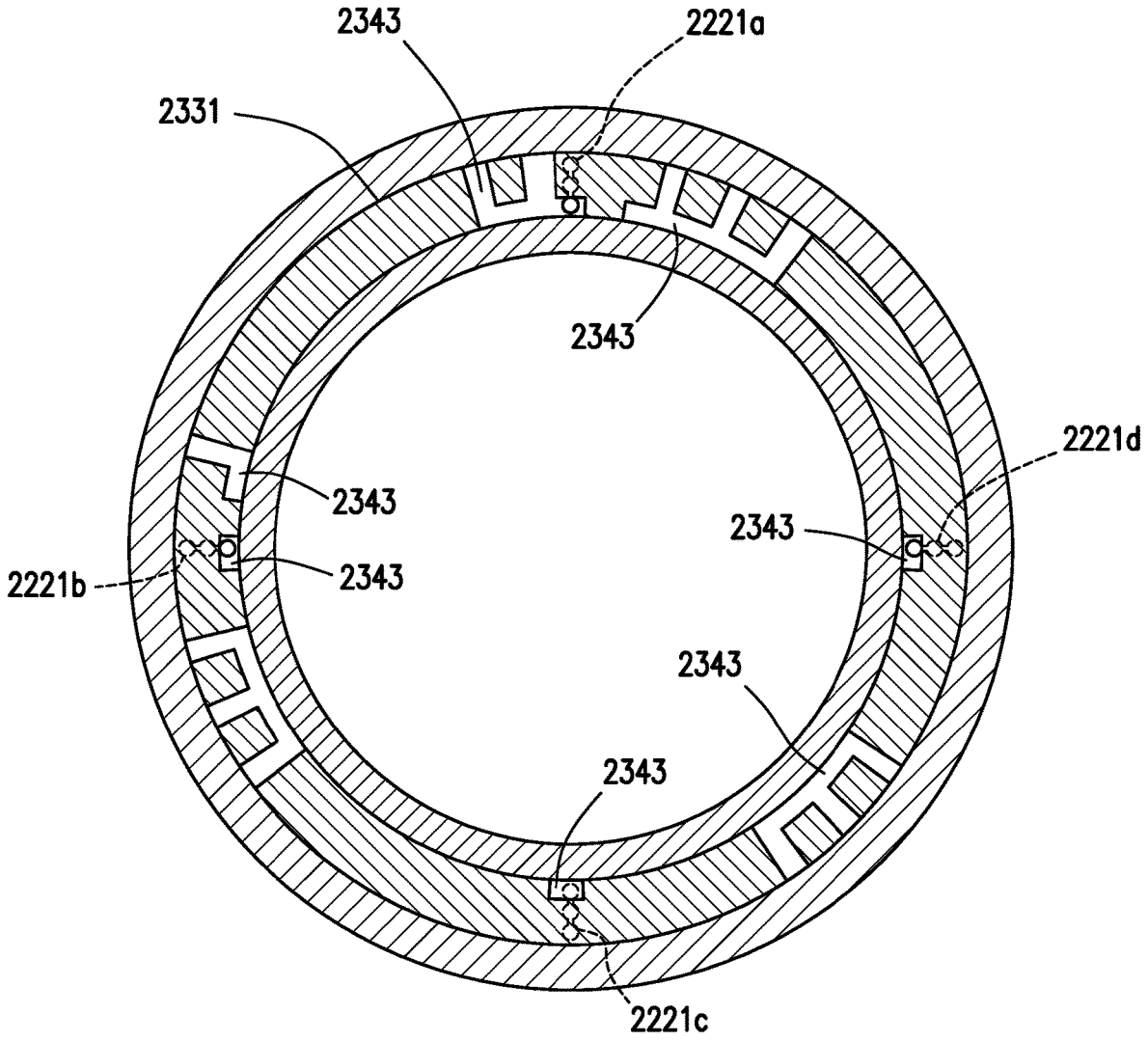
FIG. 33 depicts a semitransparent view of a ring valve consistent with at least one embodiment of the present disclosure.

In such an embodiment, with reference to FIG. 33, slots 2243' may allow all manifold orifices 2221*a-d* to be fully opened when valve ring 2231' is positioned such that manifold orifices 2221*a-d* are aligned with, for example and without limitation, the 81° position denoted J in FIG. 34. Position J may be positioned radially adjacent to a position in which all manifold orifices 222*l* a-d are fully closed, such as, for example and without limitation, the 74° position denoted I in FIG. 13. In some embodiments, each slot 2243' may include taper 2244" allowing, for example and without limitation, valve ring 2231' to gradually close the respective manifold orifice 2221*a-d* to be closed as valve ring 2231' rotates between positions. Tapers 2244" may, for example and without limitation, reduce the torque required to move valve ring 2231' when closing manifold orifices 2221*a-d*, and thereby reducing the chance of valve ring 2231' getting stuck or jammed as valve ring 2231' is moved between positions and reducing peak current or power supplied to the motor 2235.

Figure 35:
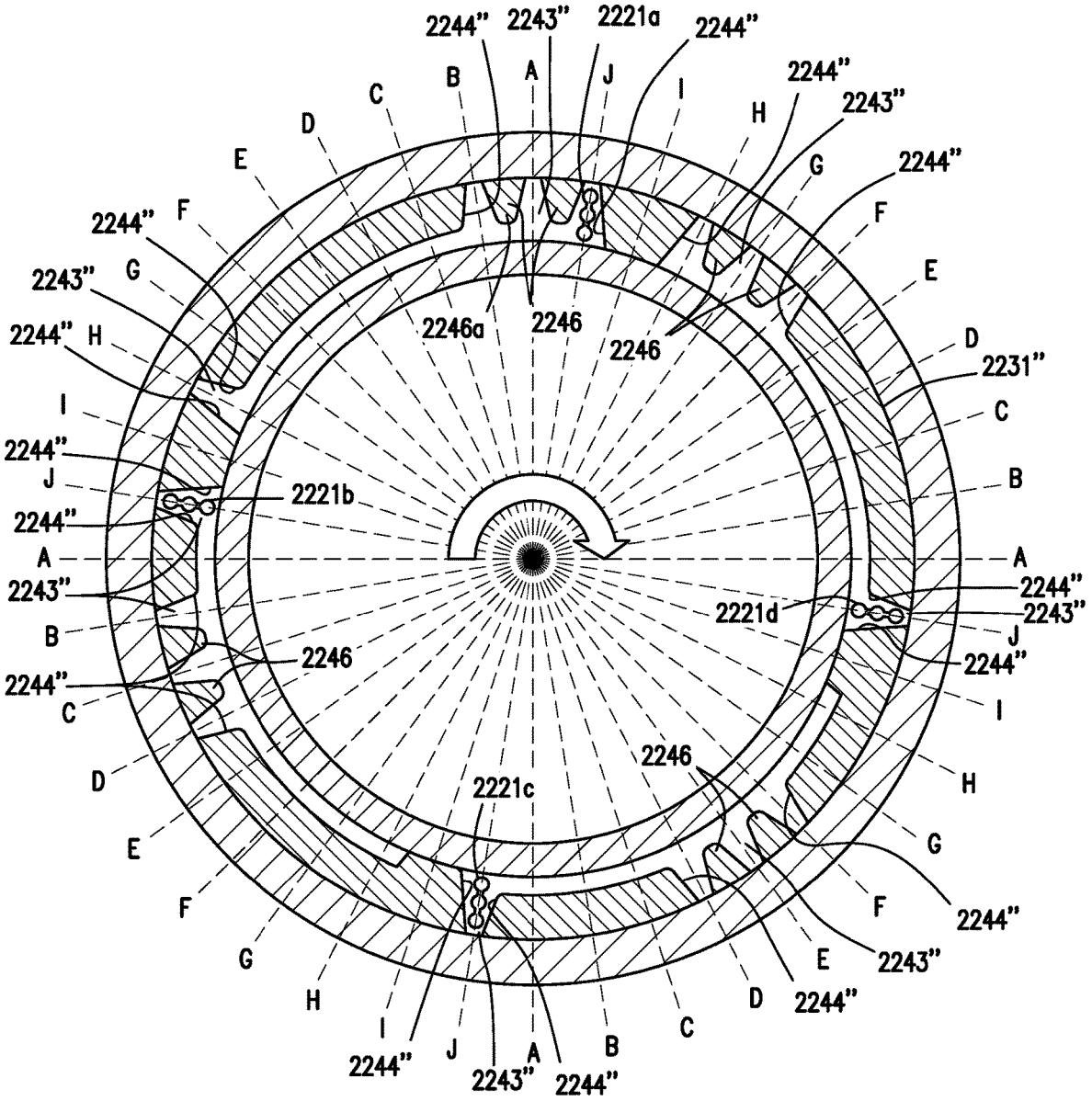
FIG. 35 depicts a semitransparent view of a ring valve consistent with at least one embodiment of the present disclosure.

In some embodiments, valve ring 2231" as depicted in FIG. 35 may operate substantially as described with respect to FIG. 34, such that valve ring 2231" may be rotated to different angular positions (labeled A-J) such that slots 2243" open, partially open, or close one or more of manifold orifices 2221*a-d* as outlined in Table 3 below:

TABLE 3

Ring Valve Positions FIG. 35

| Position | Valve Ring Angular Position | Orifice 1 (221a) | Orifice 2 (221b) | Orifice 3 (221c) | Orifice 4 (221d) |
|---|---|---|---|---|---|
| A | 0° | OPEN | PARTIALLY OPEN | PARTIALLY OPEN | PARTIALLY OPEN |
| B | 9° | OPEN | OPEN | PARTIALLY OPEN | PARTIALLY OPEN |
| C | 18° | PARTIALLY OPEN | OPEN | PARTIALLY OPEN | PARTIALLY OPEN |

TABLE 3-continued

| Ring Valve Positions FIG. 35 | | | | | |
|---|---|---|---|---|---|
| Position | Valve Ring Angular Position | Orifice 1 (221a) | Orifice 2 (221b) | Orifice 3 (221c) | Orifice 4 (221d) |
| D | 27° | PARTIALLY OPEN | OPEN | OPEN | PARTIALLY OPEN |
| E | 36° | PARTIALLY OPEN | PARTIALLY OPEN | OPEN | PARTIALLY OPEN |
| F | 45° | PARTIALLY OPEN | PARTIALLY OPEN | OPEN | OPEN |
| G | 54° | PARTIALLY OPEN | PARTIALLY OPEN | PARTIALLY OPEN | OPEN |
| H | 63° | OPEN | PARTIALLY OPEN | PARTIALLY OPEN | OPEN |
| I | 74° | CLOSED | CLOSED | CLOSED | CLOSED |
| J | 81° | OPEN | OPEN | OPEN | OPEN |

In some embodiments, valve ring 2231" may include intermediate projections 2246 positioned between certain adjacent positions in which rotation of valve ring 2231" would not otherwise close or partially close the respective manifold orifice 2221*a-d*. For example, intermediate projection 2246*a* may, as depicted in FIG. 14, cause partial closing of manifold orifice 2221*a* as valve ring 2231" rotates between position A and position B. In such an embodiment, the arrangement of intermediate projections 2246 and slots 2243" may partially close all manifold orifices 2221*a-d* at intermediate positions between one or more of positions A-J. For example, intermediate projections 246 may be positioned to partially close manifold orifice 2221*a* at intermediate positions between positions J and A and between positions A and B, partially close manifold orifice 2221*b* at intermediate positions between B and C and between positions C and D, partially close manifold orifice 2221*c* at intermediate positions between D and E and between positions E and F, and partially close manifold orifice 2221*d* at intermediate positions between F and G and between positions G and H as valve ring 2231" rotates between positions, placing each respective manifold orifice 221*a-d* in the above described partially open position. In some embodiments, with all four manifold orifices 2221*a-d* may cause the same amount of force to be applied to each steering blade 2103 as described herein above. In some embodiments, valve ring 2231" may be intentionally rotated to one of the intermediate positions, defined as between positions A and B, B and C, C and D, D and E, E and F, F and G, G and H, H and I, I and J, or J and A, allowing for such a condition to be reached. In some such embodiments, the intermediate positions may be reached by a rotation of 4.5° of valve ring 2231" from any of positions A-J.

In some embodiments, as depicted in FIG. 33, valve ring 2331 may include slots 2343 and may not include a lip such as lip 2249 as described herein above. In such embodiments, slots 2343 may be arranged such that depending on the rotational position of valve ring 2331, each of manifold orifices 2221*a-d* may be opened, partially opened, or closed. In some such embodiments, slots 2343 may be arranged about valve ring 2331 such that manifold orifices 221*a-d* opposite one another are not open at the same time. In some embodiments, slots 2343 may be arranged such that manifold orifices 2221*a-d* may be opened at the same time. In some embodiments, slots 2343 may be arranged such that at a certain rotational position of valve ring 2331, all manifold orifices 2221*a-d* may be partially open as depicted in FIG. 33. For example, in some embodiments, positions of valve ring 2331 may result in the opening and closing of manifold orifices 2221*a-d* as outlined in Table 2.

TABLE 4

| Ring Valve Positions FIG. 33 | | | | |
|---|---|---|---|---|
| Valve Ring Angular Position | Orifice 1 (221a) | Orifice 2 (221b) | Orifice 3 (221c) | Orifice 4 (221d) |
| 0° | PARTIALLY OPEN | PARTIALLY OPEN | PARTIALLY OPEN | PARTIAL-LY OPEN |
| 5°* | OPEN | CLOSED | CLOSED | CLOSED |
| 15° | OPEN | OPEN | CLOSED | CLOSED |
| 25° | CLOSED | OPEN | CLOSED | CLOSED |
| 35° | CLOSED | OPEN | OPEN | CLOSED |
| 45° | CLOSED | CLOSED | OPEN | CLOSED |
| 55° | CLOSED | CLOSED | OPEN | OPEN |
| 65° | CLOSED | CLOSED | CLOSED | OPEN |
| 75° | OPEN | CLOSED | CLOSED | OPEN |
| −5° | CLOSED | CLOSED | CLOSED | CLOSED |

In some embodiments, downhole steering tool 2100 may transmit data to the surface or to other downhole tools, including but not limited to an MWD tool, LWD tool, instrumented motor, instrumented turbine, instrumented gear-reduced turbine, instrumented axial oscillation tool, instrumented stick-slip mitigation tool, instrumented steady-weight-on-bit tool, instrumented reamer, instrumented underreamer, and instrumented drill bit. In some embodiments, for example and without limitation, a series of pressure pulses may be utilized to transmit communication signals. The pressure pulses may be generated by the opening and closing of one or more steering ports 2107 by solenoids 2115 or ring valve 2215.

In some embodiments, solenoids 2115 may be used to generate pressure pulses by opening and closing one or more solenoids 2115. As an example utilizing ring valve 2215, valve ring 2231 may be rotated between a first position corresponding to a minimum pressure drop, i.e. where all manifold orifices 2221*a-d* are closed, to a position corresponding to a higher pressure drop, such as where all manifold orifices 2221*a-d* are open. For example, such a transition may be achieved by a rotation of valve ring 2231' or 2231" between positions I and J as described with respect to FIGS. 34, 35. As another example, valve ring 2231 may be moved between a position in which one manifold orifice 221*a-d* and a position where two are open.

Figure 36:
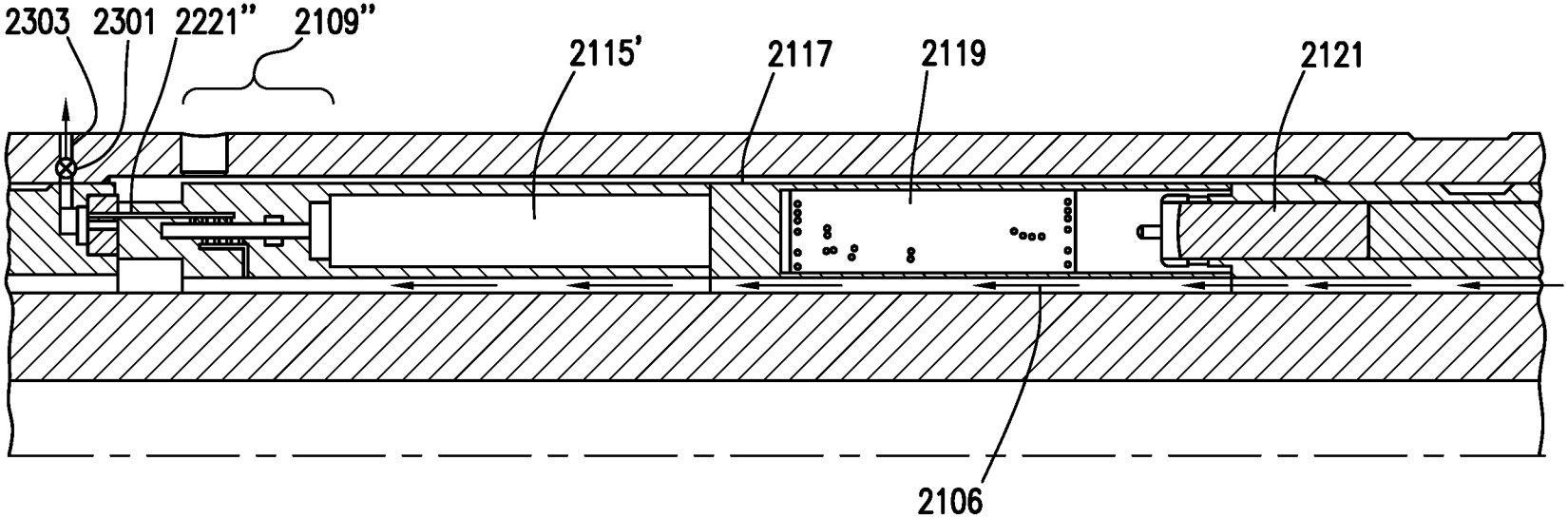
FIG. 36 depicts a partial cross section view of a downhole tool consistent with at least one embodiment of the present disclosure.

In some embodiments, downhole steering tool 2100 may include a dedicated port 2109" as depicted in FIG. 36 having a solenoid 2115' associated therewith or having a manifold orifice 221" associated therewith to bypass a percentage of the internal mud flow to the annulus through a choke 2301 or orifice 2303 could be used. In such an embodiment, dedicated port 2109" may be added to generate a stronger pressure pulse than the steering ports 2107. One having ordinary skill in the art with the benefit of this disclosure will understand that although shown with solenoid 2115', manifold orifice 221" may be used with a valve ring consistent with any other embodiment described herein.

In some embodiments, the pressure pulses may be utilized to transmit a signal to the surface or other downhole tools, including but not limited to an MWD tool, LWD tool, instrumented motor, instrumented turbine, instrumented gear-reduced turbine, instrumented axial oscillation tool, instrumented stick-slip mitigation tool, instrumented steady-weight-on-bit tool, instrumented reamer, instrumented underreamer and instrumented drill bit. In some embodiments, the pressure pulses may be utilized to transmit a binary signal. In some embodiments, the pressure-pulse amplitude, frequency, phase or any combination thereof may be utilized to transmit a binary signal. In some embodiments, Manchester encoding may be utilized to transmit data to the surface, including but not limited to inclination, azimuth, housing gravity/magnetic toolface, target toolface, actual toolface, housing rotation speed, bit rotation speed, shock/vibration severities, temperatures, pressure, other diagnostic information, received downlink command/signal, downlink command/signal reception confirmation, downhole software operation mode/state and other data relating to the operation of one or more downhole tools.

Although described with respect to a slowly rotating housing 2101, one having ordinary skill in the art with the benefit of this disclosure will understand that rotation speed of housing 2101 is not limited to the above mentioned rotation speeds, The steering direction may be controlled with any rotation speed. Additionally, the specific arrangements described herein of slots 2243, 2243' of valve rings 231, 2231', 2331 including any tapers 2244', 2244" are exemplary and are not intended to limit the scope of this disclosure. Combinations of the described arrangements as well as other arrangements of slots and valve rings may be utilized without deviating from the scope of this disclosure.

The methods described herein are configured for downhole implementation via one or more controllers deployed downhole (e.g., in a vertical/directional drilling tool). A suitable controller may include, for example, a programmable processor, such as a microprocessor or a microcontroller and processor-readable or computer-readable program code embodying logic. A suitable processor may be utilized, for example, to execute the method embodiments described above with respect to FIGS. 28A-J, and 31A-D as well as the corresponding disclosed mathematical equations for gravity/magnetic toolface. A suitable controller may also optionally include other controllable components, such as sensors (e.g., a temperature sensor), data storage devices, power supplies, timers, and the like. The controller may also be disposed to be in electronic communication with the other sensors (e.g., to receive the continuous inclination and azimuth measurements). A suitable controller may also optionally communicate with other instruments in the drill string, such as, for example, telemetry systems that communicate with the surface. A suitable controller may further optionally include volatile or non-volatile memory or a data storage device.

Figure 37:
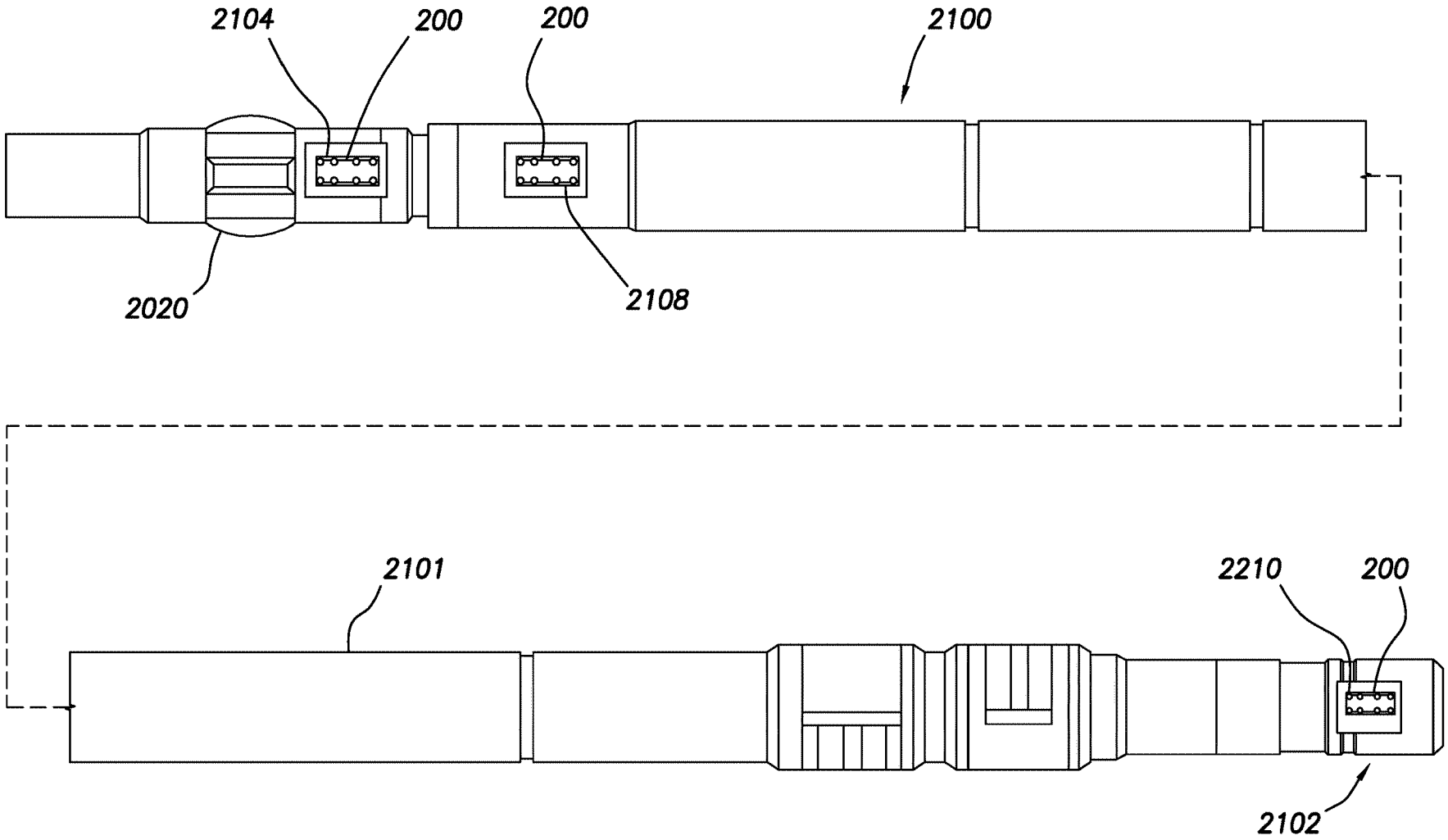
FIG. 37 depicts an overall view of a downhole tool consistent with at least one embodiment of the present disclosure.

FIG. 37 depicts on overall view of downhole steering tool 2100 having one or more drilling dynamics data recorders 200, consistent with certain embodiments of the present disclosure. As shown in FIG. 37, downhole steering tool includes bit box 2020, housing 2101, and upper mandrel 2102. Upper mandrel 2102 may be mechanically connected to mandrel 2012, as described above. Drilling dynamics data recorders 200 may be positioned within one or more of bit box slot 2104, housing slot 2108, and upper mandrel slot 2210.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A drilling dynamics data recorder positioned within a slot in a downhole tool, the drilling dynamics data recorder comprising:

a sensor package, the sensor package comprising a plurality of drilling dynamics sensors;

a processor, the processor in data communication with the plurality of drilling dynamics sensors, wherein the processor is configured to remain powered during a deep-sleep mode and wherein the processor does not function in deep-sleep mode except to receive a wake-up signal to transition the processor from the deep-sleep mode to a stand-by mode;

a real-time clock in data communication with the processor, wherein the real-time clock is configurable in at least the deep-sleep mode and an active mode, wherein the real-time clock is powered off in the deep-sleep mode;

a memory module, the memory module in data communication with the plurality of drilling dynamics sensors;

a communication port, the communication port in data communication with the memory module;

an electrical energy source, the electrical energy source in electrical communication with the memory module, the plurality of drilling dynamics sensors, and the processor;

a disk, wherein the disk includes a recorder cap and a recorder carrier, wherein the recorder cap is removable from the recorder carrier, wherein the recorder carrier is enclosed by the recorder cap, and wherein the sensor package, memory module, processor, communication port, and battery are housed within the disk; and a location pin formed as part of or mechanically coupled to the recorder carrier and configured to engage a locator slot;

wherein during the stand-by mode an at least one drilling dynamics sensor, but less than all drilling dynamics sensors, is an active sensor that upon detecting a pre-determined event, the processor sends a command to the remaining sensors to begin measurement of data and the memory module to begin logging data.

2. The drilling dynamics data recorder of claim 1, wherein the electrical energy source comprises a rechargeable or non-rechargeable battery.

3. The drilling dynamics data recorder of claim 2, wherein the electrical energy source further comprises an energy harvesting device.

4. The drilling dynamics data recorder of claim 2, wherein the drilling dynamics data recorder further comprises:

a pressure barrel, wherein the pressure barrel is cylindrical and wherein the sensor package, memory module, processor, and battery are housed within the pressure barrel, the pressure barrel having a memory dump end cap and wherein the communication port protrudes through the memory dump end cap.

5. The drilling dynamics data recorder of claim 4, wherein the slot is covered with a hatch cover.

6. The drilling dynamics data recorder of claim 2, wherein the drilling dynamics data recorder is at atmospheric or near-atmospheric pressure.

7. The drilling dynamics data recorder of claim 2, wherein the plurality of drilling dynamics sensors are a combination of two or more of a low-g accelerometer, a high-g accelerometer, a temperature sensor, a gyroscope, a Hall-effect sensor, a magnetometer, and a strain gauge.

8. The drilling dynamics data recorder of claim 2, wherein the drilling dynamics data recorder is self-contained.

9. The drilling dynamics data recorder of claim 1 wherein the sensor package, memory module and processor are positioned within a data/sensor module.

10. The drilling dynamics data recorder of claim 9, wherein the drilling dynamics data recorder is positioned within a screw housing, the screw housing having threads.

11. The drilling dynamics data recorder of claim 10, wherein the slot includes thread and wherein the screw housing is threadedly coupled to the slot.

12. A drilling dynamics data recorder system comprising:

a drilling dynamics data recorder, the drilling dynamics data recorder including:

a sensor package, the sensor package comprising a plurality of drilling dynamics sensors a memory module, the memory module in data communication with the sensor package;

a communication port, the communication port in data communication with the memory module;

a processor, the processor in data communication with the drilling dynamics sensor, wherein the processor is configured to remain powered during a deep-sleep mode and wherein the processor does not function in deep-sleep mode except to receive a wake-up signal to transition the processor from the deep-sleep mode to a stand-by mode;

a real-time clock in data communication with the processor, wherein the real-time clock is configurable in at least the deep-sleep mode and an active mode, wherein the real-time clock is powered off in the deep-sleep mode;

an electrical energy source, the electrical energy source in electrical communication with the memory module, the sensor package, and the processor;

a disk, wherein the disk includes a recorder cap and a recorder carrier, wherein the recorder cap is removable from the recorder carrier, wherein the recorder carrier is enclosed by the recorder cap, wherein the sensor package, memory module, processor, communication port, processor and electrical energy source are housed within the disk; and wherein the communication port is accessible by removing the recorder cap from the recorder carrier;

a location pin formed as part of or mechanically coupled to the recorder carrier and configured to engage a locator slot; and a downhole tool having a slot, wherein the disk is positioned within the slot;

wherein during the stand-by mode an at least one drilling dynamics sensor, but less than all drilling dynamics sensors, is an active sensor that upon detecting a pre-determined event, the processor sends a command to the remaining sensors to begin measurement of data and the memory module to begin logging data.

13. The drilling dynamics data recorder system of claim 12, wherein the electrical energy source is a rechargeable battery or a non-rechargeable battery.

14. The drilling dynamics data recorder system of claim 12, wherein the downhole tool comprises a carrier sub, wherein the drilling dynamics data recorder is positioned within the downhole tool.

15. The drilling dynamics data recorder system of claim 12, wherein the downhole tool comprises a mud motor, the mud motor having a top sub, a rotor catch, a transmission, and a bit box, the drilling dynamics data recorder system comprising one or more of a top sub recorder, a rotor catch recorder, a transmission recorder, and a bit box recorder.

16. The drilling dynamics data recorder system of claim 12, wherein the downhole tool comprises a friction reduction tool and wherein the drilling dynamics data recorder is positioned within the friction reduction tool.

17. The drilling dynamics data recorder system of claim 12, wherein the downhole tool comprises a drill bit and wherein the drilling dynamics data recorder is positioned within the drill bit.

18. The drilling dynamics data recorder of claim 12, wherein the downhole tool comprises a near-bit stabilizer, wherein the drilling dynamics data recorder is positioned within the near-bit stabilizer.

19. The drilling dynamics data recorder of claim 12, wherein the downhole tool comprises a string stabilizer, wherein the drilling dynamics data recorder is positioned within the string stabilizer.

20. The drilling dynamics data recorder of claim 12, wherein the downhole tool comprises a reamer, wherein the drilling dynamics data recorder is positioned within the reamer.

21. The drilling dynamics data recorder of claim 12, wherein the downhole tool comprises an underreamer, wherein the drilling dynamics data recorder is positioned within the underreamer.

22. The drilling dynamics data recorder of claim 12, wherein the downhole tool comprises a ball seat assembly, wherein the drilling dynamics data recorder is positioned within the ball seat assembly.

23. The drilling dynamics data recorder of claim 12, wherein the downhole tool comprises a stick-slip mitigation tool, wherein the drilling dynamics data recorder is positioned within the stick-slip mitigation tool.

24. The drilling dynamics data recorder of claim 12, wherein the downhole tool comprises a turbine, wherein the drilling dynamics data recorder is positioned within the turbine.

25. The drilling dynamics data recorder of claim 12, wherein the downhole tool comprises a steering tool, wherein the steering tool is mechanically coupled to an upper mandrel and a bit box, and wherein one or more drilling dynamics data recorders are positioned within the upper mandrel, bit box, steering tool, or a combination thereof.

26. A method comprising:

providing a drilling dynamics data recorder, the drilling dynamics data recorder positioned within a downhole tool, the drilling dynamics data recorder including:

a sensor package, the sensor package comprising a plurality of digital solid-state drilling dynamics sensors;

a memory module, the memory module in data communication with the sensor package;

a communication port, the communication port in data communication with the memory module;

a processor, the processor in data communication with the drilling dynamics sensor, wherein the processor is configured to remain powered during a deep- sleep mode and wherein the processor does not function in deep-sleep mode except to receive a wake-up signal to transition the processor from the deep-sleep mode to a stand-by mode;;

a real-time clock in data communication with the processor, wherein the real-time clock is configurable in at least the deep-sleep mode and an active mode, wherein the real-time clock is powered off in the deep-sleep mode; and an electrical energy source, the electrical energy source in electrical communication with the memory module, the sensor package, and the processor;

wherein during the stand-by mode an at least one drilling dynamics sensor, but less than all drilling dynamics sensors, is an active sensor that upon detecting a pre-determined event, the processor sends a command to the remaining sensors to begin measurement of data and the memory module to begin logging data;

positioning the downhole tool within a wellbore;

taking measurements using the drilling dynamics sensors; and transmitting the measurements from the drilling dynamics sensors to the memory module; and memory logging the measurements from the plurality of drilling dynamics sensors in the memory module to form drilling dynamics data.

27. The method of claim 26, further comprising after the step of memory logging the measurements from the drilling dynamics sensors in the memory module:

removing the downhole tool from the wellbore; and retrieving the drilling dynamics data with a surface processor.

28. The method of claim 27, further comprising using the drilling dynamics data for post run evaluation of drilling dynamics, frequency spectrum, statistical analysis, CBM, or a combination thereof.

29. The method of claim 28, further comprising prior to positioning the downhole tool within the wellbore, maintaining the drilling dynamics data recorder in deep-sleep mode.

30. The method of claim 26, wherein the drilling dynamics sensors burst data to the memory module at a burst data frequency.

31. The method of claim 30, wherein the burst data log interval is between 1 and 60 seconds.

32. The method of claim 31, wherein the sensors include memory and wherein the burst data is stored in the sensor's memory.

33. The method of claim 31, wherein the sensors include sensor memory, and wherein continuously sampled data is stored in sensory memory.

34. The method of claim 26, wherein the drilling dynamics data is calibrated for temperature.

35. The method of claim 26, wherein the drilling dynamics sensors have ranges and wherein the ranges are changed while the downhole tool is within the wellbore.

36. The method of claim 26, wherein the drilling dynamics sensors have a sampling frequency and wherein the sample frequency is changed while the downhole tool is within the wellbore.

37. The method of claim 26, wherein the drilling dynamics sensors include an anti-aliasing filter and the anti-aliasing filter is changed while the downhole tool is within the wellbore.

38. The method of claim 26, further comprising communicating with an MWD through the communications port.

39. A downhole tool having a bearing assembly, the bearing assembly comprising:

an upper bearing housing, the upper bearing housing including an upper bearing housing outer surface, the upper bearing housing outer surface being generally cylindrical along a bearing housing longitudinal axis, the upper bearing housing including an upper bearing housing bore formed therein defining an upper bearing housing inner surface, the upper bearing housing bore being generally cylindrical and formed along a bore longitudinal axis, the bore longitudinal axis being formed at an angle to the bearing housing longitudinal axis;

a lower bearing housing, the lower bearing housing mechanically coupled to the upper bearing housing, the lower bearing housing including a lower bearing housing bore formed along the bore longitudinal axis defining a lower bearing housing inner surface; and a driveshaft, the driveshaft positioned within and concentric with the upper bearing housing bore and the lower bearing housing bore, such that it extends along the bore longitudinal axis, the driveshaft including a bit box;

a first drilling dynamics data recorder positioned within a slot in the upper bearing housing, the drilling dynamics data recorder including:

a sensor package, the sensor package comprising a plurality of drilling dynamics sensors;

a memory module, the memory module in data communication with the sensor package;

a communication port, the communication port in data communication with the memory module;

a processor, the processor in data communication with the drilling dynamics sensor, wherein the processor is configured to remain powered during a deep-sleep mode and wherein the processor does not function in deep-sleep mode except to receive a wake-up signal to transition the processor from the deep-sleep mode to a stand-by mode;

a real-time clock in data communication with the processor, wherein the real-time clock is configurable in at least the deep-sleep mode and an active mode, wherein the real-time clock is powered off in the deep-sleep mode; and an electrical energy source, the electrical energy source in electrical communication with the memory module, the sensor package, and the processor, wherein during the stand-by mode an at least one drilling dynamics sensor, but less than all drilling dynamics sensors, is an active sensor that upon detecting a pre-determined event, the processor sends a command to the remaining sensors to begin measurement of data and the memory module to begin logging data.

40. The downhole tool of claim 39 having a second drilling dynamics data recorder positioned within a slot adjacent to or within the bit box.

41. The downhole tool of claim 39 further comprising:

a transmission section, the transmission section coupled to the bearing assembly;

a power section, the power section coupled to the transmission section;

and a top sub, the top sub coupled to the transmission section, a third drilling dynamics data recorder positioned within a slot in the top sub.

* * * * *